US007247421B2

(12) United States Patent
Ohzeki

(10) Patent No.: US 7,247,421 B2
(45) Date of Patent: Jul. 24, 2007

(54) IMAGE FORMING METHOD USING PHOTOTHERMOGRAPHIC MATERIAL

(75) Inventor: Tomoyuki Ohzeki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/357,006

(22) Filed: Feb. 21, 2006

(65) Prior Publication Data

US 2006/0199113 A1 Sep. 7, 2006

(30) Foreign Application Priority Data

Mar. 4, 2005 (JP) ..... 2005-061251

(51) Int. Cl.
*G03C 5/16* (2006.01)
*G03C 7/32* (2006.01)
*G03C 1/498* (2006.01)

(52) U.S. Cl. ..... 430/350; 430/363; 430/365; 430/503; 430/531; 430/619

(58) Field of Classification Search ..... 430/350, 430/619, 503, 531, 363, 365
See application file for complete search history.

(56) References Cited

U.S. PATENT DOCUMENTS 6,927,406 B2 * 8/2005 Zyromski ..... 250/496.1
2002/0110763 A1 * 8/2002 Matsumoto et al. ..... 430/350

* cited by examiner

*Primary Examiner*—Thorl Chea
(74) *Attorney, Agent, or Firm*—Margaret A. Burke; Sheldon J. Moss

(57) ABSTRACT

An image forming method using a photothermographic material including, on a support, at least a photosensitive silver halide, a non-photosensitive organic silver salt, a reducing agent for silver ions, and a binder, wherein the photothermographic material includes at least two image forming layers having spectral sensitivities that are different from each other, and wherein the image forming method includes: imagewise exposing the photothermographic material by using at least two laser beams having wavelengths that are different from each other and correspond to photosensitive wavelengths of the image forming layers; and thermally developing the photothermographic material to form a fusion image made up of two or more kinds of image information. An image forming method using a photothermographic material which records a composite image made up of a silver image and a color image of different kinds of image information is provided.

17 Claims, 1 Drawing Sheet

IMAGE FORMING METHOD USING PHOTOTHERMOGRAPHIC MATERIAL

CROSS-REFERENCE TO RELATED APPLICATION

This application claims priority under 35 USC 119 from Japanese Patent Application No. 2005-061251, the disclosure of which is incorporated by reference herein.

BACKGROUND OF THE INVENTION

1. Field of the Invention

The present invention relates to an image forming method using a photothermographic material. More particularly, the invention relates to an image forming method using a photothermographic material forming a fusion image useful as a medical diagnosis image.

2. Description of the Related Art

In recent years, in the photographic image forming field, there has been a strong desire for providing a dry photographic development process from the viewpoints of protecting the environment and economy of space. In this field, from the standpoints of high sensitivity and high image quality, a silver halide photographic photosensitive material has conventionally been used. However, for the purpose of forming an image, after imagewise exposure, wet processing steps including, for example, a color development step, a desilvering bleaching processing step and a water washing stabilizing processing step, management of processing solutions for these steps and waste solution processing are required. These have been large obstacles for realizing convenient and rapid image forming.

Photothermographic materials utilizing organic silver salts are already known. Photothermographic materials have an image forming layer in which a reducible silver salt (for example, an organic silver salt), a photosensitive silver halide, and if necessary, a toner for controlling the color tone of developed silver images are dispersed in a binder.

Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region.

On the other hand, as for color image forming methods, a method utilizing a coupling reaction between a coupler and an oxidization product of a developing agent is most common, and a photothermographic material adopting this method is described in U.S. Pat. Nos. 3,761,270 and 4,021,240, and Japanese Patent Application Laid-Open (JP-A) Nos. 59-231539 and 60-128438. In these patents, p-sulfonamide phenol has been used as a developing agent. All patents, patent publications, and non-patent literature cited in this specification are hereby expressly incorporated by reference herein. Since couplers do not have absorption in the visible region before processing, the photothermographic material based on a coupling method is more advantageous from the standpoint of sensitivity than a photothermographic material using a color forming material containing a dye that is already formed and is considered to be advantageous in that it can be used not only as a printing material but also as a photographing material. However, in the method of incorporating p-sulfonamide phenol, since p-sulfonamide phenol is deteriorated in the photothermographic material before development processing, there has been a problem in that an appropriate image can not be obtained. As for methods for solving this problem, photothermographic materials each containing a blocked p-phenylene diamine-type developing agent and processing methods therefor are proposed by European Patent (EP) Nos. 1,113,316A2, 1,113,322A2, 1,113,323A2, 1,113,324A2, 1,113,325A2, and 1,113,326A2; JP-A Nos. 2001-312026, 2003-215767 and 2003-215764; and U.S. Pat. No. 6,242,166.

However, in these photothermographic materials, since silver halide remains in a film after image forming, film turbidity and opacity become high due to light absorption and light scattering caused by such remaining silver halide, and therefore, such film is not appropriate for use in practically viewing a color image. For example, as shown in the Examples described in JP-A Nos. 2001-312026, 2003-215767 and 2003-215764; and U.S. Pat. No. 6,242,166, fogging becomes extremely high and is as high as 0.58 to 1.2. Further, in a portion in which the color image is formed, since a black image caused by developed silver is added on the thus-fogged image, it is difficult to directly view it as a color image. Therefore, as explained in the aforementioned references, the obtained image is a primary image and is not an image for being directly viewed, and accordingly, the image is digitalized, and image processing is performed to reduce fogging and adjust gradation and color tone, whereby it is attempted to form a reprocessed image which can be provided for viewing.

On the other hand, in the medical diagnostic image field, in recent years, the importance of diagnostic procedures for nuclear medicine such as PET (Positron Emission Tomography) and SPECT (Single Emission Computed Tomography) has been increasing. However, since there is scarce anatomic information available for these functional images, morphological images such as CT (Computed Tomography) and MRI (Magnetic Resonance Imaging) are separately photographed and placed on a display side by side, and a diagnosis is executed by comparing these images. Further, a technique for integrating the morphological image and the functional image on a display by utilizing software programming has been developed.

Since images are separately photographed in the above described technique, there are problems such as difficulty in registry of positioning and changes in images over time.

In order to solve these problems, in recent years, as described in Image Information Medical, November Issue, pp. 1302 to 1347 (2004), a PET-CT hybrid apparatus has been developed. Since the PET-CT hybrid apparatus can almost simultaneously photograph a PET image and a CT image and then place a fusion image made up of these images on a display, it is excellent in diagnostic performance.

Such fusion images are ordinarily represented on the display such that morphological images such as CT or MRI are shown in black-and-white while functional images such as PET or SPECT are shown in color. However, although these images can be displayed on a screen of a monitor, there is no device available at present which can produce a hard print with high precision and high quality such as can be obtained by a black-and-white laser printer for medical diagnosis. With the recent increasing social demand for open medical information and execution of an informed consent, preparation of a hard print of high quality has strongly been desired.

SUMMARY OF THE INVENTION

The present invention has been made in view of the above circumstances and provides an image forming method using a photothermographic material comprising, on a support, at least a photosensitive silver halide, a non-photosensitive organic silver salt, a reducing agent for silver ions, and a binder, wherein the photothermographic material comprises at least two image forming layers having spectral sensitivities that are different from each other, and wherein the image forming method comprises: exposing the photothermographic material with different kinds of image information by using at least two laser beams having wavelengths that are different from each other and correspond to photosensitive wavelengths of the image forming layers; and thermally developing the photothermographic material to form a fusion image made up of two or more kinds of the image information.

DETAILED DESCRIPTION OF THE INVENTION

Figure 1:
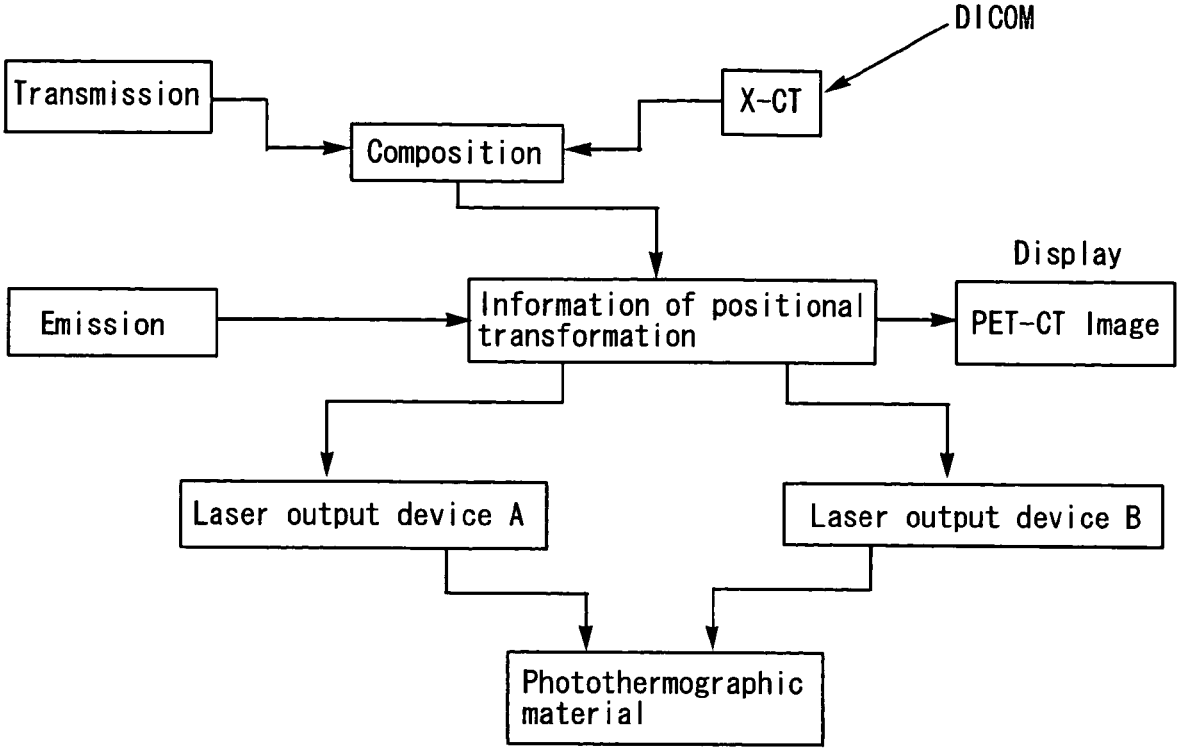
FIG. 1 is a simplified block diagram showing an example of a method for forming a fusion image using a photothermographic material according to the invention.

An object of the present invention is to provide an image forming method using a photothermographic material which records a composite image comprising a silver image and a color image each having different kinds of image information. More specifically, an aspect of the present invention is to provide an image forming method using a photothermographic material forming a fusion image useful for medical diagnosis.

The present invention is explained below in detail.

(Photothermographic Material)

The photothermographic material of the present invention has, on a support, at least two image forming layers including at least a photosensitive silver halide, a non-photosensitive organic silver salt, a reducing agent for silver ions, and a binder, wherein the image forming layers have spectral sensitivities that are different from each other.

A fusion image made up of two or more kinds of image information can be formed on one photothermographic material by using the photothermographic material of the present invention and imagewise exposing the photothermographic material using at least two laser beams having wavelengths that are different from each other and correspond to photosensitive wavelengths of the image forming layers.

Preferably, the fusion image is formed by at least one kind of image information which is medical morphological information and at least one other kind of image information which is medical functional information.

Preferably, the medical morphological information is CT (Computed Tomography) information or MRI (Magnetic Resonance Imaging) information, and the medical functional information is PET (Positron Emission Tomography) information or SPECT (Single Photon Emission Computed Tomography) information. Most preferably, an image is formed by fusing CT information or MRI information as the medical morphological information and PET information or SPECT information as the medical functional information.

As one of the preferred embodiments, at least one layer of the image forming layers is a silver image forming layer which forms an image substantially constituted by a silver image, and at least one other layer of the image forming layers is a color image forming layer which contains a coupler forming a dye.

As another preferred embodiment, at least two layers of the image forming layers form color images having different hues from each other.

These image forming layers may be disposed together on one side of the support, or they may be disposed so that one image forming layer is on one side of the support and the other image forming layer is on the other side of the support.

Plural kinds of image information that are different from one another can be recorded in the photothermographic material by performing imagewise exposure by light sources respectively corresponding to spectral sensitivities of the image forming layers. After thermal development, the plural kinds of image information are recorded as a composite image in which, for example, a silver image and a color image, or color images with different hues are overlapped. For example, in the case where the image forming method of the present invention is applied to a medical image recording material, provided that one kind of image information is based on morphological information and the other kind of image information is based on functional information, a photographed region can be reproduced as the morphological information, and the functional information of the region is shown therewith. Thus, change and abnormality can be judged with accuracy. The morphological information and the functional information can be recorded in either of two image forming layers; for example, the morphological information may be recorded as a silver image and the functional information recorded as a color image, or vice versa.

According to the present invention, an image forming method using a photothermographic material which records a composite image comprising a silver image and a color image each having a different kind of information is provided. Especially, the present invention provides an image forming method using a photothermographic material which forms a fusion image useful for medical diagnosis.

The reducing agent incorporated in the photothermographic material of the present invention is a compound which hardly has absorption in the visible light region. When the photothermographic material is subjected to thermal development, the compound itself functions as a reducing agent or releases a reducing agent to reduce silver ions, and an oxidation product of the compound itself or an oxidation product of the released reducing agent is produced. These oxidation products react with a coupler compound to form a dye and thereby yield an imagewise dye image corresponding to the silver image.

(Reducing Agent: Compound Represented by Formula (I))

The compound represented by formula (I) of the present invention is explained below in detail.

Formula (I)

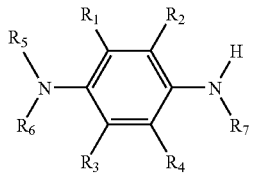

In formula (I), $R_1$, $R_2$, $R_3$, and $R_4$ each independently represent a hydrogen atom or a substituent. $R_5$ and $R_6$ each independently represent one selected from an alkyl group, an aryl group, a heterocyclic group, an acyl group, or a sulfonyl group, wherein members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring. $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_2$—CONHCO—, $R_{21}$—$SO_2$NH$SO_2$—, $R_{22}$—CONH$SO_2$—, or $(M)_{1/n}$ O$SO_2$—, wherein $R_{11}$, $R_{12}$, $R_{13}$, $R_{14}$, $R_{19}$, $R_{20}$, $R_{21}$, and $R_{22}$ each independently represent one selected from an alkyl group, an aryl group, or a heterocyclic group. $R_{15}$ represents a hydrogen atom or a block group. W represents an oxygen atom, a sulfur atom, or —N($R_{18}$)—. $R_{16}$, $R_{17}$, and $R_{18}$ each independently represent one selected from a hydrogen atom or an alkyl group, and M represents a cation having a valency of n.

$R_1$, $R_2$, $R_3$, and $R_4$ each independently represent a hydrogen atom or a substituent. Examples of the substituent represented by $R_1$, $R_2$, $R_3$, and $R_4$ include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxy group, a nitro group, a carboxy group, an alkoxy group, an aryloxy group, silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imide group, a phosphino group, a phosphinyl group, a phosphinyloxy group, a phosphinylamino group, and a silyl group.

Further in detail, a halogen atom (for example, a chlorine atom, a bromine atom, or an iodine atom), an alkyl group [which represents a substituted or unsubstituted, linear, branched, or cyclic alkyl group; an alkyl group (preferably, an alkyl group having 1 to 30 carbon atoms; for example, methyl, ethyl, n-propyl, isopropyl, t-butyl, n-octyl, eicosyl, 2-chloroethyl, 2-cyanoethyl, and 2-ethylhexyl), a cycloalkyl group (preferably, a substituted or unsubstituted cycloalkyl group having 3 to 30 carbon atoms; for example, cyclohexyl, cyclopentyl, and 4-n-dodecylcyclohexyl), a bicycloalkyl group (preferably, a substituted or unsubstituted bicycloalkyl group having 5 to 30 carbon atoms, namely, it means a monovalent group obtained by removing one hydrogen atom from bicycloalkane having 5 to 30 carbon atoms; for example, bicyclo[1,2,2]heptan-2-yl, bicyclo[2,2,2]octan-3-yl), and further a tricyclo structure having many cyclic structures, and the like are included; an alkyl group included in a substituent described below (for example, an alkyl group in an alkylthio group) also represents the alkyl group of this concept], an alkenyl group [which represents a substituted or unsubstituted, linear, branched, or cyclic alkenyl group; an alkenyl group (preferably, an alkenyl group having 2 to 30 carbon atoms; for example, vinyl, allyl, prenyl, gelanyl, and oleyl), a cycloalkenyl group (preferably, a substituted or unsubstituted cycloalkenyl group having 3 to 30 carbon atoms, namely, it means a monovalent group obtained by removing one hydrogen atom from cycloalkene having 3 to 30 carbon atoms; for example, 2-cyclopenten-1-yl and 2-cyclohexen-1-yl), a bicycloalkenyl group (a substituted or unsubstituted bicycloalkenyl group, and preferably, a substituted or unsubstituted bicycloalkenyl group having 5 to 30 carbon atoms, namely, it means a monovalent group obtained by removing one hydrogen atom from bicycloalkene having one double bond; for example, bicyclo[2,2,1]hepto-2-en-1-yl, bicyclo[2,2,2]octo-2-en-4-yl) are described], an alkynyl group (preferably, a substituted or unsubstituted alkynyl group having 2 to 30 carbon atoms; for example, ethynyl, propargyl, and a trimethylsilylethynyl group), an aryl group (preferably, a substituted or unsubstituted aryl group having 6 to 30 carbon atoms; for example, phenyl, p-tolyl, naphthyl, m-chlorophenyl, and o-hexadecanoylaminophenyl), a heterocyclic group (preferably, a monovalent group obtained by removing one hydrogen atom from 5- or 6-membered, substituted or unsubstituted, aromatic or non-aromatic heterocyclic compound, more preferably, a 5- or 6-membered heterocyclic group having 3 to 30 carbon atoms; for example, 2-furyl, 2-ethynyl, 2-pyrimidinyl, and 2-benzothiazolyl), a cyano group, a hydroxy group, a nitro group, a carboxy group, an alkoxy group (preferably, a substituted or unsubstituted alkoxy group having 1 to 30 carbon atoms; for example, methoxy, ethoxy, isopropoxy, t-butoxy, n-octyloxy, and 2-methoxyethoxy), an aryloxy group (preferably, a substituted or unsubstituted aryloxy group having 6 to 30 carbon atoms; for example, phenoxy, 2-methylphenoxy, 4-t-butylphenoxy, 3-nitrophenoxy, and 2-tetradecanoylaminophenoxy), a silyloxy group (preferably, a silyloxy group having 3 to 20 carbon atoms; for example, trimethylsilyloxy and t-butyldimethylsilyloxy), a heterocyclic oxy group (preferably, a substituted or unsubstituted heterocyclic oxy group having 2 to 30 carbon atoms; for example, 1-phenyltetrazole-5-oxy and 2-tetrahydropyranyloxy), an acyloxy group (preferably, a formyloxy group, a substituted or unsubstituted alkylcarbonyloxy group having 2 to 30 carbon atoms, or a substituted or unsubstituted arylcarbonyloxy group having 6 to 30 carbon atoms; for example, formyloxy, acetyloxy, pivaloyloxy, stearoyloxy, benzoyloxy, and p-methoxyphenylcarbonyloxy), a carbamoyloxy group (preferably, a substituted or unsubstituted carbamoyloxy group having 1 to 30 carbon atoms; for example, N,N-dimethylcarbamoyloxy, N,N-diethylcarbamoyloxy, morpholinocarbonyloxy, N,N-di-n-octylaminocarbonyloxy, and N-n-octylcarbamoyloxy), an alkoxycarbonyloxy group (preferably, a substituted or unsubstituted alkoxycarbonyloxy group having 2 to 30 carbon atoms; for example, methoxycarbonyloxy, ethoxycarbonyloxy, t-butoxycarbonyloxy, and n-octylcarbonyloxy), an aryloxycarbonyloxy group (preferably, a substituted or unsubstituted aryloxycarbonyloxy group having 7 to 30 carbon atoms; for example, phenoxycarbonyloxy, p-methoxyphenoxycarbonyloxy, and p-n-hexadecyloxyphenoxycarbonyloxy), an amino group (preferably, an amino group, a substituted or unsubstituted alkylamino group having 1 to 30 carbon atoms, or a substituted or unsubstituted anilino group having 6 to 30 carbon atoms; for example, amino, methylamino, dimethylamino, anilino, N-methyl-anilino, and diphenylamino), an acylamino group (preferably, a formylamino group, a substituted or unsubstituted alkylcarbonylamino group having 1 to 30 carbon atoms, or a substituted or unsubstituted arylcarbonylamino group having 6 to 30 carbon atoms; for example, formylamino, acetylamino, pivaloylamino, lauroylamino, benzoylamino, and 3,4,5-tri-n-octyloxyphenylcarbonylamino), an aminocarbonylamino group (preferably, a substituted or unsubstituted aminocarbonylamino group having 1 to 30 carbon atoms; for example, carbamoylamino, N,N-dimethylaminocarbonylamino, N,N-diethylaminocarbonylamino, and morpholinocarbonylamino), an alkyloxycarbonylamino group (preferably, a substituted or unsubstituted alkoxycarbonylamino group having 2 to 30 carbon atoms; for example, methoxycarbonylamino, ethoxycarbonylamino, t-butoxycarbonylamino, n-octadecyloxycarbonylamino, and N-methyl-methoxycarbonylamino), an aryloxycarbonylamino group (preferably, a substituted or unsubstituted aryloxycarbonylamino group having 7 to 30 carbon atoms; for example, phenoxycarbonylamino, p-chlorophenoxycarbonylamino, and m-n-octyloxyphenoxycarbonylamino), a sulfamoylamino group (preferably, a substituted or unsubstituted sulfamoylamino group having 0 to 30 carbon atoms; for example, sulfamoylamino, N,N-dimethylaminosulfonylamino, and N-n-octylaminosulfonylamino), an alkylsulfonylamino group and an arylsulfonylamino group (preferably, a substituted or unsubstituted alkylsulfonylamino group having 1 to 30 carbon atoms and a substituted or unsubstituted arylsulfonylamino group having 6 to 30 carbon atoms; for example, methylsulfonylamino, butylsulfonylamino, phenylsulfonylamino, 2,3,5-trichlorophenylsulfonylamino, and p-methylphenylsulfonylamino), a mercapto group, an alkylthio group (preferably, a substituted or unsubstituted alkylthio group having 1 to 30 carbon atoms; for example, methylthio, ethylthio, and n-hexadecylthio), an arylthio group (preferably, a substituted or unsubstituted arylthio group having 6 to 30 carbon atoms; for example, phenylthio, p-chlorophenylthio, and m-methoxyphenylthio), a heterocyclic thio group (preferably, a substituted or unsubstituted heterocyclic thio group having 2 to 30 carbon atoms; for example, 2-benzothiazolylthio and 1-phenyltetrazol-5-ylthio), a sulfamoyl group (preferably, a substituted or unsubstituted sulfamoyl group having 0 to 30 carbon atoms; for example, N-ethylsulfamoyl, N-(3-dodecyloxypropyl)sulfamoyl, N,N-dimethylsulfamoyl, N-acetylsulfamoyl, N-benzoylsulfamoyl, and N—(N'-phenylcarbamoyl)sulfamoyl), a sulfo group, an alkylsulfinyl group and an arylsulfinyl group (preferably, a substituted or unsubstituted alkylsulfinyl group having 1 to 30 carbon atoms and a substituted or unsubstituted arylsulfinyl group having 6 to 30 carbon atoms; for example, methylsulfinyl, ethylsulfinyl, phenylsulfinyl, and p-methylphenylsulfinyl), an alkylsulfonyl group and an arylsulfonyl group (preferably, a substituted or unsubstituted alkylsulfonyl group having 1 to 30 carbon atoms and a substituted or unsubstituted arylsulfonyl group having 6 to 30 carbon atoms; for example, methylsulfonyl, ethylsulfonyl, phenylsulfonyl, and p-methylphenylsulfonyl), an acyl group (preferably, a formyl group, a substituted or unsubstituted alkylcarbonyl group having 2 to 30 carbon atoms, and a substituted or unsubstituted arylcarbonyl group having 7 to 30 carbon atoms; for example, acetyl, pivaloyl, 2-chloroacetyl, stearoyl, benzoyl, and p-n-octyloxyphenylcarbonyl), an aryloxycarbonyl group (preferably, a substituted or unsubstituted aryloxycarbonyl group having 7 to 30 carbon atoms; for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms; for example, methoxycarbonyl, ethoxycarbonyl, t-butoxycarbonyl, and n-octadecyloxycarbonyl), a carbamoyl group (preferably, a substituted or unsubstituted carbamoyl group having 1 to 30 carbon atoms; for example, carbamoyl, N-methylcarbamoyl, N,N-dimethylcarbamoyl, N,N-di-n-octylcarbamoyl, and N-(methylsulfonyl)carbamoyl), an arylazo group and a heterocyclic azo group (preferably, a substituted or unsubstituted arylazo group having 6 to 30 carbon atoms and a substituted or unsubstituted heterocyclic azo group having 3 to 30 carbon atoms; for example, phenylazo, p-chlorophenylazo, and 5-ethylthio-1,3,4-thiadiazol-2-ylazo), an imide group (for example, N-succinimide and N-phthalimide), a phosphino group (preferably, a substituted or unsubstituted phosphino group having 2 to 30 carbon atoms; for example, dimethylphosphino, diphenylphosphino, and methylphenoxyphosphino), a phosphinyl group (preferably, a substituted or unsubstituted phosphinyl group having 2 to 30 carbon atoms; for example, phosphinyl, dioctyloxyphosphinyl, and diethoxyphosphinyl), a phosphinyloxy group (preferably, a substituted or unsubstituted phosphinyloxy group having 2 to 30 carbon atoms; for example, diphenoxyphosphinyloxy and dioctyloxyphosphinyloxy), a phosphinylamino group (preferably, a substituted or unsubstituted phosphinylamino group having 2 to 30 carbon atoms; for example, dimethoxyphosphinylamino and dimethylaminophosphinylamino), a silyl group (preferably, a substituted or unsubstituted silyl group having 3 to 30 carbon atoms; for example, trimethylsilyl, t-butyldimethylsilyl, and phenyldimethylsilyl) are described.

When the group represented by $R_1$ to $R_4$ is a group capable of being further substituted, the group represented by $R_1$ to $R_4$ may further have a substituent, and in that case, preferable substituent is the group having the same meaning as the substituent described in the explanation of $R_1$ to $R_4$. When the group represented by $R_1$ to $R_4$ is substituted by two or more substituents, those substituents may be the same or different.

$R_5$ and $R_6$ each independently represent one selected from an alkyl group, aryl group, a heterocyclic group, an acyl group, an alkylsulfonyl group, or an arylsulfonyl group. Preferable ranges of the alkyl group, aryl group, heterocyclic group, acyl group, alkylsulfonyl group, or arylsulfonyl group represents the groups having the same meaning as the alkyl group, aryl group, heterocyclic group, acyl group, alkylsulfonyl group, or arylsulfonyl group which are explained in the group represented by $R_1$ to $R_4$. When the group represented by $R_5$ or $R_6$ is a group capable of being further substituted, the group represented by $R_5$ or $R_6$ may further have a substituent, and in that case, preferable substituent represents the group having the same meaning as the substituent described in the explanation of $R_1$ to $R_4$. When the group represented by $R_5$ or $R_6$ is substituted by two or more substituents, those substituents may be the same or different.

Members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring.

$R_7$ in formula (I) represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_{20}$—CONHCO—, $R_{21}$—$SO_2NHSO_2$—, $R_{22}$—$CONHSO_2$—, or $(M)_{1/n}OSO_2$—, wherein $R_{11}$, $R_{12}$, $R_{13}$, $R_{14}$, $R_{19}$, $R_{20}$, $R_{21}$, and $R_{22}$ each independently represent one selected from an alkyl group, an aryl group, or a heterocyclic group. $R_{15}$ represents a hydrogen atom or a block group, W represents an oxygen atom, a sulfur atom, or —N($R_{18}$)— and $R_{16}$, $R_{17}$ and $R_{18}$ represent one selected from a hydrogen atom or an alkyl group. The alkyl group, aryl group and heterocyclic group represented by $R_{11}$, $R_{12}$, $R_{13}$, $R_{14}$, $R_{19}$, $R_{20}$, $R_{21}$, or $R_{22}$ represent the group having the same meaning as the alkyl group, aryl group and heterocyclic group described in the explanation of the above $R_1$ to $R_4$. M represents a cation having a valency of n. When the group represented by $R_{11}$, $R_{12}$, $R_{13}$, $R_{14}$, $R_{19}$, $R_{20}$, $R_{21}$, or $R_{22}$ is a group capable of being further substituted, the group represented by $R_{11}$, $R_{12}$, $R_{13}$, $R_{14}$, $R_{19}$, $R_{20}$, $R_{21}$, or $R_{22}$ may further have a substituent, and in that case, preferable substituent represents the group having the same meaning as the substituent described in the explanation of $R_1$ to $R_4$. When the group represented by $R_{11}$, $R_{12}$, $R_{13}$, $R_{14}$, $R_{19}$, $R_{20}$, $R_{21}$, or $R_{22}$ is substituted by two or more substituents, those substituents may be the same or different.

When $R_{16}$, $R_{17}$ and $R_{18}$ represent an alkyl group, those represent the group having the same meaning as the alkyl group explained in the substituent represented by $R_1$ to $R_4$. In the case of where $R_{15}$ represents a block group, the block group has the same meaning as the block group represented by BLK, which is described below.

Preferable range of the compound represented by formula (I) is explained below. $R_1$, $R_2$, $R_3$, or $R_4$ is preferably a hydrogen atom, a halogen atom, an alkyl group, an aryl group, an acylamino group, an alkylsulfonylamino group, an arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a hydroxy group, a carboxy group, a sulfo group, a nitro group, a sulfamoyl group, an alkylsulfonyl group, an arylsulfonyl group, or an acyloxy group, and more preferably a hydrogen atom, a halogen atom, an alkyl group, an acylamino group, an alkylsulfonylamino group, an arylsulfonylamino group, an alkoxy group, an alkylthio group, an arylthio group, an alkoxycarbonyl group, a carbamoyl group, a cyano group, a hydroxy group, a carboxy group, a sulfo group, a nitro group, a sulfamoyl group, an alkylsulfonyl group, or an arylsulfonyl group. It is particularly preferable that one of $R_1$ or $R_3$ is a hydrogen atom among $R_1$ to $R_4$.

$R_5$ and $R_6$ are preferably an alkyl group, an aryl group, or a heterocyclic group, and most preferably an alkyl group.

It is preferred from the viewpoint of being compatible in color forming property and storability that the oxidization potential of p-phenylenediamine derivative, in which $R_7$ of the compound represented by formula (I) is a hydrogen atom, is 5 mV or less (with respect to SCE) in an aqueous solution having the pH of 10.

$R_7$ is preferably $R_{11}$—O—CO—, $R_{14}$—$SO_2$—, $R_{19}$—$SO_2$—NH—CO—, or $R_{15}$—W—C($R_{16}$)($R_{17}$)—, more preferably $R_{11}$—O—CO— or $R_{19}$—$SO_2$—NH—CO—, and most preferably $R_{19}$—$SO_2$—NH—CO—. $R_{11}$ is preferably an alkyl group, and $R_{11}$ is preferably a group containing a timing group which causes a cleavage reaction using an electron transfer reaction described in U.S. Pat. Nos. 4,409,323 and 4,421,845, and $R_{11}$ is preferably a group represented by the following formula (T-1), in which the terminal which causes the electron transfer reaction of the timing group is blocked.

$$\text{BLK-W—(X=Y)}_j\text{—C(R}_{21}\text{)R}_{22}\text{—**} \qquad \text{Formula (T-1)}$$

In the formula, BLK represents a block group, **denotes a bond with —O—CO— at this position, W represents an oxygen atom, a sulfur atom, or —N($R_{23}$)—, X and Y each represent a methine or a nitrogen atom, j represents 0, 1, or 2, and $R_{21}$, $R_{22}$ and $R_{23}$ each represent a hydrogen atom or the group having the same meaning as the substituent explained in $R_1$ to $R_4$. Here, when X and Y represent a substituted methine, it may be any of the case in which the substituent and two arbitrary substituents of $R_{21}$, $R_{22}$, and $R_{23}$ bond together to form a cyclic structure (for example, a benzene ring or a pyrazole ring) and the case in which a cyclic structure is not formed.

As a block group represented by BLK, known compounds can be used. Namely, a block group such as an acyl group, a sulfonyl group, and the like described in Japanese Patent Application Publication (JP-B) No. 48-9968, JP-A Nos. 52-8828, 57-82834, U.S. Pat. No. 3,311,476, JP-B No. 47-44805 (U.S. Pat. No. 3,615,617), and the like, a block group utilizing the reverse Michael reaction described in JP-B Nos. 55-17369 (U.S. Pat. No. 3,888,677), 55-9696 (U.S. Pat. No. 3,791,830), 55-34927 (U.S. Pat. No. 4,009,029), JP-A Nos. 56-77842 (U.S. Pat. No. 4,307,175), 59-105640, 59-105641, and 59-105642, and the like, a block group utilizing formation of quinonemethide or quinonemethide-like compound by an intramolecular electron transfer described in JP-B No. 54-39727, U.S. Pat. Nos. 3,674,478, 3,932,480, 3,993,661, JP-A Nos. 57-135944, 57-135945 (U.S. Pat. No. 4,420,554), 57-136640, 61-196239, 61-196240 (U.S. Pat. No. 4,702,999), 61-185743, 61-124941 (U.S. Pat. No. 4,639,408), JP-A No. 2-280140 and the like, a blocking group utilizing an intramolecular nucleophilic substitution reaction described in U.S. Pat. Nos. 4,358,525 and 4,330,617, JP-A Nos. 55-53330 (U.S. Pat. No. 4,310,612), 59-121328, 59-218439, and 63-318555 (European Patent Application Laid-Open (EP-A) No. 0295729), and the like, a block group utilizing a ring cleavage reaction of 5- or 6-membered ring described in JP-A Nos. 57-76541 (U.S. Pat. No. 4,335,200), 57-135949 (U.S. Pat. No. 4,350,752), 57-179842, 59-137945, 59-140445, 59-219741, 59-202459, 60-41034 (U.S. Pat. No. 4,618,563), 62-59945 (U.S. Pat. No. 4,888,268), 62-65039 (U.S. Pat. No. 4,772,537), 62-80647, 3-236047, and 3-238445 and the like, a block group utilizing an addition reaction of a nucleophile to a conjugated unsaturated bond described in JP-A Nos. 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596), and 4-186344 and the like, a block group utilizing a β-elimination reaction described in JP-A Nos. 59-93442, 61-32839, and 62-163051, JP-B No. 5-37299, and the like, a block group utilizing a nucleophilic substitution reaction of diarylmethanes described in JP-A No. 61-188540, a block group utilizing the Rossen's transition reaction described in JP-A No. 62-187850, a block group utilizing the reaction of N-acyl compound of thiazolidine-2-thione and amines described in JP-A Nos. 62-80646, 62-144163, and 62-147457 and the like, a block group, which has two electrophilic groups and reacts with a dinucleophilic agent, described in JP-A Nos. 2-296240 (U.S. Pat. No. 5,019,492), 4-177243, 4-177244, 4-177245, 4-177246, 4-177247 4-177248, 4-177249, 4-179948, 4-184337, and 4-184338, WO No. 92/21064, JP-A No. 4-330438, WO No. 93/03419, JP-A No. 5-45816, and the like, and a block group described in JP-A Nos. 3-236047, 3-238445 can be described.

Among these block groups, the block group having two electrophilic groups which reacts with a dinucleophilic agent, described in JP-A Nos. 2-296240 (U.S. Pat. No. 5,019,492), 4-177243, 4-177244, 4-177245, 4-177246, 4-177247 4-177248, 4-177249, 4-179948, 4-184337, and 4-184338, WO No. 92/21064, JP-A No. 4-330438, WO No. 93/03419, JP-A No. 5-45816, and the like is particularly preferable.

Specific examples of the timing group part excluding BLK from the group represented by formula (T-1) are shown below. In the following, * denotes a bond with BLK at this position and ** denotes a bond with —O—CO— at this position.

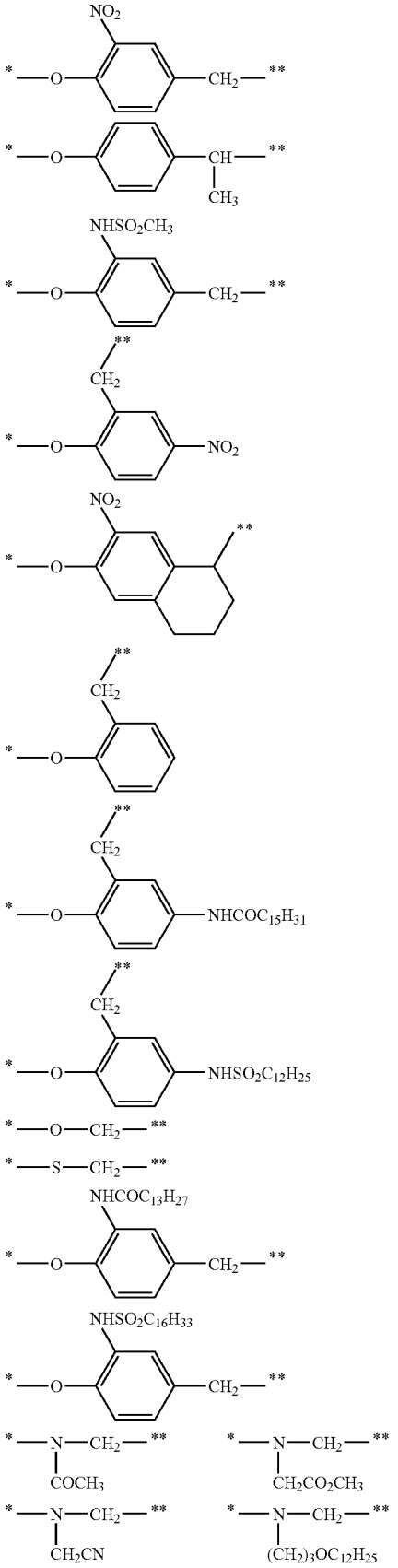

-continued

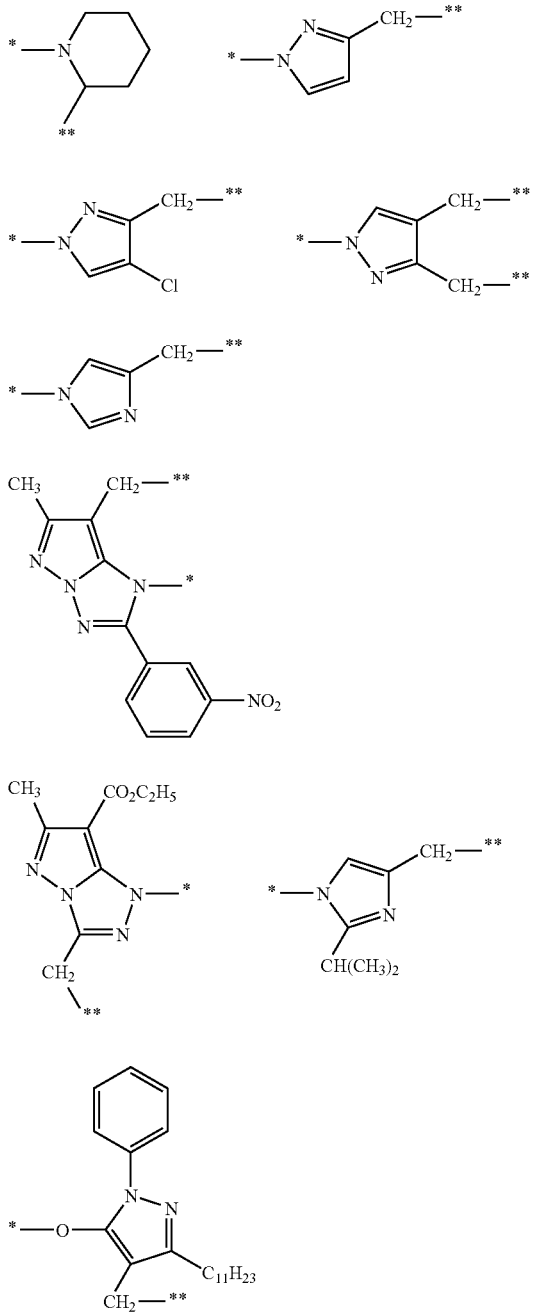

$R_{12}$ and $R_{13}$ preferably are preferably an alkyl group or an aryl group, and $R_{14}$ is preferably an aryl group.

$R_{15}$ is preferably a block group and preferable block groups are the same as those of preferable BLK among the groups represented by the above-mentioned formula (T-1). $R_{16}$, $R_{17}$, and $R_{18}$ are preferably a hydrogen atom.

As the compound represented by formula (I) used in the present invention, the compounds described in U.S. Pat. Nos. 5,242,783 and 4,426,441, and JP-A Nos. 62-227141, 5-257225, 5-249602, 6-43607, and 7-333780 are also preferable.

(Reducing Agent: Compound Represented by Formula (II))

Formula (II)

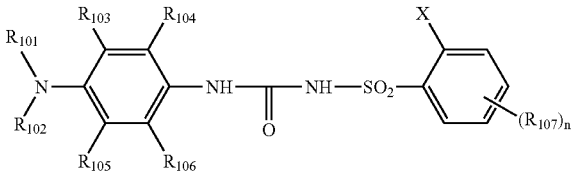

In formula (II), $R_{101}$ and $R_{102}$ each independently represent a substituted or unsubstituted alkyl group, aryl group, heterocyclic group, acyl group, alkylsulfonyl group, or arylsulfonyl group. $R_{103}$, $R_{104}$, $R_{105}$, $R_{106}$, and $R_{107}$ each independently represent a hydrogen atom or a substituent. Members in at least one combination of $R_{101}$ and $R_{102}$, $R_{103}$ and $R_{104}$, $R_{105}$ and $R_{106}$, and $R_{107}$ and X may bond to each other to form a 5-, 6-, or 7-membered ring. X represents a halogen atom or a substituent having a heteroatom through which the substituent bonds to the benzene ring. n represents an integer of from 0 to 4, and when n represents 2 or more, a plurality of $R_{107}$ may be the same or different from one another and may bond to each other to form a 5-, 6-, or 7-membered ring.

In formula (II), $R_{103}$, $R_{104}$, $R_{105}$, $R_{106}$, and $R_{107}$ each independently represent a hydrogen atom or a substituent. Preferable substituents represented by $R_{103}$, $R_{104}$, $R_{105}$, $R_{106}$, and $R_{107}$ are described below.

(1) Halogen Atom

For example, a chlorine atom, a bromine atom, an iodine atom, and the like.

(2) Alkyl Group

Substituted or unsubstituted, linear, branched, and cyclic alkyl groups.

<Substituted or Unsubstituted, Linear or Branched Alkyl Group>

Preferably, having 1 to 30 carbon atoms, for example, a methyl group, an ethyl group, a n-propyl group, an isopropyl group, a t-butyl group, a n-octyl group, an eicosyl group, a 2-chloroethyl group, a 2-cyanoethyl group, a 2-ethylhexyl group, and the like.

<Substituted or Unsubstituted Cyclic Alkyl Group>

A cycloalkyl group (preferably, a substituted or unsubstituted cycloalkyl group having 3 to 30 carbon atoms; for example, a cyclohexyl group, a cyclopentyl group, a 4-n-dodecylcyclohexyl group, and the like), a bicycloalkyl group (preferably, a substituted or unsubstituted bicycloalkyl group having 5 to 30 carbon atoms, namely, a monovalent group obtained by removing one hydrogen atom from bicycloalkane having 5 to 30 carbon atoms; for example, a bicyclo[1,2,2]heptan-2-yl group, a bicyclo[2,2,2]octan-3-yl group, and the like), furthermore including a tricyclo structure and the alkyl group included in the substituents explained below (for example, the alkyl group of an alkylthio group and the like).

(3) Alkenyl Group

Substituted or unsubstituted linear, branched, and cyclic alkenyl groups.

<Linear, or Branched Alkenyl Group>

Preferably, a substituted or unsubstituted alkenyl group having 2 to 30 carbon atoms, for example, a vinyl group, an allyl group, a prenyl group, a gelanyl group, an oleyl group, and the like.

<Cycloalkenyl Group>

Preferably, a substituted or unsubstituted cycloalkenyl group having 3 to 30 carbon atoms, namely, a monovalent group obtained by removing one hydrogen atom from cycloalkene having 3 to 30 carbon atoms. For example, a 2-cyclopenten-1-yl group, a 2-cyclohexen-1-yl group, and the like.

<Bicycloalkenyl Group>

A substituted or unsubstituted bicycloalkenyl group, preferably, a substituted or unsubstituted bicycloalkenyl group having 5 to 30 carbon atoms, namely, a monovalent group obtained by removing one hydrogen atom from bicycloalkene having one double bond. For example, a bicyclo[2,2,1]hepto-2-en-1-yl group, a bicyclo[2,2,2]octo-2-en-4-yl group, and the like.

(4) Alkynyl Group

Preferably, a substituted or unsubstituted alkynyl group having 2 to 30 carbon atoms, for example, an ethynyl group, a propargyl group, a trimethylsilylethynyl group, and the like.

(5) Aryl Group

Preferably, a substituted or unsubstituted aryl group having 6 to 30 carbon atoms, for example, a phenyl group, a p-tolyl group, a naphthyl group, a m-chlorophenyl group, an o-hexadecanoylaminophenyl group, and the like.

(6) Heterocyclic Group

Preferably, a monovalent group obtained by removing one hydrogen atom from 5- or 6-membered and a substituted or unsubstituted, aromatic or non-aromatic heterocyclic compound, and more preferably, a 5- or 6-membered aromatic heterocyclic group having 3 to 30 carbon atoms. For example, a 2-furyl group, a 2-thienyl group, a 2-pyrimidinyl group, a 2-benzothiazolyl group, and the like.

(7) Cyano Group, Hydroxy Group, Nitro Group, and Carboxy Group (8) Alkoxy Group

Preferably, a substituted or unsubstituted alkoxy group having 1 to 30 carbon atoms, for example, a methoxy group, an ethoxy group, an isopropoxy group, a t-butoxy group, a n-octyloxy group, a 2-methoxyethoxy group, and the like.

(9) Aryloxy Group

Preferably, a substituted or unsubstituted aryloxy group having 6 to 30 carbon atoms, for example, a phenoxy group, a 2-methoxyphenoxy group, a 4-t-butylphenoxy group, a 3-nitrophenoxy group, a 2-tetradecanoylaminophenoxy group, and the like.

(10) Silyloxy Group

Preferably, a silyloxy having 2 to 20 carbon atoms, for example, a trimethylsilyloxy group, a t-butyldimethylsilyloxy group, and the like.

(11) Heterocyclic Oxy Group

Preferably, a substituted or unsubstituted heterocyclic oxy group having 2 to 30 carbon atoms, for example, a 1-phenyltetrazole-5-oxy group, a 2-tetrahydropyranyloxy group, and the like.

(12) Acyloxy Group

Preferably, a formyloxy group, a substituted or unsubstituted alkylcarbonyloxy group having 2 to 30 carbon atoms, a substituted or unsubstituted arylcarbonyloxy group, and the like. For example, an acetyloxy group, a pivaloyloxy group, a stearoyloxy group, a benzoyloxy group, a p-methoxyphenylcarbonyloxy group, and the like.

(13) Carbamoyloxy Group

Preferably, a substituted or unsubstituted carbamoyloxy group having 1 to 30 carbon atoms, for example, an N,N-dimethylcarbamoyloxy group, an N,N-diethylcarbamoyloxy group, a morpholinocarbonyloxy group, an N,N-di-n-octylaminocarbonyloxy group, an N-n-octylcarbamoyloxy group, and the like.

(14) Alkoxycarbonyloxy Group

Preferably, a substituted or unsubstituted alkoxycarbonyloxy group having 2 to 30 carbon atoms, for example, a methoxycarbonyloxy group, an ethoxycarbonyloxy group, a t-butoxycarbonyloxy group, a n-octylcarbonyloxy group, and the like.

(15) Aryloxycarbonyloxy Group

Preferably, a substituted or unsubstituted aryloxycarbonyloxy group having 7 to 30 carbon atoms, for example, a phenoxycarbonyloxy group, a p-methoxyphenoxycarbonyloxy group, a p-n-hexadecyloxyphenoxycarbonyloxy group, and the like.

(16) Amino Group

Preferably, an amino group, a substituted or unsubstituted alkylamino group having 1 to 30 carbon atoms, and a substituted or unsubstituted anilino group having 6 to 30 carbon atoms. For example, an amino group, a methylamino group, a dimethylamino group, an anilino group, an N-methyl-anilino group, a diphenylamino group, and the like.

(17) Acylamino Group

Preferably, a formylamino group, a substituted or unsubstituted alkylcarbonylamino group having 1 to 30 carbon atoms and a substituted or unsubstituted arylcarbonylamino group having 6 to 30 carbon atoms. For example, a formylamino group, an acetylamino group, a pivaloylamino group, a lauroylamino group, a benzoylamino group, a 3,4,5-tri-n-octyloxyphenylcarbonylamino group, and the like.

(18) Aminocarbonylamino Group

Preferably, a substituted or unsubstituted aminocarbonylamino group having 1 to 30 carbon atoms, for example, a carbamoylamino group, an N,N-dimethylaminocarbonylamino group, an N,N-diethylaminocarbonylamino group, a morpholinocarbonylamino group, and the like.

(19) Alkoxycarbonylamino Group

Preferably, a substituted or unsubstituted alkoxycarbonylamino group having 2 to 30 carbon atoms, for example, a methoxycarbonylamino group, an ethoxycarbonylamino group, a t-butoxycarbonylamino group, a n-octadecyloxycarbonylamino group, an N-methylmethoxycarbonylamino group, and the like.

(20) Aryloxycarbonylamino Group

Preferably, a substituted or unsubstituted aryloxycarbonylamino group having 7 to 30 carbon atoms, for example, a phenoxycarbonylamino group, a p-chlorophenoxycarbonylamino group, a m-n-octyloxyphenoxycarbonylamino group, and the like.

(21) Sulfamoylamino Group

Preferably, a substituted or unsubstituted sulfamoylamino group having 0 to 30 carbon atoms, for example, a sulfamoylamino group, an N,N-dimethylaminosulfonylamino group, an N-n-octylaminosulfonylamino group, and the like.

(22) Alkylsulfonylamino Group and Arylsulfonylamino Group

Preferably, a substituted or unsubstituted alkylsulfonylamino group having 1 to 30 carbon atoms and a substituted or unsubstituted arylsulfonylamino group having 6 to 30 carbon atoms. For example, a methylsulfonylamino group, a butylsulfonylamino group, a phenylsulfonylamino group, a 2,3,5-trichlorophenylsulfonylamino group, a p-methylphenylsulfonylamino group, and the like.

(23) Mercapto Group

(24) Alkylthio Group

Preferably, a substituted or unsubstituted alkylthio group having 1 to 30 carbon atoms, for example, a methylthio group, an ethylthio group, a n-hexadecylthio group, and the like.

(25) Arylthio Group

Preferably, a substituted or unsubstituted arylthio group having 6 to 30 carbon atoms, for example, a phenylthio group, a p-chlorophenylthio group, a m-methoxyphenylthio group, and the like.

(26) Heterocyclic Thio Group

Preferably, a substituted or unsubstituted heterocyclic thio group having 2 to 30 carbon atoms, for example, a 2-benzothiazolylthio group, a 1-phenyltetrazol-5-ylthio group, and the like.

(27) Sulfamoyl Group

Preferably, a substituted or unsubstituted sulfamoyl group having 0 to 30 carbon atoms, for example, an N-ethylsulfamoyl group, an N-(3-dodecyloxypropyl)sulfamoyl group, an N,N-dimethylsulfamoyl group, an N-acetylsulfamoyl group, an N-benzoylsulfamoyl group, an N—(N'-phenylcarbamoyl)sulfamoyl group, and the like.

(28) Sulfo Group

(29) Alkylsulfinyl Group and Arylsulfinyl Group

Preferably, a substituted or unsubstituted alkylsulfinyl group having 1 to 30 carbon atoms and a substituted or unsubstituted arylsufinyl group having 6 to 30 carbon atoms. For example, a methylsulfinyl group, an ethylsulfinyl group, a phenylsulfinyl group, a p-methylphenylsulfinyl group, and the like.

(30) Alkylsulfonyl Group and Arylsulfonyl Group

Preferably, a substituted or unsubstituted alkylsulfonyl group having 1 to 30 carbon atoms and a substituted or unsubstituted arylsufonyl group having 6 to 30 carbon atoms. For example, a methylsulfonyl group, an ethylsulfonyl group, a phenylsulfonyl group, a p-methylphenylsulfonyl group, and the like.

(31) Acyl Group

Preferably, a formyl group, a substituted or unsubstituted alkylcarbonyl group having 2 to 30 carbon atoms, a substituted or unsubstituted arylcarbonyl group having 7 to 30 carbon atoms, and the like. For example, an acetyl group, a pivaloyl group, a 2-chloroacetyl group, a stearoyl group, a benzoyl group, a p-n-octyloxyphenylcarbonyl group, and the like.

(32) Alkoxycarbonyl Group

Preferably, a substituted or unsubstituted alkoxycarbonyl group having 2 to 30 carbon atoms, for example, a methoxycarbonyl group, an ethoxycarbonyl group, a t-butoxycarbonyl group, a n-octadecyloxycarbonyl group, and the like.

(33) Aryloxycarbonyl Group

Preferably, a substituted or unsubstituted aryloxycarbonyl group having 7 to 30 carbon atoms, for example, a phenoxycarbonyl group, an o-chlorophenoxycarbonyl group, a m-nitrophenoxycarbonyl group, a p-t-butylphenoxycarbonyl group, and the like.

(34) Carbamoyl Group

Preferably, a substituted or unsubstituted carbamoyl group having 1 to 30 carbon atoms, for example, a carbamoyl group, an N-methylcarbamoyl group, an N,N-dimethylcarbamoyl group, an N,N-di-n-octylcarbamoyl group, an N-(methylsulfonyl)carbamoyl group, and the like.

(35) Arylazo Group and Heterocyclic Azo Group

Preferably, a substituted or unsubstituted arylazo group having 6 to 30 carbon atoms and a substituted or unsubstituted heterocyclic azo group having 3 to 30 carbon atoms. For example, a phenylazo group, a p-chlorophenylazo group, a 5-ethylthio-1,3,4-thiadiazol-2-ylazo group, and the like.

(36) Imide Group

For example, an N-succinimide, an N-phthalimide group, and the like.

(37) Phosphino Group

Preferably, a substituted or unsubstituted phosphino group having 2 to 30 carbon atoms, for example, a dimethylphosphino group, a diphenylphosphino group, a methylphenoxyphosphino group, and the like.

(38) Phosphinyl Group

Preferably, a substituted or unsubstituted phosphinyl group having 2 to 30 carbon atoms, for example, a phosphinyl group, a dioctyloxyphosphinyl group, a diethoxyphosphinyl group, and the like.

(39) Phosphinyloxy Group

Preferably, a substituted or unsubstituted phosphinyloxy group having 2 to 30 carbon atoms, for example, a diphenoxyphosphinyloxy group, a dioctyloxyphosphinyloxy group, and the like.

(40) Phosphinylamino Group

Preferably, a substituted or unsubstituted phosphinylamino group having 2 to 30 carbon atoms, for example, a dimethoxyphosphinylamino group, a dimethylaminophosphinylamino group, and the like.

(41) Silyl Group

Preferably, a substituted or unsubstituted silyl group having 3 to 30 carbon atoms, for example, a trimethylsilyl group, a t-butyldimethylsilyl group, a phenyldimethylsilyl group, and the like.

Among these, $R_{103}$, $R_{104}$, $R_{105}$, $R_{106}$, and $R_{107}$ are more preferably a hydrogen atom, a halogen atom, an alkyl group, an aryl group, a cyano group, a hydroxy group, a nitro group, a carboxy group, an alkoxy group, an aryloxy group, an acyloxy group, an acylamino group, an alkylsulfonylamino group, an arylsulfonylamino group, an alkylthio group, an arylthio group, a sulfamoyl group, a sulfo group, an alkoxycarbonyl group, an aryloxycarbonyl group, a carbamoyl group, an alkylsulfonyl group, or an arylsulfonyl group, and even more preferably a hydrogen atom, a halogen atom, an alkyl group, an alkoxy group, an acylamino group, an alkylsulfonylamino group, an arylsulfonylamino group, an alkylthio group, an arylthio group, a sulfamoyl group, a sulfo group, an alkoxycarbonyl group, a carbamoyl group, an alkylsulfonyl group, or an arylsulfonyl group. Particularly preferably, one of $R_{104}$ or $R_{106}$ from among $R_{103}$, $R_{104}$, $R_{105}$, $R_{106}$, and $R_{107}$ is a hydrogen atom.

When the group represented by $R_{103}$, $R_{104}$, $R_{105}$, $R_{106}$, or $R_{107}$ is a group capable of being further substituted, the group represented by $R_{103}$, $R_{104}$, $R_{105}$, $R_{106}$, or $R_{107}$ may further have a substituent and in that case, preferable substituents may be the same as the substituents explained in the column of $R_{103}$, $R_{104}$, $R_{105}$, $R_{106}$, and $R_{107}$. When the group represented by $R_{103}$, $R_{104}$, $R_{105}$, $R_{106}$, or $R_{107}$ is substituted by two or more substituents, those substituents may be the same or different.

$R_{101}$ and $R_{102}$ each independently represent an alkyl group, an aryl group, a heterocyclic group, an acyl group, an alkylsulfonyl group, or an arylsulfonyl group. Preferable ranges of these groups are the same as the alkyl group, aryl group, heterocyclic group, acyl group, alkylsulfonyl group or arylsulfonyl group explained in the above explanation of the substituents represented by $R_{103}$, $R_{104}$, $R_{105}$, $R_{106}$ and $R_{107}$. $R_{101}$ and $R_{102}$ are preferably an alkyl group, an aryl group, or a heterocyclic group, and most preferably an alkyl group. When the group represented by $R_{101}$ or $R_{102}$ is capable of being further substituted, the group represented by $R_{101}$ and $R_{102}$ may further have a substituent and in that case, preferable substituent is similar to the substituents explained in $R_{103}$, $R_{104}$, $R_{105}$, $R_{106}$, and $R_{107}$. When the group represented by $R_{101}$ or $R_{102}$ is substituted by two or more substituents, those substituents may be the same or different.

Members in at least one combination of $R_{101}$ and $R_{102}$, $R_{103}$ and $R_{104}$, $R_{105}$ and $R_{106}$, and $R_{107}$ and X may bond to each other to form a 5-, 6-, or 7-membered ring.

X represents a halogen atom or a substituent having a heteroatom through which the substituent bonds to the benzene ring. Here, the heteroatom is an atom other than a carbon atom, for example, oxygen, nitrogen, sulfur, or the like. X is preferably a halogen atom, a hydroxy group, a nitro group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an arylazo group, a heterocyclic azo group, an imide group, a phosphino group, a phosphinyl group, a phosphinyloxy group, a phosphinylamino group, a silyl group, and the like.

Preferable ranges of these groups are the same as those of the halogen atom, alkoxy group, aryloxy group, silyloxy group, heterocyclic oxy group, acyloxy group, carbamoyloxy group, alkoxycarbonyloxy group, aryloxycarbonyloxy group, acylamino group, aminocarbonylamino group, alkoxycarbonylamino group, aryloxycarbonylamino group, sulfamoylamino group, alkylsulfonylamino group, arylsulfonylamino group, alkylthio group, arylthio group, heterocyclic thio group, sulfamoyl group, alkylsulfinyl group, arylsulfinyl group, alkylsulfonyl group, arylsulfonyl group, arylazo group, heterocyclic azo group, imide group, phosphino group, phosphinyl group, phosphinyloxy group, phosphinylamino group, sily group, and the like explained in the column of the substituents represented by $R_{103}$, $R_{104}$, $R_{105}$, $R_{106}$, and $R_{107}$.

X is preferably a halogen atom, a hydroxy group, an alkoxy group, an aryloxy group, a silyloxy group, a heterocyclic oxy group, a carbamoyloxy group, an amino group, an acylamino group, an aminocarbonylamino group, an alkoxycarbonylamino group, an alkylsulfonylamino group, an arylsulfonylamino group, a mercapto group, an alkylthio group, a sulfamoyl group, an alkylsulfonyl group, an arylsulfonyl group, or a silyl group, and more preferably, a halogen atom, a hydroxy group, an alkoxy group, an acylamino group, an aminocarbonylamino group, an alkoxycarbonylamino group, an alkylsulfonylamino group and arylsulfonylamino group.

n represents an integer of from 0 to 4. When n is two or more, a plurality of $R_{107}$ may be the same or different and may bond to each other to form a 5-, 6-, or 7-membered ring.

(Reducing Agent: Compound Represented by Formula (III))

Formula (III)

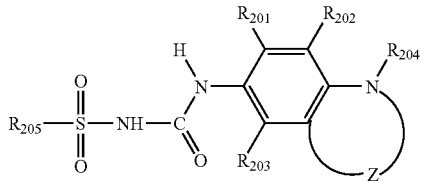

In formula (III), $R_{201}$, $R_{202}$, and $R_{203}$ each independently represent a hydrogen atom or a substituent. $R_{204}$ represents one selected from an alkyl group, an aryl group, or a heterocyclic group, wherein members in at least one combination of $R_{201}$ and $R_{202}$, and $R_{202}$ and $R_{204}$ may bond to each other to form a 5-, 6-, or 7-membered ring. Z represents a non-metallic atomic group for forming a 5-, 6-, or 7-membered ring together with a nitrogen atom and two carbon atoms in a benzene ring, and $R_{205}$ represents one selected from an alkyl group, an aryl group, or a heterocyclic group. However, no hydroxy group, carboxy group, or sulfo group is contained in any of $R_{201}$ to $R_{204}$.

Although the compound of formula (III) incorporated in the photothermographic material of the present invention is a compound which hardly has absorption in the visible light region, when thermal development is carried out, the compound contributes to release a reducing agent and form a silver image, and an oxidation product of the released reducing agent is produced. When the oxidation product reacts with a coupler compound, a dye is formed and an imagewise dye image can be obtained corresponding to the silver image. In the present invention, the dye donating coupler and the compound represented by formula (III) may be contained in the image forming layer, but they can be separated and added in different layers when they are in a state possible to react.

The compound represented by formula (III) in the present invention is described in detail below. $R_{201}$, $R_{202}$, and $R_{203}$ each independently represent a hydrogen atom or a substituent. As the substituent represented by $R_{201}$, $R_{202}$, and $R_{203}$, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a nitro group, an alkoxy group, aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, an heterocyclic azo group, an imide group, a phosphino group, a phosphinyl group, a phosphinyloxy group, a phosphinylamino group, a silyl group, and the like can be described. Further in detail, a halogen atom (for example, a chlorine atom, a bromine atom, and an iodine atom), an alkyl group [represents a substituted or unsubstituted, linear, branched, or cyclic alkyl group; an alkyl group (preferably, an alkyl group having 1 to 30 carbon atoms, for example, methyl, ethyl, n-propyl, isopropyl, t-butyl, n-octyl, eicosyl, 2-chloroethyl, 2-cyanoethyl, and 2-ethylhexyl), a cycloalkyl group (preferably, a substituted or unsubstituted cycloalkyl group having 3 to 30 carbon atoms, for example, cyclohexyl, cyclopentyl, and 4-n-dodecylcyclohexyl), a bicycloalkyl group (preferably, a substituted or unsubstituted bicycloalkyl group having 5 to 30 carbon atoms namely, that is a monovalent group obtained by removing one hydrogen atom from bicycloalkane having 5 to 30 carbon atoms; for example, bicyclo[1,2,2]heptan-2-yl, bicyclo[2,2,2]octan-3-yl) and further tricycle structure having many cyclic structures are included; an alkyl group included in a substituent described below (for example, an alkyl group in an alkylthio group) also represents the alkyl group of this concept], an alkenyl group [represents a substituted or unsubstituted, linear, branched, or cyclic alkenyl group; an alkenyl group (preferably, a substituted or unsubstituted alkenyl group having 2 to 30 carbon atoms; for example, vinyl, allyl, prenyl, gelanyl, and oleyl), a cycloalkenyl group (preferably, a substituted or unsubstituted cycloalkenyl group having 3 to 30 carbon atoms, namely, a monovalent group obtained by removing one hydrogen atom from cycloalkene having 3 to 30 carbon atoms; for example, 2-cyclopenten-1-yl and 2-cyclohexen-1-yl), a bicycloalkenyl group (a substituted or unsubstituted bicycloalkenyl group, preferably a substituted or unsubstituted bicycloalkenyl group having 5 to 30 carbon atoms, namely, a monovalent group obtained by removing one hydrogen atom from bicycloalkene having one double bond; for example, bicyclo[2,2,1]hepto-2-en-1-yl and bicyclo[2,2,2]octo-2-en-4-yl)], an alkynyl group (preferably, a substituted or unsubstituted alkynyl group having 2 to 30 carbon atoms; for example, ethynyl, propargyl, and trimethylsilylethynyl), an aryl group (preferably, a substituted or unsubstituted aryl group having 6 to 30 carbon atoms; for example, phenyl, p-tolyl, naphthyl, m-chlorophenyl, and o-hexadecanoylaminophenyl), a heterocyclic group (preferably, a monovalent group obtained by removing one hydrogen atom from a 5- or 6-membered, substituted or unsubstituted, or aromatic or non-aromatic heterocyclic compound, and more preferably, a 5- or 6-membered aromatic heterocyclic group having 3 to 30 carbon atoms; for example, 2-furyl, 2-thienyl, 2-pyrimidinyl, and 2-benzothiazolyl), a cyano group, a nitro group, an alkoxy group (preferably, a substituted or unsubstituted alkoxy group having 1 to 30 carbon atoms; for example, methoxy, ethoxy, isopropoxy, t-butoxy, n-octyloxy, and 2-methoxyethoxy), an aryloxy group (preferably, a substituted or unsubstituted aryloxy group having 6 to 30 carbon atoms; for example, phenoxy, 2-methylphenoxy, 4-t-butylphenoxy, 3-nitrophenoxy, and 2-tetradecanoylaminophenoxy), a silyloxy group (preferably, a substituted or unsubstituted silyloxy group having 3 to 20 carbon atoms; for example, trimethylsilyloxy and t-butyldimethylsilyloxy), a heterocyclic oxy group (preferably, a substituted or unsubstituted heterocyclic oxy group having 2 to 30 carbon atoms; for example, 1-phenyltetrazole-5-oxy and 2-tetrahydropyranyloxy), an acyloxy group (preferably, a formyloxy group, a substituted or unsubstituted alkylcarbonyloxy group having 2 to 30 carbon atoms, and a substituted or unsubstituted arylcarbonyloxy group having 6 to 30 carbon atoms; for example, formyloxy, acetyloxy, pivaloyloxy, stearoyloxy, benzoyloxy, and p-methoxyphenylcarbonyloxy), a carbamoyloxy group (preferably, a substituted or unsubstituted carbamoyloxy group having 1 to 30 carbon atoms, for example, N,N-dimethylcarbamoyloxy, N,N-diethylcarbamoyloxy, morphorinocarbonyloxy, N,N-di-n-octylaminocarbonyloxy, and N-n-octylcarbamoyloxy), an alkoxycarbonyloxy group (preferably, a substituted or unsubstituted alkoxycarbonyloxy group having 2 to 30 carbon atoms; for example, methoxycarbonyloxy, ethoxycarbonyloxy, t-butoxycarbonyloxy, and n-octylcarbonyloxy), an aryloxycarbonyloxy group (preferably, a substituted or unsubstituted aryloxycarbonyloxy group having 7 to 30 carbon atoms; for example, phenoxycarbonyloxy, p-methoxyphenoxycarbonyloxy, and p-n-hexadecyloxyphenoxycarbonyloxy), an amino group (preferably, an amino group, a substituted or unsubstituted alkylamino group having 1 to 30 carbon atoms, and a substituted or unsubstituted anilino group having 6 to 30 carbon atoms; for example, amino, methylamino, dimethylamino, anilino, N-methyl-anilino, and diphenylamino), an acylamino group (preferably, a formylamino group, a substituted or unsubstituted alkylcarbonylamino group having 1 to 30 carbon atoms, and a substituted or unsubstituted arylcarbonylamino group having 1 to 30 carbon atoms; for example, formylamino, acetylamino, pivaloylamino, lauroylamino, benzoylamino, and 3,4,5-tri-n-octyloxyphenylcarbonylamino), an aminocarbonylamino group (preferably, a substituted or unsubstituted aminocarbonylamino group having 1 to 30 carbon atoms; for example, carbamoylamino, N,N-dimethylaminocarbonylamino, N,N-diethylaminocarbonylamino, and morpholinocarbonylamino), an alkoxycarbonylamino group (preferably, a substituted or unsubstituted alkoxycarbonylamino group having 2 to 30 carbon atoms; for example, methoxycarbonylamino, ethoxycarbonylamino, t-butoxycarbonylamino, n-octadecylcarbonylamino, and N-methyl-methoxycarbonylamino), an aryloxycarbonylamino group (preferably, a substituted or unsubstituted aryloxycarbonylamino group having 7 to 30 carbon atoms; for example, phenoxycarbonylamino, p-chlorophenoxycarbonylamino, and m-n-octyloxyphenoxycarbonylamino), a sulfamoylamino group (preferably, a substituted or unsubstituted sulfamoylamino group having 0 to 30 carbon atoms; for example, sulfamoylamino, N,N-dimethylaminosulfonylamino, and N-n-octylaminosulfonylamino), an alkylsulfonylamino group and an arylsulfonylamino group (preferably, a substituted or unsubstituted alkylsulfonylamino group having 1 to 30 carbon atoms and a substituted or unsubstituted arylsulfonylamino group having 6 to 30 carbon atoms; for example, methylsulfonylamino, butylsulfonylamino, phenylsulfonylamino, 2,3,5-trichlorophenylsulfonylamino, and p-methylphenylsulfonylamino), a mercapto group, an alkylthio group (preferably, a substituted or unsubstituted alkylthio group having 1 to 30 carbon atoms; for example, methylthio, ethylthio, and n-hexadecylthio), an arylthio group (preferably, a substituted or unsubstituted arylthio group having 6 to 30 carbon atoms; for example, phenylthio, p-chlorophenylthio, and m-methoxyphenylthio), a heterocyclic thio group (preferably, a substituted or unsubstituted heterocyclic thio group having 2 to 30 carbon atoms; for example, 2-benzothiazolylthio and 1-phenyltetrazol-5-ylthio), a sulfamoyl group (preferably, a substituted or unsubstituted sulfamoyl group having 0 to 30 carbon atoms; for example, N-ethylsulfamoyl, N-(3-dodecyloxypropyl)sulfamoyl, N,N-dimethylsulfamoyl, N-acetylsulfamoyl, N-benzoylsulfamoyl, and N—(N'-phenylcarbamoyl)sulfamoyl), an alkylsulfinyl group and an arylsulfinyl group (preferably, a substituted or unsubstituted alkylsulfinyl group having 1 to 30 carbon atoms and a substituted or unsubstituted arylsulfinyl group having 6 to 30 carbon atoms; for example, methylsulfinyl, ethylsulfinyl, phenylsulfinyl, and p-methylphenylsulfinyl), an alkylsulfonyl group and an arylsulfonyl group (preferably, a substituted or unsubstituted alkylsulfonyl group having 1 to 30 carbon atoms and a substituted or unsubstituted arylsulfonyl group having 6 to 30 carbon atoms; for example, methylsulfonyl, ethylsulfonyl, phenylsulfonyl, and p-methylphenylsulfonyl), an acyl group (preferably, a formyl group, a substituted or unsubstituted alkylcarbonyl group having 2 to 30 carbon atoms, and a substituted or unsubstituted arylcarbonyl group having 7 to 30 carbon atoms; for example, acetyl, pivaloyl, 2-chloroacetyl, stearoyl, benzoyl, and p-n-octyloxyphenylcarbonyl), an aryloxycarbonyl group (preferably, a substituted or unsubstituted aryloxycarbonyl group having 7 to 30 carbon atoms; for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms; for example, methoxycarbonyl, ethoxycarbonyl, t-butoxycarbonyl, and n-octadecyloxycarbonyl), a carbamoyl group (preferably, a substituted or unsubstituted carbamoyl group having 1 to 30 carbon atoms; for example, carbamoyl, N-methylcarbamoyl, N,N-dimethylcarbamoyl, N,N-di-n-octylcarbamoyl, and N-(methylsulfonyl)carbamoyl), an arylazo group and a heterocyclic azo group (preferably, a substituted or unsubstituted arylazo group having 6 to 30 carbon atoms and a substituted or unsubstituted heterocyclic azo group having 3 to 30 carbon atoms; for example, phenylazo, p-chlorophenylazo, and 5-ethylthio-1,3,4-thiadiazol-2-ylazo), an imide group (for example, N-succinimide and N-phthalimide), a phosphino group (preferably, a substituted or unsubstituted phosphino group having 2 to 30 carbon atoms; for example, dimethylphosphino, diphenylphosphino, and methylphenoxyphosphino), a phosphinyl group (preferably, a substituted or unsubstituted phosphinyl group having 2 to 30 carbon atoms; for example, phosphinyl, dioctyloxyphosphinyl, and diethoxyphosphinyl), a phosphinyloxy group (preferably, a substituted or unsubstituted phosphinyloxy group having 2 to 30 carbon atoms; for example, diphenoxyphosphinyloxy and dioctyloxyphosphinyloxy), a phosphinylamino group (preferably, a substituted or unsubstituted phosphinylamino group having 2 to 30 carbon atoms; for example, dimethoxyphosphinylamino and dimethylaminophosphinylamino), a silyl group (preferably, a substituted or unsubstituted silyl group having 3 to 30 carbon atoms; for example, trimethylsilyl, t-butyldimethylsilyl, and phenyldimethylsilyl) are described.

When the group represented by $R_{201}$ to $R_{203}$ is a group capable of being further substituted, the group represented by $R_{201}$ to $R_{203}$ may further have a substituent, and in that case, preferable substituents represent the groups having the same meaning as the substituents explained in $R_{201}$ to $R_{203}$. When the group represented by $R_{201}$ to $R_{203}$ is substituted by two or more substituents, the substituents may be the same or different.

$R_{204}$ and $R_{205}$ each independently represent one selected from an alkyl group, an aryl group, or a heterocyclic group, and preferable ranges of the alkyl group, aryl group, and heterocyclic group represent the groups having the same meaning as the alkyl group, aryl group, and heterocyclic group explained in the substituents represented by $R_{201}$ to $R_{203}$ described above. When the group represented by $R_{204}$ or $R_{205}$ is a group being further substituted, the group represented by $R_{204}$ or $R_{205}$ may further have a substituent, and in that case, preferable substituents represent the groups having the same meaning as the substituents explained in $R_{201}$ to $R_{203}$. When the group represented by $R_{204}$ or $R_{205}$ is substituted by two or more substituents, the substituents may be the same or different.

Members in at least one combination of $R_{201}$ and $R_{202}$, and $R_{202}$ and $R_{204}$ may bond to each other to form a 5-, 6-, or 7-membered carbon ring or heterocycle.

Preferable range of the compound represented by formula (III) is explained below. $R_{201}$ to $R_{203}$ are preferably a hydrogen atom, a halogen atom, an alkyl group, an aryl group, an acylamino group, an alkylsulfonylamino group, an arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a nitro group, a sulfamoyl group, an alkylsulfonyl group, an arylsulfonyl group, or an acyloxy group, and more preferably, a hydrogen atom, a halogen atom, an alkyl group, an acylamino group, an alkylsufonylamino group, an arylsulfonylamino group, an alkoxy group, an alkylthio group, an arylthio group, an alkoxycarbonyl group, a carbamoyl group, a cyano group, a nitro group, a sulfamoyl group, an alkylsulfonyl group, or an arylsulfonyl group. It is particularly preferred that one of $R_{201}$ or $R_{203}$ is a hydrogen atom. $R_{202}$ is more preferably an alkyl group or an alkoxy group $R_{204}$ is preferably an alkyl group.

Z preferably forms a 1,2,3,4-tetrahydroquinone skeleton or an indoline skeleton together with an adjacent nitrogen atom, and the hydrogen atom of the hydrocarbon which constitutes Z may be substituted by a substituent.

$R_{205}$ is preferably an alkyl group or an aryl group, and more preferably, a substituted phenyl group represented by the following formula (IV).

Formula (IV)

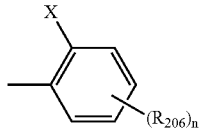

In the formula, X represents a halogen atom or a group which substitutes for a hydrogen atom on a benzene ring through a heteroatom. $R_{206}$ represents a hydrogen atom or a substituent. n represents an integer of from 0 to 4. When n is two or more, a plurality of $R_{206}$ may be the same or different from one another, and two adjacent groups thereamong may bond to each other to form a 5-, to 7-membered carbon ring or heterocycle.

As X, a halogen atom, a hydroxy group, a nitro group, an alkoxy group, aryloxy group, a silyloxy group, a heterocyclic oxy group, an acyloxy group, a carbamoyloxy group, an alkoxycarbonyloxy group, an aryloxycarbonyloxy group, an amino group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an arylazo group, a heterocyclic azo group, an imide group, a phosphino group, a phosphinyl group, a phosphinyloxy group, a phosphinylamino group, and a silyl group are described. Preferable ranges of these groups are the same as those explained in the substituents represented by $R_{201}$ to $R_{203}$ described above.

As X, more preferred are a halogen atom, a hydroxy group, an alkoxy group, aryloxy group, a silyloxy group, a heterocyclic oxy group, a carbamoyloxy group, an amino group, an acylamino group, an aminocarbonylamino group, an alkoxycarbonylamino group, an alkylsulfonylamino group, an arylsulfonylamino group, a mercapto group, an alkylthio group, a sulfamoyl group, an alkylsulfonyl group, an arylsulfonyl group, and a silyl group, and even more preferred are a halogen atom, a hydroxy group, an alkoxy group, an acylamino group, an aminocarbonylamino group, an alkoxycarbonylamino group, an alkylsulfonylamino group, and an arylsulfonylamino group.

$R_{206}$ preferably represents a substituent, and the substituent represented by $R_{206}$ represents the group having the same meaning as the substituents explained in $R_{201}$ to $R_{203}$.

$R_{206}$ is preferably a halogen atom, an alkyl group, an aryl group, an alkoxy group, an aryloxy group, an amino group, an acylamino group, an aminocarbonylamino group, an alkoxycarbonylamino group, an alkylsulfonylamino group, an arylsulfonylamino group, or an alkylthio group, and more preferably a halogen atom, an alkyl group, an alkoxy group, an acylamino group. n is preferably an integer of from 0 to 3.

In the compound represented by formula (III), it is preferable that the C log P value of the compound in which $R_{205}$—$SO_2$—NH—CO— is replaced with a hydrogen atom is 3.0 or more. A C log P value is a calculated value of a water/octanol distribution coefficient of a compound and the inventors of the invention calculated it using Chem Draw Ultra, ver. 5.0, produced by Cambridge Soft Corporation.

Specific examples of the compound represented by formulae (I) to (III) of the present invention are shown below, but the present invention is not limited to these.

(1)

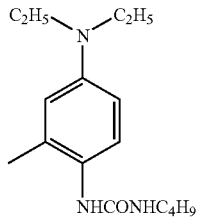

(2)

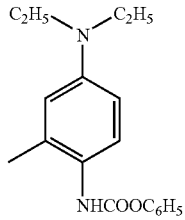

(3)

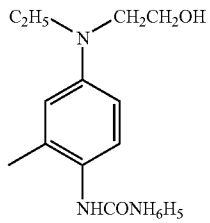

-continued
(4)
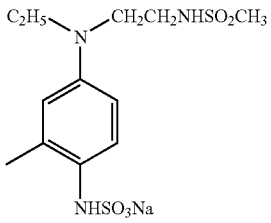
(5)
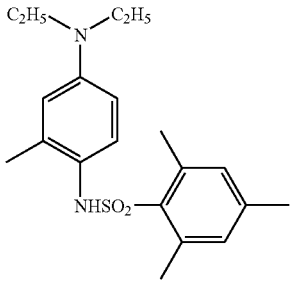
(6)
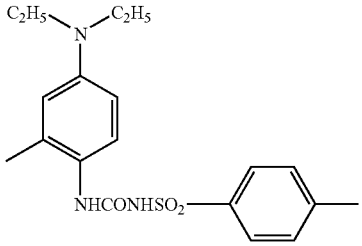
(7)
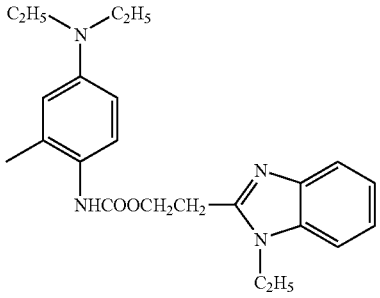
(8)
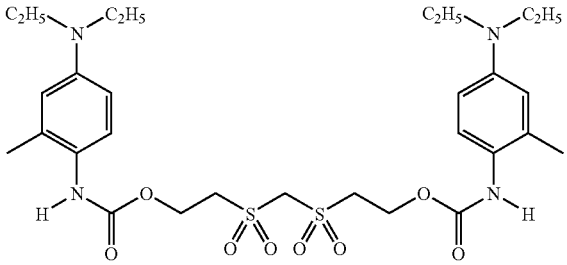
-continued
(9)
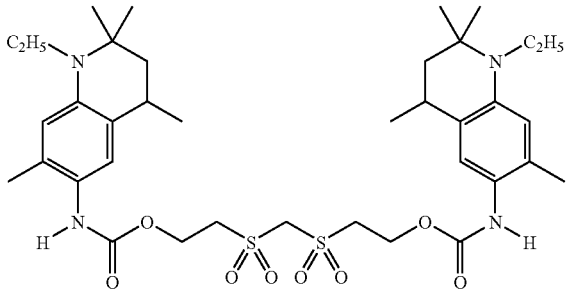
(10)
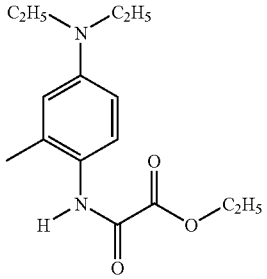
(11)
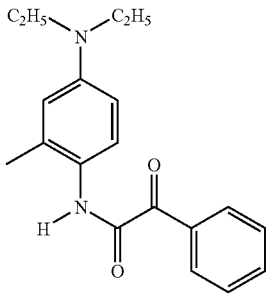
(12)
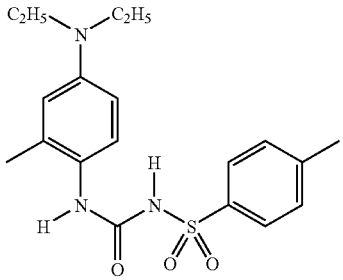
(13)
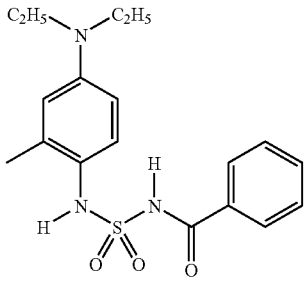

-continued
(14)
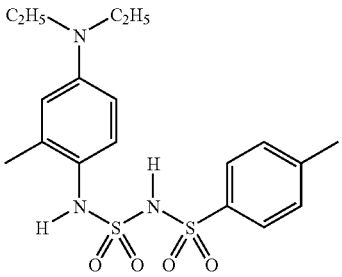
(15)
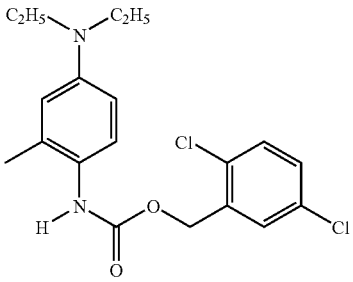
(16)
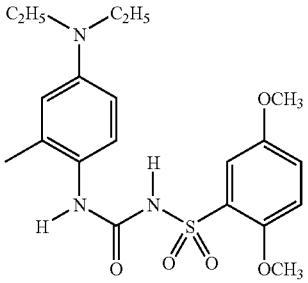
(17)
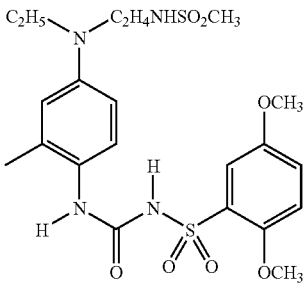
(18)
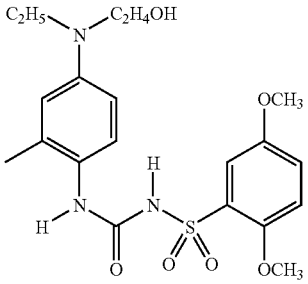
-continued
(19)
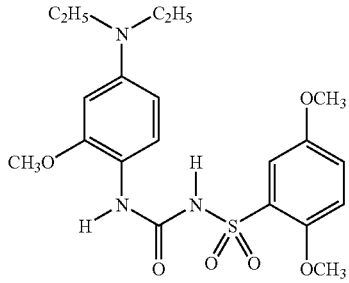
(20)
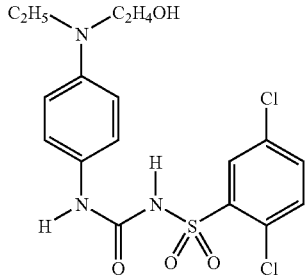
(21)
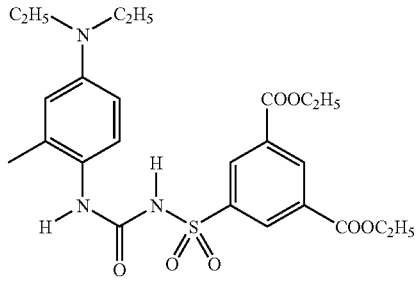
(22)
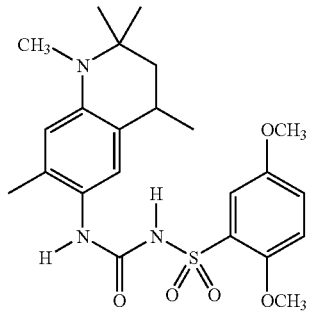
(23)
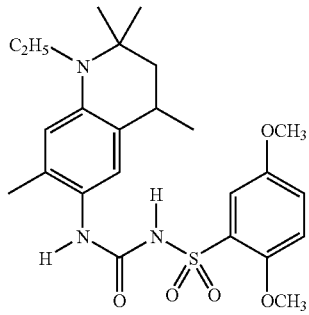

-continued (24)

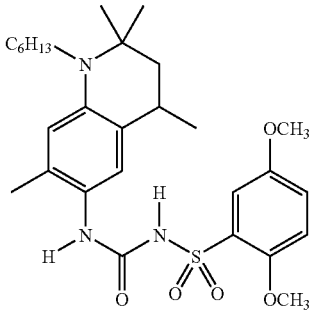

(25)

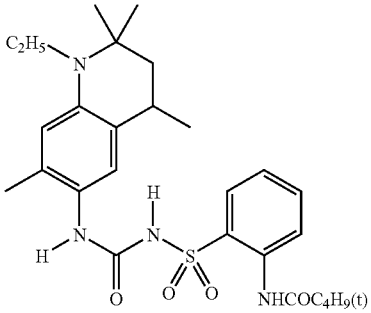

(26)

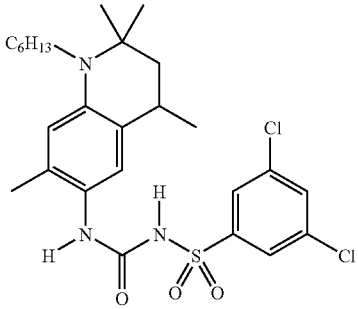

(27)

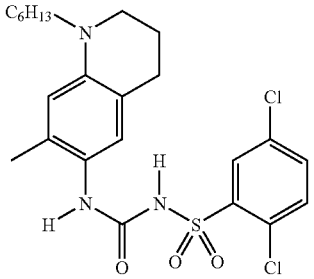

(28)

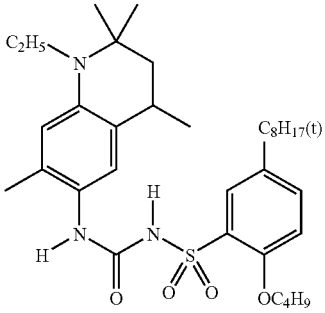

-continued (29)

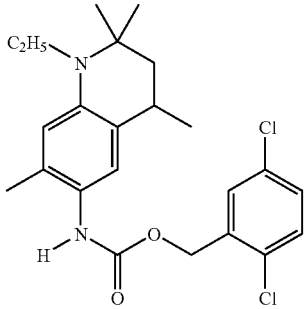

(30)

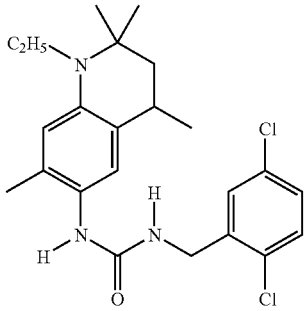

Concerning the reducing agent represented by formulae (I) to (III) of the present invention, two or more of them may be used together in the same image forming layer or different image forming layers and it may be used in combination with a color reducing agent other than that of the present invention. As color reducing agents out of the present invention, the compounds described in EP-A Nos. 1113322, 1113323, 1113324, 1113325, 1113326, 1158358, 1158359, 1160621, 1164417, 1164418, and 1168071, U.S. Pat. No. 6,319,640B1, and WO Nos. 01/96946 and 01/96954 can be described. Specifically, for example, the following reducing agents are described.

DEVP-A1

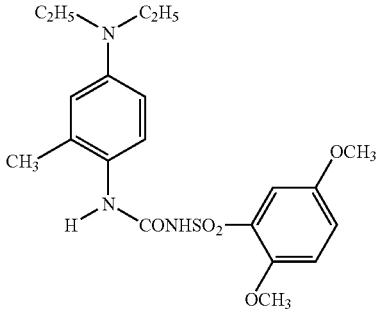

DEVP-A2

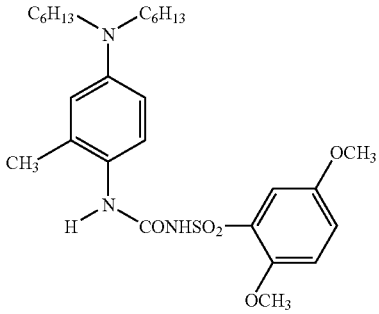

-continued
DEVP-A3
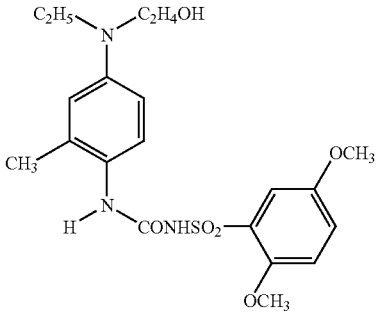
DEVP-A4
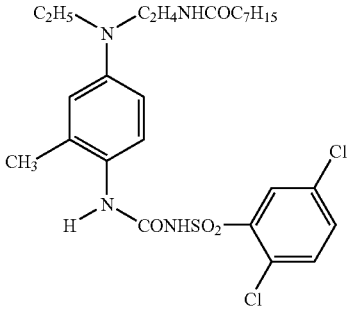
DEVP-A5
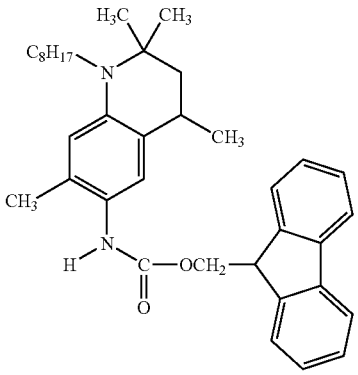
DEVP-A6
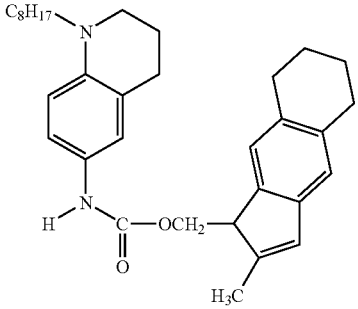
-continued
DEVP-A7
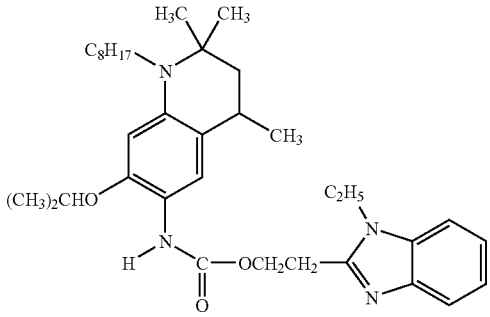
DEVP-A8
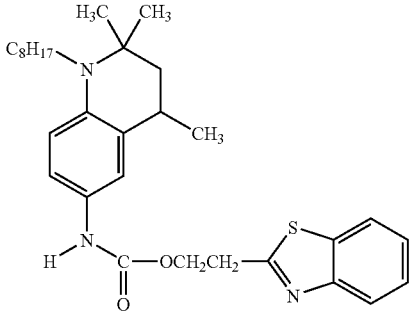
DEVP-A9
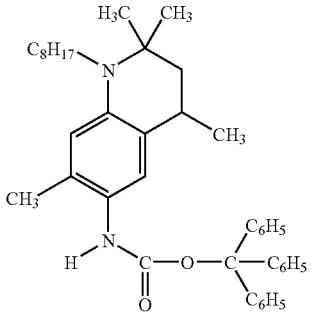
DEVP-A10
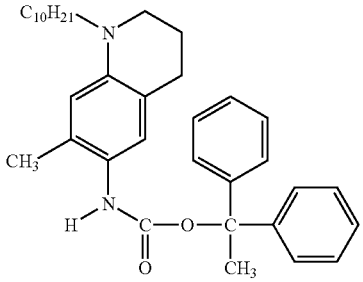
DEVP-A11
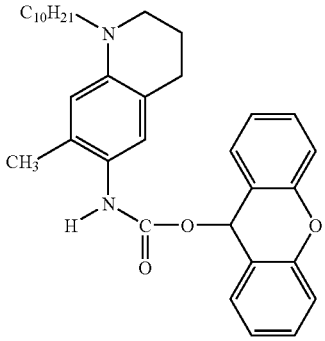

-continued
DEVP-A12
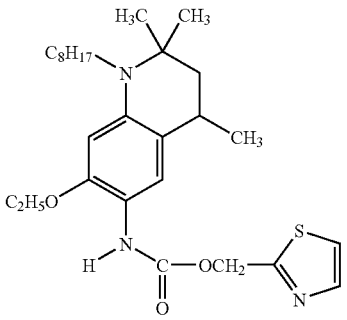
DEVP-A13
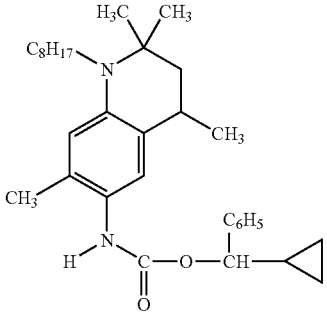
DEVP-A14
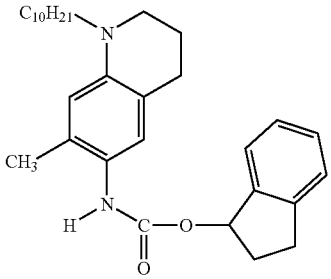
DEVP-A15
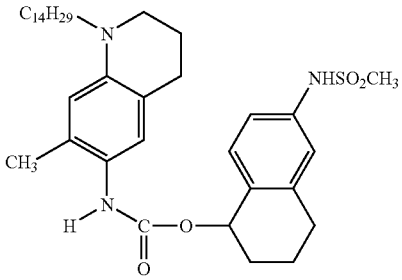
DEVP-A16
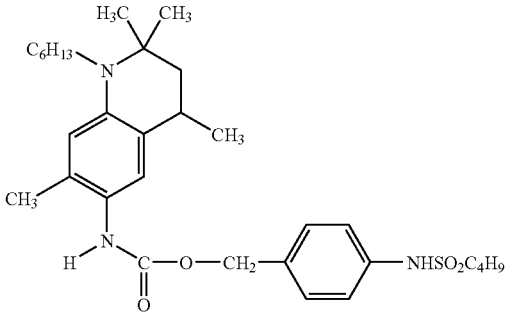
-continued
DEVP-A17
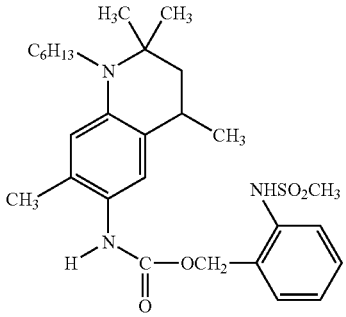
DEVP-A18
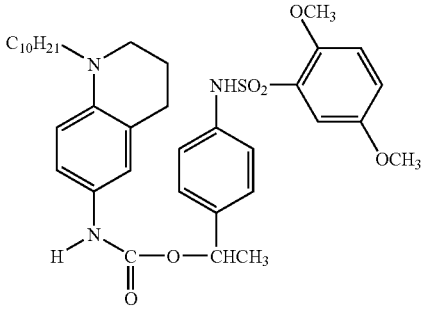
DEVP-A19
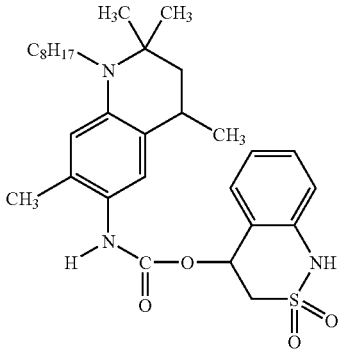
DEVP-A20
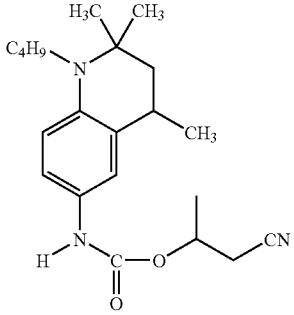

-continued
DEVP-A21
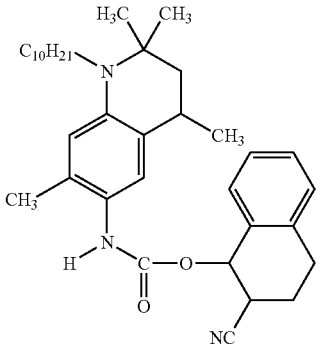
DEVP-A22
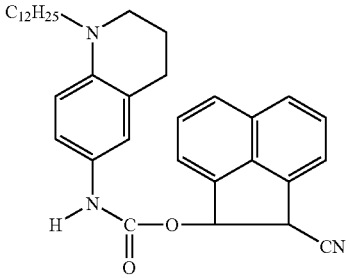
DEVP-A23
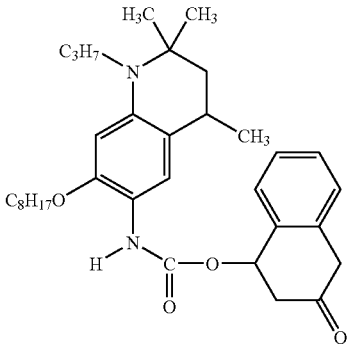
DEVP-A24
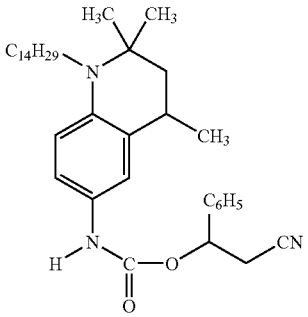
-continued
DEVP-A25
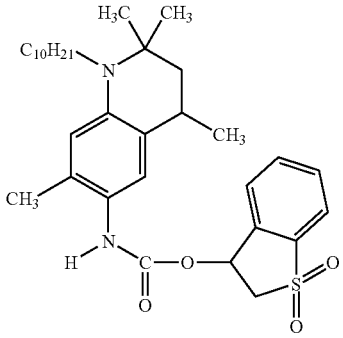
DEVP-A26
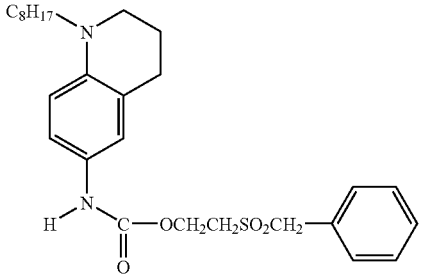
DEVP-A27
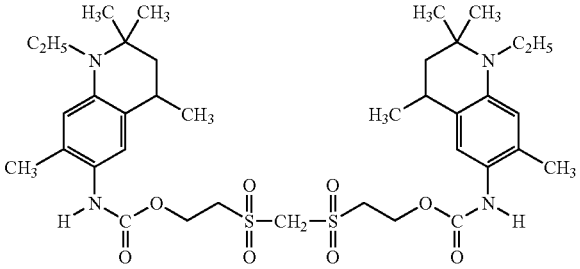
DEVP-A28
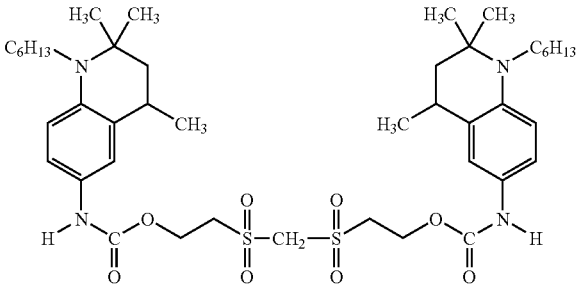
DEVP-A29
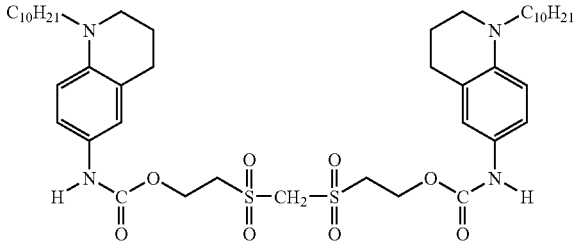

<Adding Method of Reducing Agent>

In the present invention, the reducing agent is contained in the photothermographic material in the form of a fine crystal particle dispersion.

Colloid dispersions of fine crystal particles of these materials can be obtained by any methods which give mechanical shearing well-known in the said technical field. Examples of the method are described in U.S. Pat. Nos. 2,581,414 and 2,855,156 and Canadian Patent No. 1,105,761, and these methods can be used. For example, a solid particle fine grinding method (a ball mill method, a pebble mill method, a roller mill method, a sand mill method, a beads mill method, a dyno mill method, a mussap mill method, and a media mill method are included. Furthermore, a colloid mill method, a fine grinding method by attrition, a dispersing method by ultrasonic energy and the high speed stirring method (described in U.S. Pat. No. 4,474,872 of Onishi et. al.,) are included. From the viewpoints of easy operation, easy washing, and good reproducibility, a ball mill method, a roller mill method, a media mill method, and a fine grinding method by attrition are preferable.

As another method, a dispersion in which the said compound exists in amorphous physical state can be prepared by a well-known method such as a colloid mill method, a uniforming method, a high speed stirring method, or a sonic method. Subsequently, the amorphous physical state of the said compound can be converted to a fine crystal physical state by a method such as a heat anneal method or a chemical anneal method. In the heat anneal method, the temperature programming method in which the dispersion is circulated to a higher temperature than the glass transition temperature of the amorphous compound is included. Preferable heat anneal method includes the process which makes the said dispersion circulate in a temperature range of from 17° C. to 90° C. This circulation process can include an order of arbitrary temperature changing which promotes formation of fine crystal phase from the remained amorphous physical state. Typically, a period of high temperature interval is selected in order to inhibit the ripening and particle growth by collision process to the minimum, and at the same time to make the said phase formation activate. In the chemical anneal method, an incubation method by a chemical agent which changes the distribution of the compound between the continuous phase of the said dispersion and the discontinuous phase and a surfactant is included. Such chemical agent includes hydrocarbons (hexadecane and the like), surfactants, alcohols (butanol, pentanol, undecanol, and the like), and organic solvents having high boiling point. These chemical agents can be added to the dispersion during particle formation or after particle formation. This chemical anneal method includes a method of incubating the said dispersion at from 17° C. to 90° C. in the presence of the above-mentioned chemical agent, a method of stirring the said dispersion in the presence of the above-mentioned chemical agent, and a method of slowly removing the chemical agent by a method of diafiltration after adding the chemical agent, and the like.

The formation of a colloid dispersion in an aqueous medium usually needs presence of auxiliary dispersing agent, such as a surfactant, a surface active polymer, and a hydrophilic polymer. Such auxiliary dispersing agents are described in U.S. Pat. No. 5,008,179 (column Nos. 13 and 14) of Chari et. al., and U.S. Pat. No. 5,104,776 (column Nos. 7 to 13) of Bagchi and Sargeant, and these can be used suitably.

In the present invention, a mean particle size of fine crystal particles in the fine crystal particle dispersion is preferably from 0.001 μm to 5 μm and more preferably from 0.001 μm to 0.5 μm.

The photothermographic material of the present invention contains the reducing agent on the same side of the support as the photosensitive silver halide and the reducible silver salt. The addition amount of the reducing agent of the present invention may be in a large range, and is preferably in a range of from 0.01 mol to 100 mol, more preferably from 0.1 mol to 10 mol, and even more preferably from 0.5 mol to 3.0 mol, per 1 mol of the coupler compound.

The reducing agent of the present invention preferably has solubility to water of 1 $g/m^3$ or less, and more preferably $10^{-3}$ $g/m^3$ or less, in order to raise dispersion stability of the fine crystal particle dispersion. Further, the melting point of the reducing agent of the present invention is preferably from 80° C. to 300° C.

(Color Image Forming Material)

In the present invention, various color image forming materials conventionally known in color photosensitive material can be used. A typical color image forming material is described in, for example, T. H. James, "THE THEORY OF THE PHOTOGRAPHIC PROCESS, FOURTH EDITION", pages 335 to 372 (1977).

Preferable color image forming material used in the present invention is a coupler which forms a dye by coupling with an oxidation product of the reducing agent which is a developing agent.

The coupler compound used for the present invention is called a well-known coupler in the photographic industry, and 2 equivalent couplers or 4 equivalent couplers are used. As examples of the photographic coupler, the coupler having a function explained in "Organic compounds for conventional color photography" (Journal of Synthetic Organic Chemistry, Japan, edited by Nobuo Furutachi, vol. 4, page 439 (1983)) and the coupler described in Research Disclosure No. 37038, pages 80 to 85 and 87 to 89, (February, 1995) can be used.

As the yellow color image forming coupler, for example, a pivaloylacetamide type coupler, a benzoylacetamide type coupler, a malondiester type coupler, a malondiamide type coupler, a dibenzoylmethane type coupler, a benzothiazolylacetamide type coupler, a malonestermonoamide type coupler, a benzoxazolylacetamide type coupler, a benzoimidazolylacetamide type coupler, a benzothiazolylacetamide type coupler, a cycloalkylcarbonylacetamide type coupler, an indolin-2-ylacetamide type coupler, a quinazolin-4-on-2-ylacetamide type coupler described in U.S. Pat. No. 5,021,332, a benzo-1,2,4-thiaziazine-1,1-dioxid-3-ylacetamide type coupler described in U.S. Pat. No. 5,021,330, a coupler described in EP No. 421221A, a coupler described in U.S. Pat. No. 5,455,149, a coupler described in EP-A No. 0622673, a 3-indolylacetamide type coupler described in EP-A Nos. 0953871, 0953872, and 0953873, and the like are described.

As the magenta color image forming coupler, for example, a 5-pyrazolone type coupler, a 1H-pyrazolo[1,5-a]benzimidazole type coupler, 1H-pyrazolo[5,1-c][1,2,4]triazole type coupler, a 1H-pyrazolo[1,5-b][1,2,4]triazole type coupler, a 1H-imidazo[1,2-b]pyrazole type coupler, a cyanoacetophenone type coupler, an active propene type coupler described in WO No. 93/01523, an enamine type coupler described in WO No. 93/075342, a 1H-imidazo[1,2-b][1,2,4]triazole type coupler, a coupler described in U.S. Pat. No. 4,871,652, and the like are described.

As the cyan image forming coupler, for example, a phenol type coupler, a naphthol type coupler, a 2,5-diphenylimidazole type coupler described in EP-A No. 024953, a 1H-pyrrolo[1,2-b][1,2,4]triazole type coupler, a 1H-pyrrolo[2,1-c][1,2,4]triazole type coupler, a pyrrole type coupler described in JP-A Nos. 4-188137 and 4-190347, a 3-hydroxypyridine type coupler described in JP-A No. 1-315736, a pyrrolopyrazole type coupler described in U.S. Pat. No. 5,164,289, a pyrroloimidazole type coupler described in JP-A 4-174429, a pyrazolopyrimidine type coupler described in U.S. Pat. No. 4,950,585, a pyrrolotriazine type coupler described in JP-A No. 4-204730, a coupler described in U.S. Pat. No. 4,746,602, a coupler described in U.S. Pat. No. 5,104,783, a coupler described in U.S. Pat. No. 5,162,196, a coupler described in EP No. 0556700, and the like are described.

Specific examples of typical coupler compounds which can be used in the present invention are described below, however the present invention is not limited in these specific examples.

Cyan coupler (C-1)

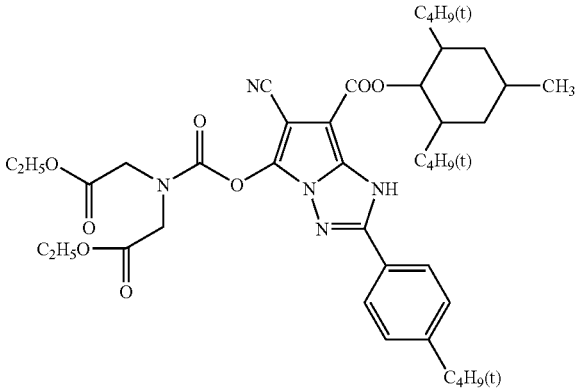

(C-2)

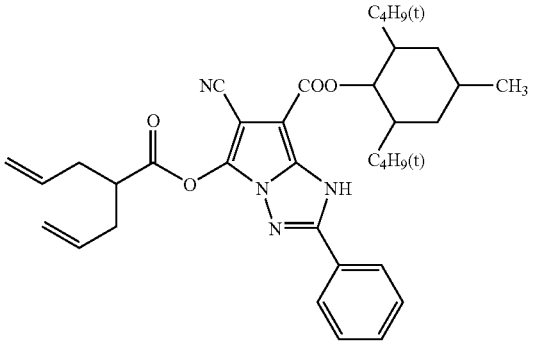

(C-3)

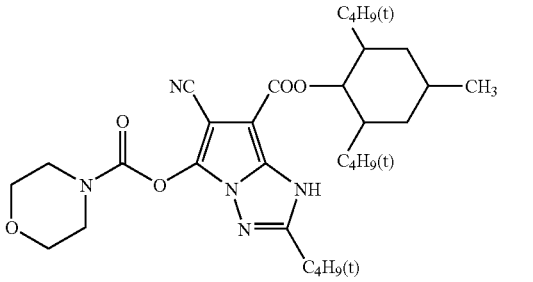

-continued (C-4)

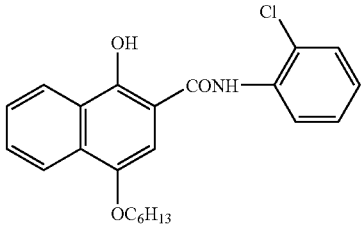

(C-5)

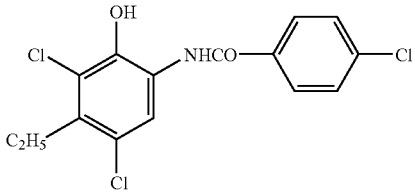

(C-6)

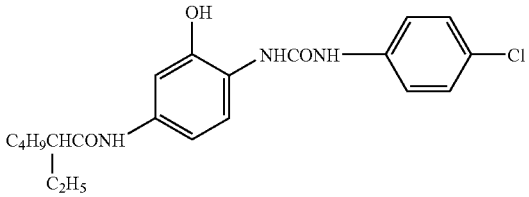

(C-7)

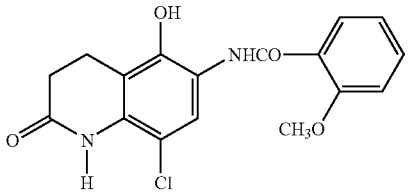

(C-8)

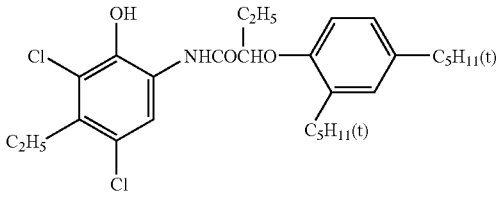

Magenta coupler (M-1)

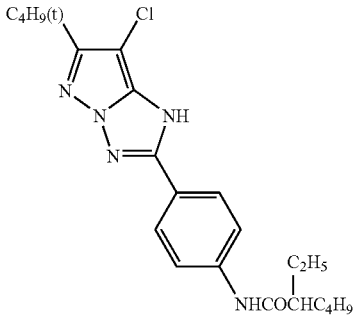

-continued
(M-2)
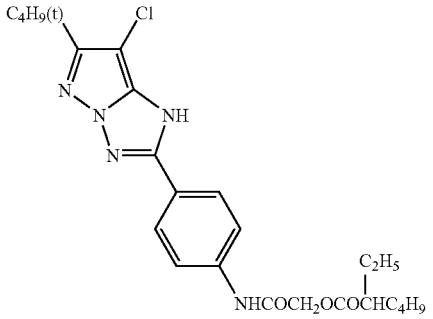
(M-3)
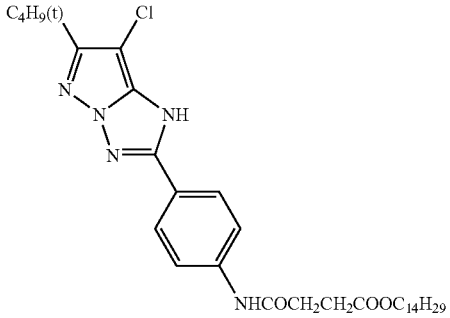
(M-4)
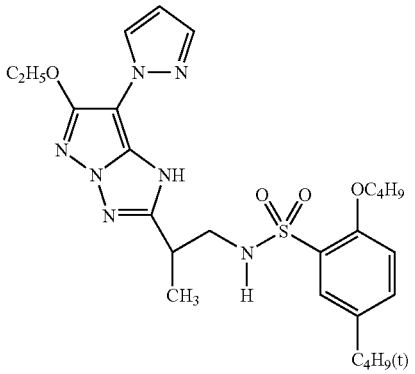
(M-5)
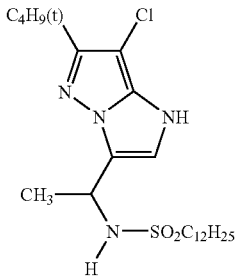
-continued
(M-6)
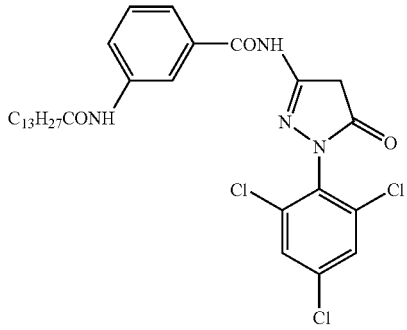
(M-7)
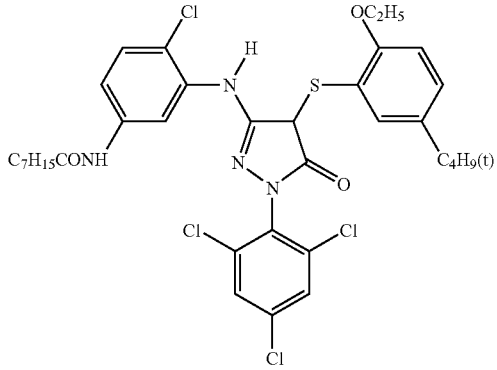
(M-8)
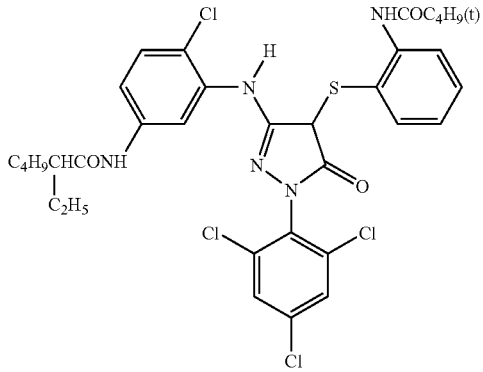
Yellow coupler
(Y-1)
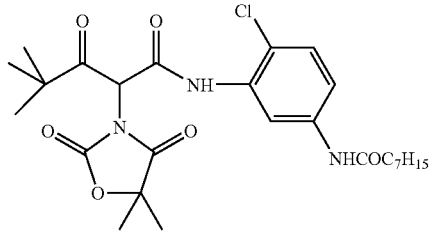

-continued (Y-2)

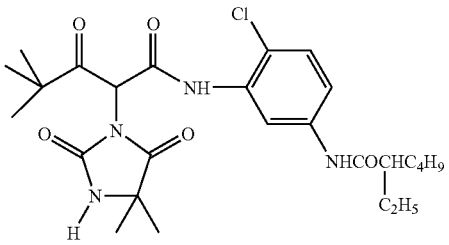

(Y-3)

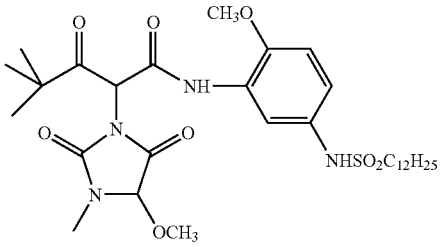

(Y-4)

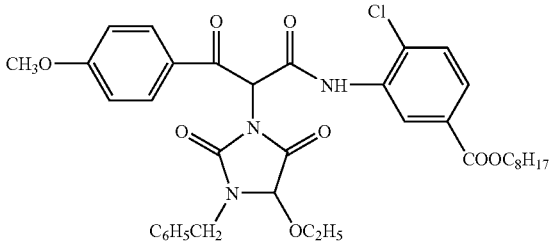

(Y-5)

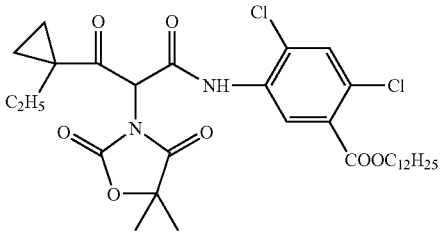

(Y-6)

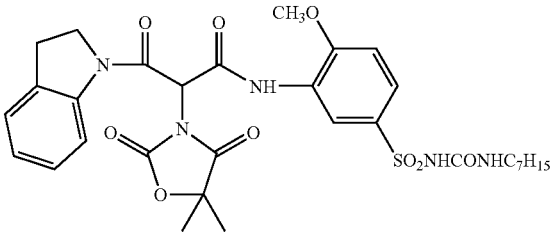

(Y-7)

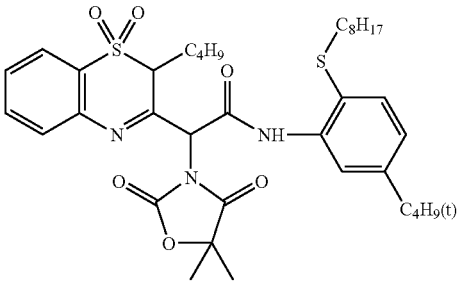

-continued (Y-8)

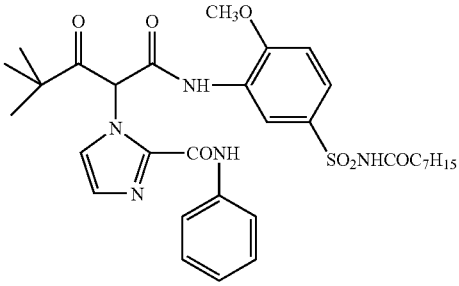

The coupler compounds described above can be easily synthesized by a well-known method in the photographic industry described in the above-mentioned patent specification about coupler.

The coupler compound used for the present invention can be incorporated into a layer of a photothermographic material by a well-known method described in U.S. Pat. No. 2,322,027 and the like. In this case, an organic solvent having a high boiling point described in U.S. Pat. Nos. 4,555,470, 4,536,466, 4,536,467, 4,587,206, 4,555,476, and 4,599,296, JP-B No. 3-62256, and the like can be used in combination with an organic solvent having a low boiling point, which has a boiling point within 50° C. to 160° C., if necessary. Further, these dye donating couplers, organic solvents having a high boiling point, and the like can be used together with two or more of them. The amount of the organic solvent having a high boiling point is 10 g or less with respect to 1 g of hydrophobic additive used, preferably 5 g or less, and more preferably in a range of from 0.1 g to 1 g. And it is preferred to use in a range of 1.0 mL or less, more preferably 0.5 mL or less, and particularly preferably 0.3 mL or less, with respect to 1 g of binder. The dispersing method by a polymer described in JP-B No. 51-39853 and JP-A No. 51-59943, and the adding method as a fine particle dispersion described in JP-A No. 62-30242 can also be used. In addition to the above-mentioned method, in the case of substantially water insoluble compound, it can be contained into a binder as fine particles and dispersed. In the case where a hydrophobic compound is dispersed into a hydrophilic colloid, various surfactants can be used. For example, a surfactant described in JP-A No. 59-157636, pages 37 to 38, and above-mentioned Research Disclosure can be used. A phosphate ester type surfactant described in JP-A Nos. 7-056267 and 7-228589, and German Patent Application No. 1,932,299A can also be used. Further, according to the well-known solid dispersing method, the coupler compound can be used by dispersing the powder of the coupler compound into water by means of ball mill, colloid mill, sand grinder mill, Manton-gaulin mill, micro fluidizer, or ultrasonics.

Although the coupler compound used for the present invention may be added to either layer on the support as far as the coupler compound exist on the same side as the photosensitive silver halide and the non-photosensitive organic silver, it is preferably added to the layer containing the silver halide or its adjacent layer. The addition amount of the coupler compound used for the present invention is preferably from 0.2 mmol to 200 mmol per 1 mol of silver, more preferably from 0.3 mmol to 100 mmol, and even more preferably from 0.5 mmol to 30 mmol. The coupler compound may be used alone or two or more of them in combination.

Further, following functional couplers may be used in the present invention. As the coupler in which the color dye has suitable diffusing ability, compounds described in U.S. Pat. No. 4,366,237, GB No. 2,125,570, EP No. 96,873B and DE No. 3,234,533 are preferable. As the coupler for compensating unnecessary absorption of color dye, a yellow colored cyan coupler and a yellow colored magenta coupler described in EP No. 456,257A1, a magenta colored cyan coupler described in U.S. Pat. No. 4,833,069 and a colorless masking coupler described in (2) of U.S. Pat. No. 4,837,136 and formula (A) in claim 1 of WO No. 92/11575 (especially illustrated compounds described in pages 36 to 45) are described. As the compound which reacts with an oxidation product of developing agent and releases a residual compound useful for photography (including couplers), the following compounds are described.

Development inhibitor releasing compound: the compound represented by formula (I) to (IV) described in page 11 of EP No. 378,236A1, the compound represented by formula (I) described in page 7 of EP No. 436,938A2, the compound represented by formula (I) described in EP No. 568,037A, the compound represented by formula (I), (II), or (III) described in pages 5 to 6 of EP No. 440,195A2.

Bleaching accelerator releasing compound: the compound represented by formula (I) or (I') described in page 5 of EP No. 310,125A2 and the compound represented by formula (I) in claim 1 in JP-A No. 6-59411.

Rigand releasing compound: the compound represented by LIG-X described in claim 1 of U.S. Pat. No. 555,478.

Leuco dye releasing compound: compound Nos. 1 to 6 represented by columns 3 to 8 in U.S. Pat. No. 4,749,641.

Fluorescent dye releasing compound: the compound represented by COUP-DYE in claim 1 of U.S. Pat. No. 774,181.

Development accelerator or fogging agent releasing compound: the compound represented by formula (1), (2), or (3) in column 3 of U.S. Pat. No. 656,123 and ExZK-2 in lines 36 to 38 in page 75 of EP No. 450,637A2.

The compound which releases a dye forming group by elimination: the compound represented by formula (I) in claim 1 of U.S. Pat. No. 4,857,447 and the compound represented by formula (I) described in JP-A No. 5-307248 and the compound represented by formula (I), (II), or (III) described in pages 5 and 6 of EP No. 440,195A2 and the compound (a rigand releasing compound) represented by formula (I) described in claim 1 of JP-A No. 6-059411 and the compound represented by LIG-X described in claim 1 of U.S. Pat. No. 555,478. The functional coupler is preferably used in an amount of from 0.05 times to 10 times by mole of the coupler which contributes to color forming described above, and more preferably from 0.1 times to 5 times by mole.

Further, the melting point of the coupler used for the present invention is preferably 90° C. or more. The melting point of the coupler used for the present invention is preferably higher than the melting point of the thermal solvent described below, and more preferably higher than the temperature for developing process. The combination of the coupler used for the present invention and thermal solvent preferably has mutually soluble property.

(Thermal Solvent)

The photothermographic material of the present invention may contain a thermal solvent. The "thermal solvent" used in the present invention is an organic material which is a solid in surrounding temperature, but has an action which shows a mixing melting point together with other components in the temperature of used thermal processing temperature or less and changes to liquid state at the time of thermal development and promotes thermal development or thermal transfer of a dye. As the thermal solvent, a compound which can serve as a solvent of developing agent, a compound which has a high dielectric constant and promotes physical development of a silver salt, a compound having an action which forms soluble mixture with a binder and makes the binder swell, and the like are useful. Examples of the thermal solvent used in the present invention include the compounds described in U.S. Pat. Nos. 3,347,675, 3,667,959, 3,438,776 3,666,477, Research Disclosure No. 17,643, JP-A Nos. 51-19525, 53-24829, 53-60223, 58-118640, 58-198038, 59-229556, 59-68730, 59-84236, 60-191251, 60-232547, 60-14241, 61-52643, 62-78554, 62-42153, 62-44737, 63-53548, 63-161446, 1-224751, 2-863, 2-120739, and 2-123354, and the like are described. Specifically, a material having low water solubility which is preferable for fine crystal particle dispersion can be selected from among urea derivatives (phenylmethylurea and the like), amide derivatives (acetamide, stearylamide, p-toluamide, p-propanoyloxyethoxybenzamide, and the like), sulfonamide derivatives (p-toluenesulfonamide and the like), poly-alcohols (polyethylene glycol polymer and the like), and the like.

In order to raise dispersion stability of fine crystal particle dispersion, water solubility of the thermal solvent is preferably 1 g/m$^3$ or less, and more preferably $10^{-3}$ g/m$^3$ or less. Further, the melting point of the thermal solvent used for the present invention is preferably 90° C. or more and the temperature for developing process or less. The addition amount of the thermal solvent is preferably from 1% by weight to 200% by weight with respect to the coating amount of binder, and more preferably from 5% by weight to 50% by weight. Specific examples and the melting points of typical thermal solvents used for the present invention are shown below, but the invention is not limited by these specific examples.

TS-1

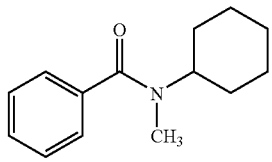

mp. 76° C.

TS-2

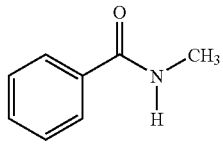

mp. 76° C.

TS-3

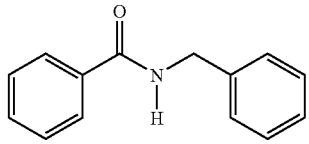

mp. 104° C.

-continued

TS-4

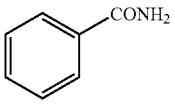

mp. 128° C.

TS-5

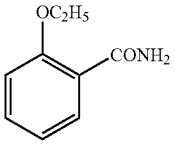

mp. 131° C.

TS-6

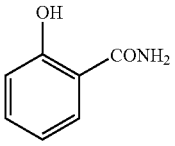

mp. 140° C.

TS-7

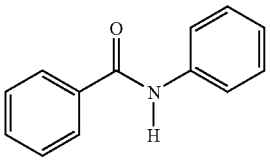

mp. 164° C.

TS-8

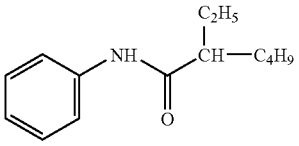

TS-9

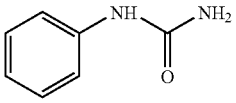

mp. 146° C.

TS-10

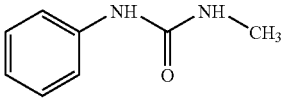

mp. 149° C.

TS-11

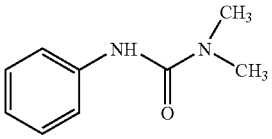

mp. 134° C.

TS-12

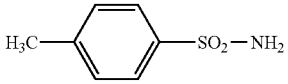

mp. 139° C.

-continued

TS-13

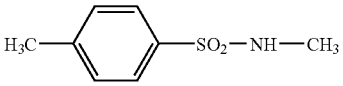

mp. 80° C.

TS-14

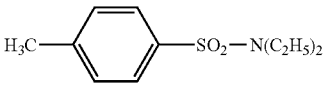

TS-15

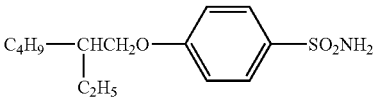

TS-16

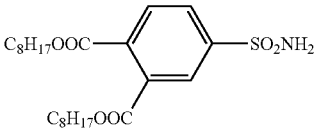

TS-17

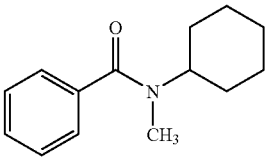

TS-18

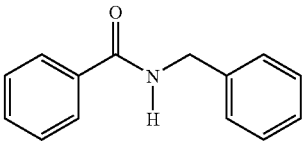

TS-19

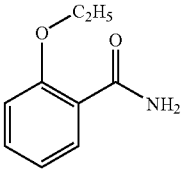

TS-20

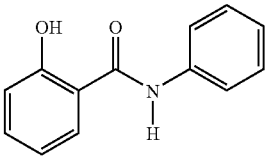

(Non-Photosensitive Organic Silver Salt)

1) Composition

The organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), EP No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cubic, or potato-like indefinite shaped particles with the major axis to minor axis ratio being 5 or lower are also used preferably. Such organic silver salt particles suffer less from fogging during thermal development compared with long needle-like particles with the major axis to minor axis length ratio of higher than 5. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm.

In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be manufactured by each independently preparing an aqueous dispersion of the organic silver salt and an aqueous dispersion of a photosensitive silver salt and then mixing. A method of mixing two or more aqueous dispersions of organic silver salts and two or more aqueous dispersions of photosensitive silver salts upon mixing is used preferably for controlling the photographic properties.

4) Addition Amount

While the organic silver salt according to the invention can be used in a desired amount, a total amount of coated silver including silver halide in the silver image forming layer is preferably in a range of from 0.1 g/m$^2$ to 5 g/m$^2$, more preferably from 0.3 g/m$^2$ to 3 g/m$^2$, and even more preferably from 0.5 g/m$^2$ to 2.0 g/m$^2$. A total amount of coated silver including silver halide in the color image forming layer is preferably in a range of from 0.05 g/m$^2$ to 3 g/m$^2$, more preferably from 0.1 g/m$^2$ to 1.8 g/m$^2$, and even more preferably from 0.2 g/m$^2$ to 1.2 g/m$^2$.

(Reducing Agent for Forming Silver Image or Auxiliary Reducing Agent for Forming Color Image)

In the present invention, the reducing agent for forming a silver image or the auxiliary reducing agent for forming a color image is preferably a so-called hindered phenolic reducing agent or a bisphenol agent having a substituent at the ortho-position to the phenolic hydroxy group. It is more preferably a compound represented by the following formula (R).

Formula (R)

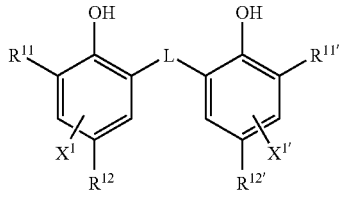

In formula (R), $R^{11}$ and $R^{11'}$ each independently represent an alkyl group having 1 to 20 carbon atoms. $R^{12}$ and $R^{12'}$ each independently represent a hydrogen atom or a group substituting for a hydrogen atom on a benzene ring. L represents an —S— group or a —CHR$^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group substituting for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —CHR$^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —CHR$^{13}$— group.

$R^{13}$ is preferably a hydrogen atom or an alkyl group having 1 to 15 carbon atoms. The alkyl group is preferably a chain or a cyclic alkyl group. And, a group which has a C=C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimethyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ preferably is a hydrogen atom.

In the case where $R^{11}$ and $R^{11}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more reducing agents in combination, it is preferred to use two or more reducing agents in combination depending on the purpose.

Specific examples of the reducing agent for forming a silver image or the auxiliary reducing agent for forming a color image including the compounds represented by formula (R) according to the invention are shown below, but the invention is not restricted to these.

R-1
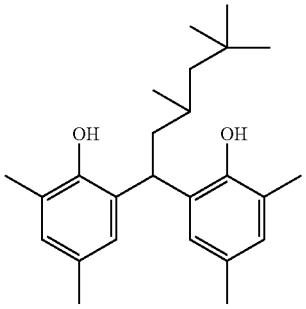
R-2
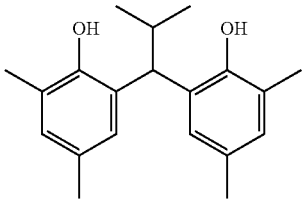
R-3
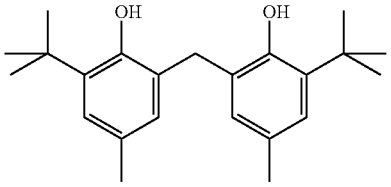
R-4
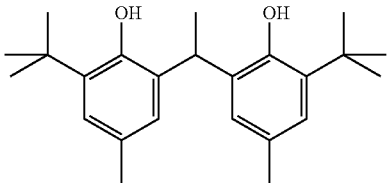
R-5
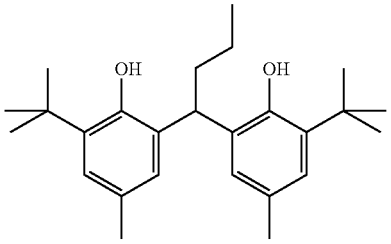
R-6
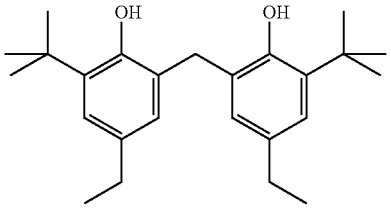
R-7
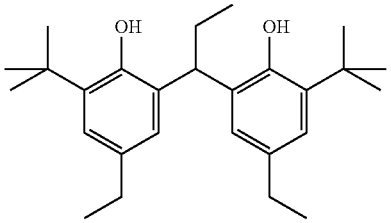
-continued
R-8
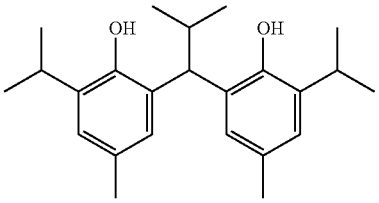
R-9
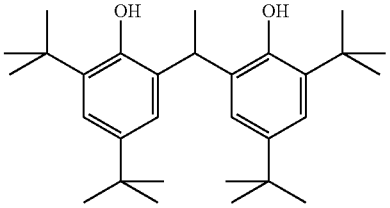
R-10
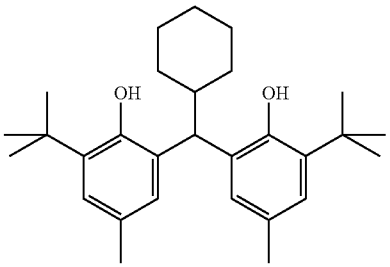
R-11
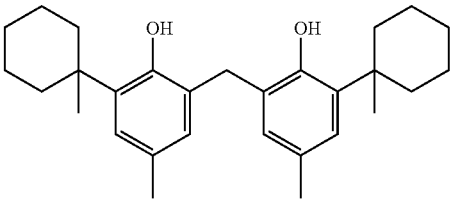
R-12
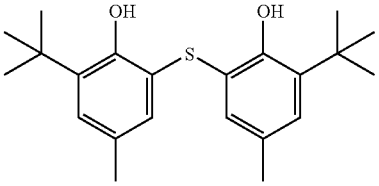
R-13
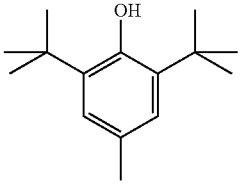
R-14
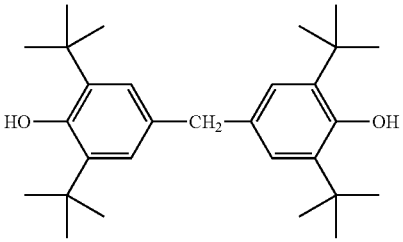

-continued

R-15

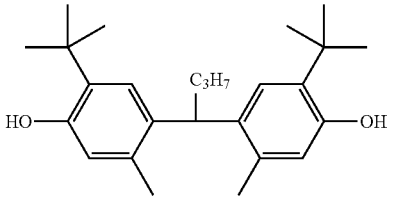

R-16

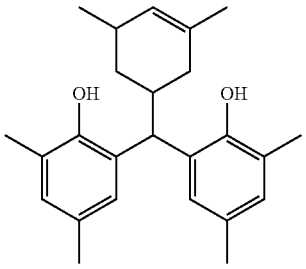

R-17

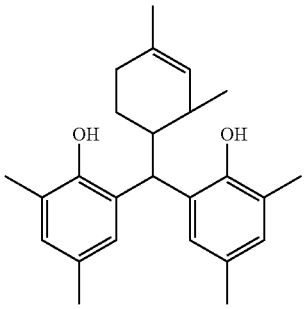

R-18

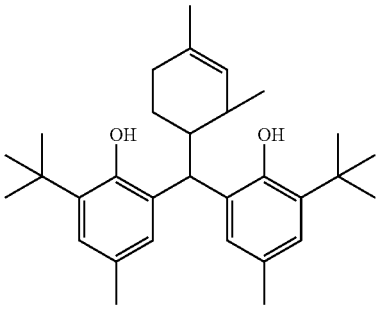

The addition amount of the reducing agent for forming a silver image or the auxiliary reducing agent for forming a color image is preferably from 0.1 g/m$^2$ to 3.0 g/m$^2$, more preferably from 0.2 g/m$^2$ to 1.5 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent for forming a silver image or the auxiliary reducing agent for forming a color image is preferably contained in the image forming layer.

The reducing agent for forming a silver image or the auxiliary reducing agent for forming a color image is preferably used as a solid particle dispersion, and is added in the form of fine particles having a mean particle size of from 0.01 μm to 10 μm, preferably from 0.05 μm to 5 μm and, more preferably from 0.1 μm to 2 μm.

(Photosensitive Silver Halide)

1) Halogen Composition

For the photosensitive silver halide used in the invention, there is no particular restriction on the halogen composition and silver chloride, silver chlorobromide, silver bromide, silver iodobromide, silver iodochlorobromide, or silver iodide can be used.

When the photosensitive silver halide used in the invention is used for the blue sensitive layer, it is also preferred that the photosensitive silver halide has an average silver iodide content of 40 mol % or higher. It is more preferred that the average silver iodide content is 80 mol % or higher, and it is even more preferred that the average silver iodide content is 90 mol % or higher.

The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. A core-high-silver iodide-structure which has a high content of silver iodide in the core part, and a shell-high-silver iodide-structure which has a high content of silver iodide in the shell part can also be preferably used. Further, a technique of localizing silver bromide or silver iodide on the surface of a grain as form epitaxial parts can also be preferably used.

The silver halide having a high silver iodide content of the invention can assume any of a β phase or a γ phase. The term "β phase" described above means a high silver iodide structure having a wurtzite structure of a hexagonal system and the term "γ phase" means a high silver iodide structure having a zinc blend structure of a cubic crystal system. An average content of γ phase in the present invention is determined by a method presented by C. R. Berry. In the method, an average content of γ phase is calculated from the peak ratio of the intensity owing to γ phase (111) to that owing to β phase (100), (101), (002) in powder X-ray diffraction method. Detail description, for example, is described in Physical Review, volume 161 (No. 3), pages 848 to 851 (1967).

2) Grain Size

The grain size of the photosensitive silver halide is preferably small with an aim of suppressing clouding after image formation and, specifically, it is 0.20 μm or less, more preferably, in a range of from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

When the photosensitive silver halide used in the invention is used for the blue sensitive layer, a grain size large enough to achieve high sensitivity can also be selected.

In the present invention, it is preferred that 50% or more of a total projected area of the photosensitive silver halide grains is occupied by grains having a projected area equivalent diameter of from 0.3 μm to 5.0 μm, and more preferably from 0.35 μm to 3.0 μm. The term "projected area equivalent diameter" used here means a diameter of a circle having the same area as the projected area of one silver halide grain. As for a measuring method, the area of a grain is calculated from projected area of individual grains by observation through an electron microscope, and thereafter the projected area equivalent diameter is determined by converting the area to a circle having an area equivalent to the obtained area. In this case, a mean grain thickness of the photosensitive silver halide is preferably 0.3 μm or less, more preferably 0.2 μm or less, and even more preferably 0.15 μm or less.

3) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, most preferably, from 0.07 $g/m^2$ to 0.3 $g/m^2$. The photosensitive silver halide is preferably used in a range of from 0.01 mol to 0.5 mol, more preferably from 0.02 mol to 0.3 mol, and even more preferably from 0.03 mol to 0.2 mol, per 1 mol of the organic silver salt.

When the photosensitive silver halide used in the invention is used for the blue sensitive layer, the coating amount of silver halide is limited to a lower level in spite of the requirement for high sensitivity. It is because the increase of the coating amount of silver halide may result in decreasing the film transparency and deteriorating the image quality. However, when a silver iodide complex-forming agent is used in the present invention, more amount of silver halide can be coated because thermal development can decrease the haze of film caused by the residual silver halide.

In the present invention, the coating amount of the silver halide is preferably in a range from 1 mol % to 100 mol %, per 1 mol of non-photosensitive organic silver salt, more preferably from 2 mol % to 60 mol %, and particularly preferably from 3 mol % to 45 mol %.

4) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

As for the method of forming tabular grains of silver iodide, the methods described in JP-A Nos. 59-119350 and 59-119344 are preferably used.

5) Grain Shape

While examples of shapes of silver halide grains in the invention are cubic grains, octahedral grains, dodecahedral grains, tetradecahedral grains, tabular grains, spherical grains, rod-like grains, potato-like grains, and the like, preferable are tabular grains, dodecahedral grains, and tetradecahedral grains. The term "dodecahedral grain" means a grain having faces of (001), {1(−1)0} and {101} and the term "tetradecahedral grain" means a grain having faces of (001), {100} and {101}. Here, the {100} face and {101} face express families of crystallographic planes equivalent to a (100) face and (101) face, respectively.

According to the methods of preparing dodecahedral, tetradecahedral, and octahedral silver iodide grains, the methods described in JP-A Nos. 2002-081020, 2003-287835, and 2003-287836 can be used for reference. When the photosensitive silver halide used in the invention is used for the blue sensitive layer, the silver halide grains are preferably tabular grains. The mean aspect ratio is preferably 2 or more, more preferably in a range of from 2 to 100, and even more preferably from 5 to 50.

6) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used together. A preferred content is in a range of from $1\times10^{-9}$ mol to $\mathbf{1\times10^{-3}}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6{}^{3-}]$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complexes is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

7) Sensitizing Dye

It is preferred that at least one of the image forming layers according to the present invention is appropriately spectrally sensitized so that the plural image forming layers have spectral sensitivities that are different from one another.

The methods for providing different spectral sensitivity to silver halide grains incorporated in the image forming layer include the following means;

(1) A method for providing different spectral sensitivity selected from infrared sensitivity, red sensitivity, and green sensitivity, to the silver halide grains individually.

(2) A method for providing spectral sensitivity selected from infrared sensitivity, red sensitivity, and green sensitivity, together with blue sensitivity to the silver halide grains.

In the embodiment of method (2), preferably the blue sensitivity due to an inherent sensitivity of the silver halide grains sensitized with one or more spectral sensitivity selected from infrared sensitivity, red sensitivity, and green sensitivity is sufficiently lower than the blue sensitivity of the blue sensitized silver halide grains. Sufficient low blue sensitivity means that the sensitivity difference ($\Delta$log E) in blue sensitivity is 0.3 or more, preferably 0.5 or more, and more preferably 1.0 or more. The blue sensitivity used herein means a logarithm of a reciprocal of the exposure value (E) necessary for giving a middle point density upon exposure to blue light. The middle point density used herein means a value obtained by dividing the sum of fog and maximum density (Dmax) by 2.

In another embodiment of method (2), by disposing a blue light absorbing layer between the blue sensitive layer and the other spectral sensitive layer, imagewise exposure to the other spectral sensitive layer can be performed through the blue light absorbing layer.

As the sensitizing dye applicable in the invention, those which spectrally sensitizes the silver halide grains in a desired wavelength region upon adsorption to the silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Gelatin

As the gelatin contained the photosensitive silver halide emulsion used in the invention, various gelatins can be used. It is necessary to maintain an excellent dispersion state of a photosensitive silver halide emulsion in a coating solution containing an organic silver salt, and gelatin having a low molecular weight of 500 to 60,000 is preferably used. These gelatins having a low molecular weight may be used at grain formation step or at the time of dispersion after desalting treatment and it is preferably used at the time of dispersion after desalting treatment.

9) Chemical Sensitization

The photosensitive silver halide in the present invention can be used without chemical sensitization, but is preferably chemically sensitized by at least one of chalcogen sensitizing method, gold sensitizing method and reduction sensitizing method. The chalcogen sensitizing method includes sulfur sensitizing method, selenium sensitizing method, and tellurium sensitizing method.

In sulfur sensitization, unstable sulfur compounds can be used. Such unstable sulfur compounds are described in Chemie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element, and active gelatin can be used. Specifically, thiosulfates, thioureas, and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea and acetyltrimethylselemourea), selenamides (e.g., selenamide and N,N-diethylphenylselenamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, and diacylselenides can be used. Furthermore, non-unstable selenium compounds such as selenius acid, selenocyanic acid, selenazoles, and selenides, and the like described in JP-B Nos. 46-4553 and 52-34492 can also be used. Specifically, phosphineselenides, selenoureas, and salts of selenocyanic acids are preferred.

In the tellurium sensitization, unstable tellurium compounds are used. Unstable tellurium compounds described in JP-A Nos. 4-224595, 4-271341, 4-333043, 5-303157, 6-27573, 6-175258, 6-180478, 6-208186, 6-208184, 6-317867, 7-140579, 7-301879, and 7-301880, and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride, and ethoxy-diphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride, and bis(ethoxycarbonyl)telluride), telluroureas (e.g., N,N'-dimethylethylenetellurourea and N,N'-diphenylethylenetellurourea), telluroamides, telluroesters, and the like are used. Specifically, diacyl(di)tellurides and phosphinetellurides are preferred. Especially, the compounds described in paragraph No. 0030 of JP-A No. 11-65021 and compounds represented by formula (II), (III), or (IV) in JP-A No. 5-313284 are more preferred.

Specifically, as for the chalcogen sensitization of the invention, selenium sensitization and tellurium sensitization are preferred, and tellurium sensitization is particularly preferred.

In gold sensitization, gold sensitizer described in Chemie et Physique Photographique, written by P. Grafkides, (Paul Momtel, 5th ed., 1987) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belgium Patent No. 691857, and the like can also be used. And another novel metal salts other than gold such as platinum, palladium, iridium and the like, which are described in Chemie et Pysique Photographique, written by P. Grafkides, (Paul Momtel, 5th ed., 1987) and Research Disclosure (vol. 307, Item 307105), can be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of chalcogen sensitizer used in the invention may vary depending on the silver halide grain used, the chemical ripening condition and the like and it is used by about $10^{-8}$ mol to $10^{-1}$ mol, preferably, $10^{-7}$ mol to $10^{-2}$ mol, per 1 mol of silver halide.

The addition amount of the gold sensitizer may vary depending on various conditions and it is generally from $10^{-7}$ mol to $10^{-2}$ mol and, preferably from $10^{-6}$ mol to $5\times10^{-3}$ mol, per 1 mol of silver halide. There is no particular restriction on the condition for the chemical sensitization and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is from 3 to 10, and preferably, from 4 to 9; and the temperature is from 20° C. to 95° C., and preferably, from 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide, or dimethylamine borane is preferred, as well as use of stannous chloride, aminoimino methane sulfonic acid, hydrazine derivatives, borane compounds, silane compounds, polyamine compounds, and the like are preferred.

The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293,917.

The photosensitive silver halide grain in the invention is preferably chemically sensitized by at least one method of gold sensitizing method and chalcogen sensitizing method for the purpose of designing a high-sensitivity photothermographic material.

10) Compound that is One-Electron-Oxidized to Provide a One-Electron Oxidation Product which Releases One or More Electrons The photothermographic material of the invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No.

2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). And preferable ranges of these compounds are the same as the preferable ranges described in the quoted specifications.

Formula (1)

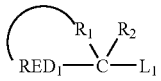

Formula (2)

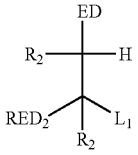

Formula (3)

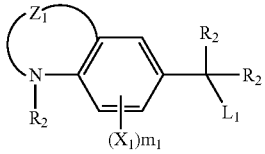

Formula (4)

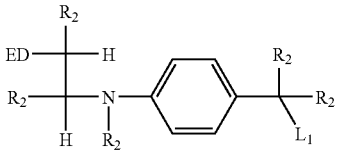

Formula (5)

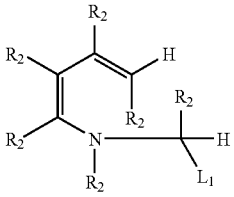

Formula (6)

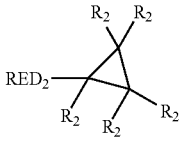

Formula (7)

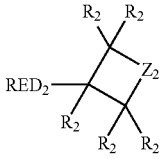

-continued

Formula (8)

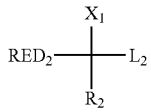

Reaction formula (1)

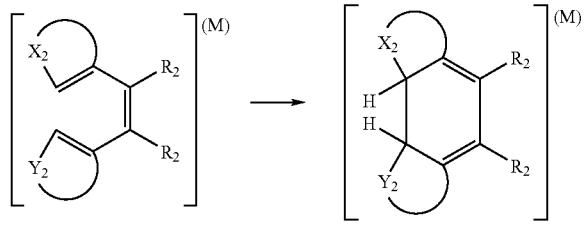

Formula (9)

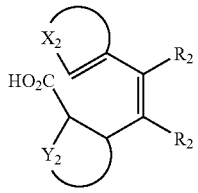

In the formulae, $RED_1$ and $RED_2$ represent a reducing group. $R_1$ represents a nonmetallic atomic group forming a cyclic structure equivalent to a tetrahydro derivative or an octahydro derivative of a 5- or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group capable to form a 6-membered ring with a nitrogen atom and two carbon atoms of a benzene ring. $X_1$ represents a substituent, and $m_1$ represents an integer of from 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxy group or a salt thereof, or a hydrogen atom. $X_2$ represents a group to form a 5-membered heterocycle with C═C. $Y_2$ represents a group to form a 5-membered aryl group or heterocyclic group with C═C. M represents one selected from a radical, a radical cation, or a cation.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). Preferable ranges of these compounds are the same as the preferable ranges described in the quoted specifications.

$RED_6$-Q-Y Formula (10)

Reaction formula (1)

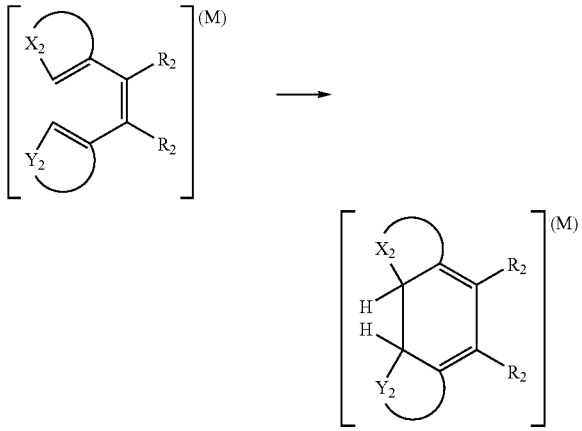

Formula (11)

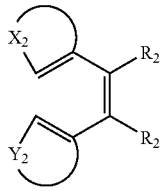

In the formulae described above, X represents a reducing group which can be one-electron-oxidized. Y represents a reactive group containing a carbon-carbon double bond part, a carbon-carbon triple bond part, an aromatic group part or benzo-condensed non-aromatic heterocyclic group which reacts with one-electron-oxidized product formed by one-electron-oxidation of X to form a new bond. $L_2$ represents a linking group to link X and Y. $R_2$ represents a hydrogen atom or a substituent. In the case where plural $R_2$s exist in a same molecule, these may be identical or different from one another.

$X_2$ represents a group to form a 5-membered heterocycle with C═C. $Y_2$ represents a group to form a 5- or 6-membered aryl group or heterocyclic group with C═C. M represents one selected from a radical, a radical cation, or a cation.

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group which forms silver iminate (—N(Ag)—), as a partial structure of heterocycle (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$—, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

11) Compound Having Adsorptive Group and Reducing Group

The photothermographic material of the present invention preferably comprises a compound having an adsorptive group to silver halide and a reducing group in a molecule. It is preferred that the compound is represented by the following formula (Rd).

$$A\text{-}(W)_n\text{—}B \qquad \text{Formula (Rd)}$$

In formula (Rd), A represents a group which adsorbs to a silver halide (hereafter, it is called an adsorptive group); W represents a divalent linking group; n represents 0 or 1; and B represents a reducing group.

In formula (Rd), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also includes a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having an —NH— group, which forms silver iminate (—N(Ag)—, as a partial structure of a heterocycle) or a heterocyclic group having an —S— group, a —Se— group, a —Te— group, or a ═N— group, which coordinates to a silver ion by a coordination bond, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (Rd), a heterocyclic group substituted by a mercapto group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group which forms silver iminate (—N(Ag)—) as a partial structure of heterocycle (for example, a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (Rd), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (Rd), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (Rd), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (Rd), a reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (Rd) according to the present invention may have the ballasted group or polymer chain in it generally used in the non-moving photographic additives as a coupler. And as a polymer, for example, the polymer described in JP-A No. 1-100530 can be selected.

The compound of formula (Rd) according to the present invention may be bis or tris type of compound. The molecular weight of the compound represented by formula (Rd) according to the present invention is preferably from 100 to 10000, more preferably from 120 to 1000, and particularly preferably from 150 to 500.

The examples of the compound represented by formula (Rd) according to the present invention are shown below, but the present invention is not limited in these.

(1)

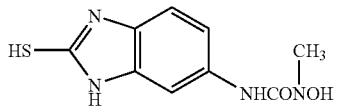

(2)

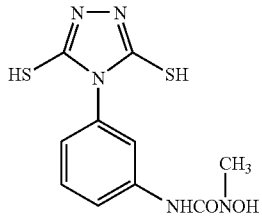

(3)

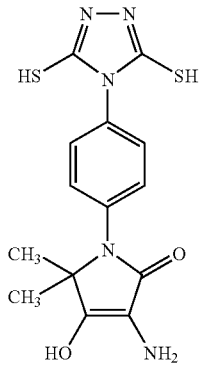

(4)

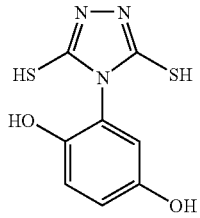

-continued
(5)
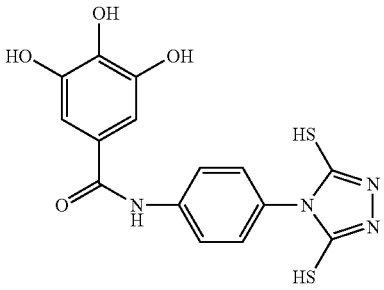
(6)
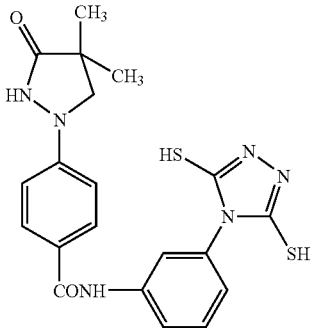
(7)
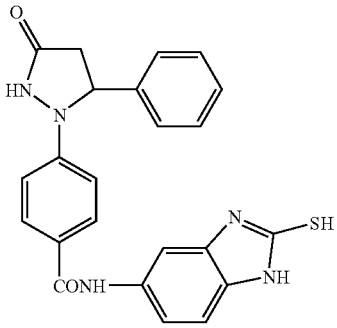
(8)
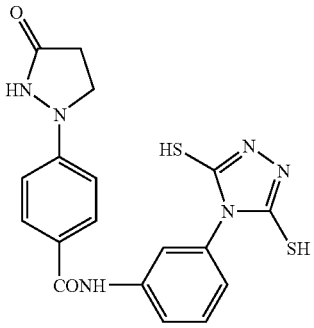
-continued
(9)
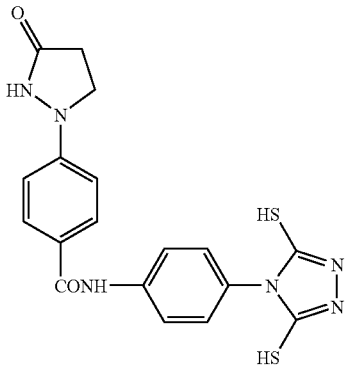
(10)
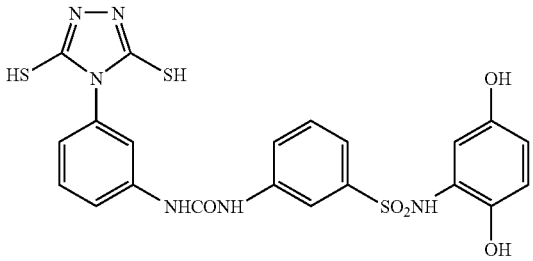
(11)
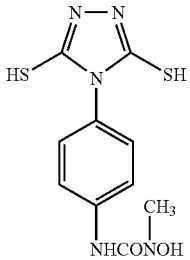
(12)
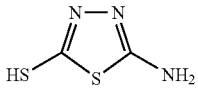
(13)
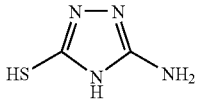
Further, example compounds 1 to 30 and 1"-1 to 1"-77 shown in EP No. 1308776A2, pages 73 to 87 are also described as preferable examples of the compound having an adsorptive group and a reducing group according to the invention.
These compounds can be easily synthesized by any known method. The compound of formula (Rd) according to the present invention can be used alone, but it is preferred to use two or more of the compounds in combination. When two or more of the compounds are used in combination, those may be added to the same layer or the different layers, whereby adding methods may be different from each other.

The compound represented by formula (Rd) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (Rd) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

12) Combined Use of Silver Halides

The photosensitive silver halide emulsion in the photothermographic material used in the invention may be used alone, or two or more of them (for example, those of different average particle sizes, different halogen compositions, of different crystal habits and of different conditions for chemical sensitization) may be used together. Gradation can be controlled by using plural photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

13) Mixing Silver Halide and Organic Silver Salt

The photosensitive silver halide in the invention is particularly preferably formed in the absence of the non-photosensitive organic silver salt and chemically sensitized. This is because sometimes sufficient sensitivity can not be attained by the method of forming the silver halide by adding a halogenating agent to an organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, homogenizer, or the like, or a method of mixing a photosensitive silver halide completed for preparation at any timing in the preparation of an organic silver salt and preparing the organic silver salt. The effect of the invention can be obtained preferably by any of the methods described above.

14) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Development Accelerator)

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a high boiling solvent which is solid at a normal temperature and an auxiliary solvent having a low boiling point, or to add as a so-called oilless emulsified dispersion not using a solvent having a high boiling point.

In the present invention, among the development accelerators described above, hydrazine compounds represented by formula (D) described in the specification of JP-A No. 2002-156727, and phenolic or naphtholic compounds represented by formula (2) described in the specification of JP-A No. 2001-264929 are more preferred.

Particularly preferred development accelerators of the invention are compounds represented by the following formulae (A-1) or (A-2).

$$Q_1\text{-NHNH-}Q_2 \qquad \text{Formula (A-1)}$$

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated heterocycle are more preferred. Further, $Q_2$ is preferably a carbamoyl group and, particularly, a carbamoyl group having a hydrogen atom on the nitrogen atom is particularly preferred.

Formula (A-2)

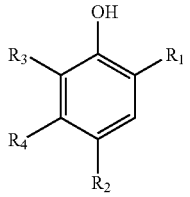

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

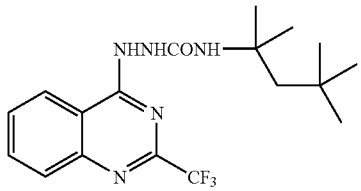

A-2

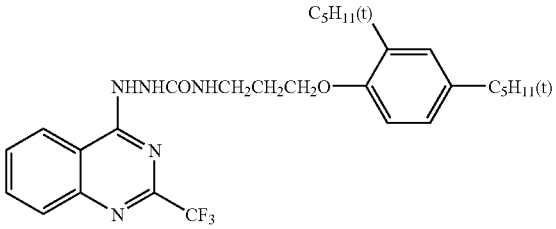

A-3

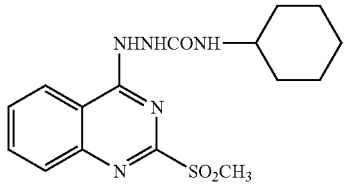

A-4

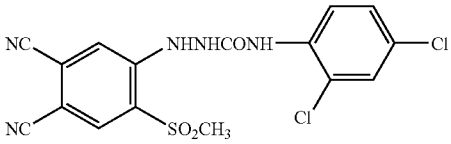

A-5

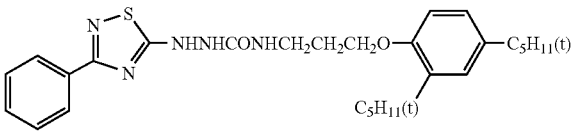

-continued

A-6

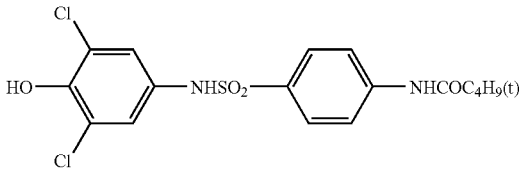

A-7

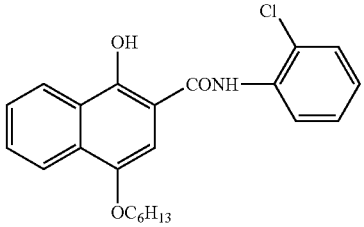

A-8

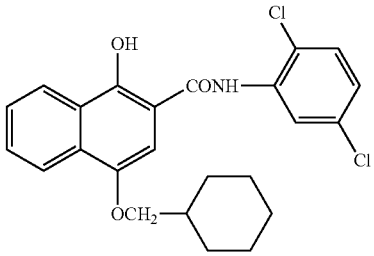

A-9

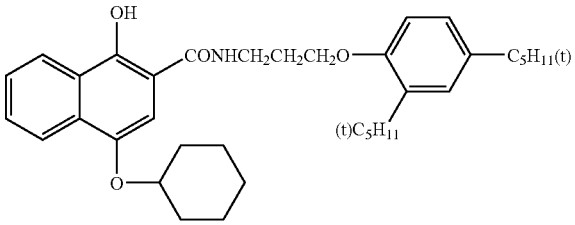

A-10

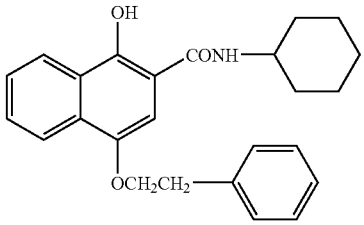

A-11

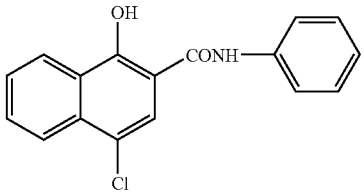

-continued

A-12

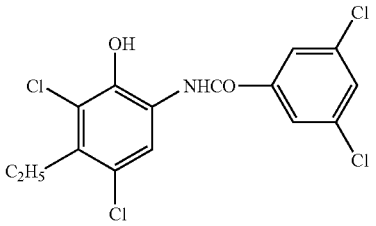

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group which reacts with these groups of the reducing agent and forms a hydrogen bond therewith.

As the group forming a hydrogen bond with a hydroxy group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound expressed by formula (D) shown below.

Formula (D)

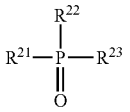

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxy group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others according to the invention are shown below, but the invention is not limited thereto.

D-1

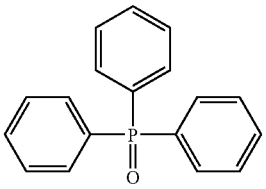

D-2

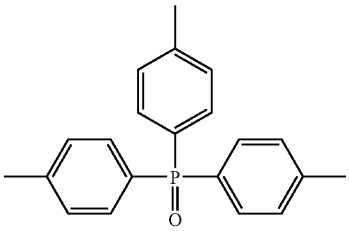

D-3

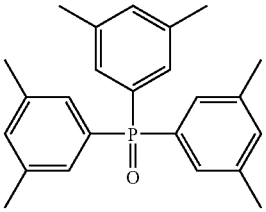

-continued

D-4

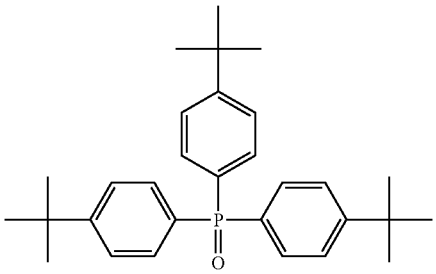

D-5

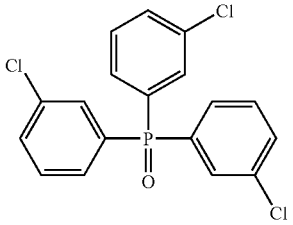

D-6

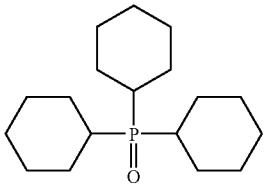

D-7

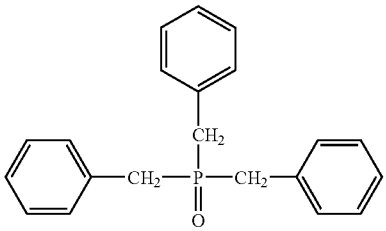

D-8

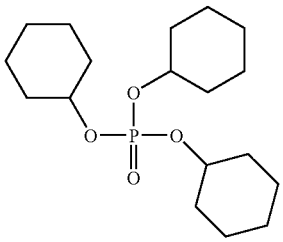

D-9

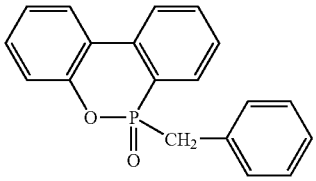

D-10

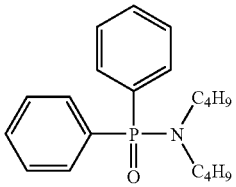

-continued

D-11

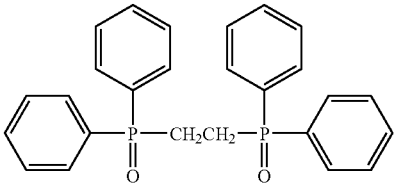

D-12

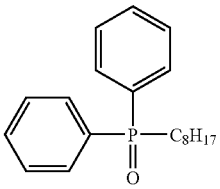

D-13

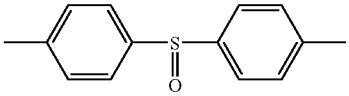

D-14

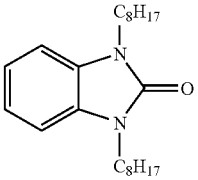

D-15

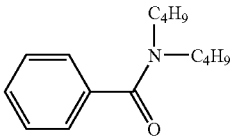

Specific examples of hydrogen bonding compounds other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Binder for Image Forming Layer)

Any kind of polymer may be used as the binder for the image forming layer of the invention. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly (methacrylic acids), styrene-maleic anhydride copolymers, styrene-acrylonitrile copolymers, styrene-butadiene copolymers, poly(vinyl acetals) (e.g., poly(vinyl formal) or poly (vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent, or emulsion to form a coating solution.

The glass transition temperature (Tg) of the binder which is used in the image forming layer is preferably in a range of from 10° C. to 80° C., more preferably from 20° C. to 70° C. and, even more preferably from 23° C. to 65° C.

In the specification, Tg is calculated according to the following equation:

$$1/Tg=\Sigma(Xi/Tgi)$$

where the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more polymers depending on needs. And, the polymer having Tg of 20° C. or more and the polymer having Tg of less than 20° C. can be used in combination. In the case where two or more polymers differing in Tg may be blended for use, it is preferred that the weight-average Tg is in the range mentioned above.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower at 25° C. and 60% RH is used, the performance can be enhanced.

Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent.

As the water-miscible organic solvent, there can be described, for example, alcohols such as methyl alcohol, ethyl alcohol, propyl alcohol, or the like; cellosolves such as methyl cellosolve, ethyl cellosolve, butyl cellosolve, or the like; ethyl acetate; dimethylformamide; or the like.

The term "equilibrium water content at 25° C. and 60% RH" as referred herein can be expressed as follows:

$$\text{Equilibrium water content at 25° C. and 60\% RH} = [(W1-W0)/W0]\times 100 \text{ (\% by weight)}$$

wherein W1 is the weight of the polymer in moisture-controlled equilibrium under the atmosphere of 25° C. and 60% RH, and W0 is the absolutely dried weight at 25° C. of the polymer. For the definition and the method of measurement for water content, reference can be made to Polymer Engineering Series 14, "Testing methods for polymeric materials" (The Society of Polymer Science, Japan, published by Chijin Shokan).

The equilibrium water content at 25° C. and 60% RH is preferably 2% by weight or lower, and is more preferably, in a range of from 0.01% by weight to 1.5% by weight, and is even more preferably, from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodispersed particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer.

The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor.

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)- (molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)- (molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

P-17; Latex of -St(61.5)-Isoprene(35.5)-AA(3)-(crosslinking, Tg 17° C.)

P-18; Latex of -St(67)-Isoprene(28)-Bu(2)-AA(3)-(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like. The polymer latex above may be used alone, or may be used by blending two or more of them depending on needs.

Particularly preferable as the polymer latex for use in the invention are that of styrene-butadiene copolymer and that of styrene-isoprene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer.

Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above. Further, the ratio of copolymerization and the like in the styrene-isoprene copolymer are similar to those in the styrene-butadiene copolymer.

As the latex of styrene-butadiene copolymer preferably used in the invention, there can be mentioned P-3 to P-9 and P-15 described above, and commercially available LACSTAR-3307B, 7132C, Nipol Lx416, and the like. And as examples of the latex of styrene-isoprene copolymer, there can be mentioned P-17 and P-18 described above.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like.

These hydrophilic polymers are added at an amount of 30% by weight or less, and preferably 20% by weight or less, with respect to the total weight of the binder incorporated in the image forming layer.

According to the invention, the image forming layer is preferably formed by using polymer latex for the binder. Concerning the amount of the binder for the image forming layer, the mass ratio of total binder to organic silver salt (total binder/organic silver salt) is preferably in a range of from 1/10 to 10/1, and more preferably from 1/5 to 4/1.

Further, the mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, and more preferably from 1 $g/m^2$ to 15 $g/m^2$. As for the image forming layer of the invention, there may be added a crosslinking agent for crosslinking, a surfactant to improve coating ability, or the like.

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or higher, and even more preferably 70% by weight or higher.

Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

1) Organic Polyhalogen Compound

Preferable organic polyhalogen compound that can be used in the invention is explained specifically below. In the invention, preferred organic polyhalogen compound is the compound expressed by the following formula (H).

$$Q\text{-}(Y)_n\text{—}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom. Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

The compound expressed by formula (H) of the invention is preferably used in an amount of from $10^{-4}$ mol to 1 mol, more preferably from $10^{-3}$ mol to 0.5 mol, and further preferably from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

Specific examples of the compound expressed by formula (H) of the invention are shown below.

H-1

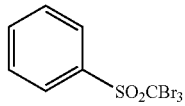

H-2

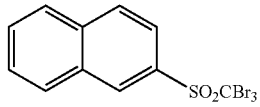

H-3

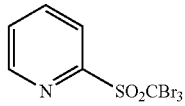

H-4

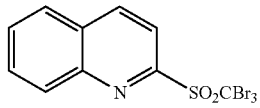

H-5

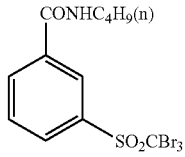

H-6

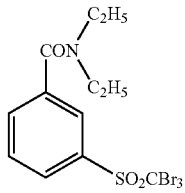

H-7

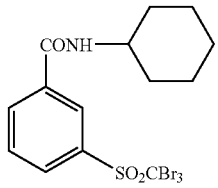

H-8

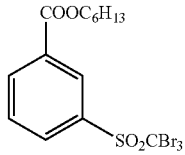

-continued

H-9

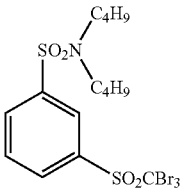

H-10

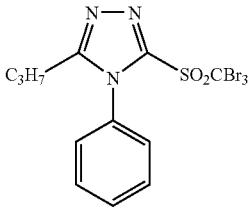

H-11

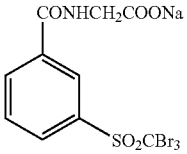

H-12

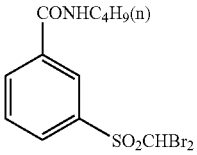

H-13

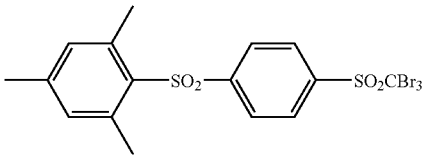

H-14

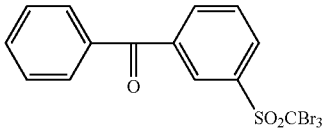

H-15

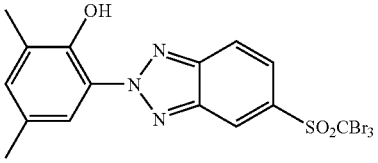

H-16

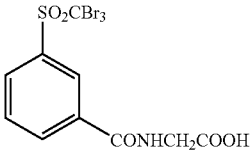

H-17

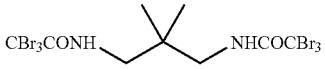

H-18

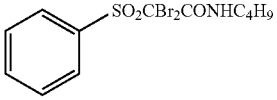

-continued

H-19

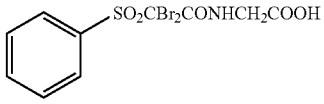

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911 and 20001-312027 are preferable.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to claim 9 of JP-A No. 11-352624, a compound expressed by formula (III), 4-hydroxy-6-methyl-1,3,3a, 7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used.

Furthermore, it may be added as a solution having mixed therein other additives such as sensitizing agents, reducing agents, toners, and the like.

In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storage stabilities of before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, addition of a toner is preferred. Description on the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

(Layer Constitution and Constituent Components)

The photothermographic materials of the present invention has at least two image forming layers including a silver image forming layer and a color image forming layer. The silver halide emulsion layer (the image forming layer) comprising each image forming layer has a different spectral sensitivity. Examples of the spectral sensitivity which can be employed for each layer include various spectral sensitivities well-known in the conventional photographic silver halide materials, such as infrared sensitivity, red sensitivity, green sensitivity, blue sensitivity, and ultraviolet sensitivity. The combination thereof is not particularly limited.

As regards the arrangement of the image forming layers, all image forming layers may be disposed on the same side of the support, or separately on both sides of the support. Preferably, all image forming layers are disposed on the same side of the support.

The silver image forming layer and the color image forming layer each may be composed of one layer or plural layers constructed on a support. In the case of constituting the image forming layer from plural layers, the layers comprising a high sensitivity silver halide emulsion and a low sensitivity silver halide emulsion or the layers comprising silver halide emulsions having different types of gradation are preferably employed.

In the practice of the present invention, the photothermographic material may have a non-photosensitive layer in addition to the image forming layer.

Examples of the non-photosensitive layer include a surface protective layer to protect the surface of the image forming layer, an undercoat layer and under layer between the image forming layer and the support, an intermediate layer between the image forming layers, and a back layer in the case where the image forming layers are disposed only on one side of the support. As the non-photosensitive layer, a filter layer containing dyes or pigments may be disposed in order to control the sensitivity of the image forming layer or to adjust the relative sensitivity of plural image forming layers.

In the practice of the present invention, silver halide grains, dye-providing couplers, and a color developing agent (or a precursor thereof) may be incorporated in the same layer. However, when they are in a reactive association, the above components can be incorporated in separate layers. For example, the layer including a color developing agent and the layer including silver halide grains are preferably provided separately to improve raw stock storability.

The photothermographic material may include a hardener, a surfactant, a photographic stabilizer, an antistatic agent, a lubricant, a matting agent, a latex, a formalin scavenger, a dye, an ultraviolet absorbing agent, and the like for various purposes. Specific examples of these are described in Research Disclosure mentioned above, JP-A No. 9-204031, and the like.

(Image Forming Method)

As medical diagnostic images, for example, in case of inspecting tumors by means of PET, the specifications of the anatomical position therewith are also necessary for the inspection at the same. Therefore, an overlapping display of the images obtained by CT and MRI are important. Conventionally, plural kinds of image information obtained by the above individual means are subjected to digitization, and thereafter, by comparing the positional information therewith for registration and using transformation parameters (parallel movement and rotation) obtained therefrom, overlapped images can be shown on the display screen. A specific marker, or the like is employed for the registration.

FIG. 1 is a diagram showing an example of a procedure for forming a fusion image from plural kinds of image information derived from PET and X-ray CT information.

A composite image is formed by a transmission image and an X-ray CT image which are transmitted through DICOM (Digital Imaging and Communication in Medicine). The above process is a composing process for morphological information. Therefore, comparison of morphologies is possible without any markers, but by marking several points thereon, it is possible to compare the morphologies automatically by using computer. On the other hand, PET image obtained separately can provide functional information which is used for tumor malignant diagnosis, inspection of infiltrative region of cancer, or detection of metastatic tumor, with the use of a tracer accumulated in a specific site. Positional transformation parameters can be obtained by comparing positional information derived from PET image with positional information obtained from the transmission image and an X-ray CT image. Thereby, a fusion image of PET image and X-ray CT image is shown on the display screen.

On the other hand, PET image in which the positional transformation information is added to the respective image information is recorded in the photothermographic material by scanning exposure using laser beam A, and similarly, X-ray CT image is recorded in the same material by scanning exposure using laser beam B. The latent image formed by laser beam A and the latent image formed by laser beam B each is formed individually in the respective image forming layer having spectral sensitivity corresponding to the wavelength region of the exposure. Upon thermal development after imagewise exposure, each layer forms a black and white image due to developed silver image and a color image, or different color images.

The procedure for forming a PET-CT fusion image is explained above and formation of fusion images of any other methods can be performed similarly to the procedure described above.

Examples of the combination forming fusion images include the followings.

PET image/MRI image

SPECT image/CT image

SPECT image/MRI image

1) Exposure

The photothermographic material of the invention may be subjected to imagewise exposure by any means, but at least two kinds of image information are recorded by lights having different wavelengths from each other. The exposure mode thereof may be chosen from any means such as scanning exposure using a laser beam or one-shot exposure using a camera, but preferably, all image information is recorded by a scanning exposure.

After exposing either one of the silver image forming layer and the color image forming layer, sequentially the other layer may be exposed; or before finishing the first exposure, the remaining exposure may be sequentially performed; or simultaneous exposure may be performed.

As laser beam source which can be used in the invention, He—Ne laser of red through infrared emission, red laser diode, or $Ar^+$, He—Ne, He—Cd laser of blue through green emission, or blue laser diode are described. Preferred is laser diode such as red laser diode, infrared laser diode, or blue laser diode.

Preferred combinations in the practice of the present invention include a combination of red laser diode and blue laser diode, a combination of infrared laser diode and blue laser diode, and a combination of red laser diode and infrared laser diode. The lasers used for the silver image forming layer or the color image forming layer may be arbitrary chosen from either lasers described above.

Preferably, one laser diode is used for silver image formation and the other laser diode having the wavelength region different from the above is used for color image formation. In the case where the color image forming layer comprises two or more layers having different spectral sensitivity, laser diodes corresponding to the respective wavelength region are employed. For example, infrared laser diode may be used for the silver image formation and red, green, or blue laser diode used for the color image formation.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, and even more preferably from 5 seconds to 25 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed.

Preferable imagers which enable a rapid process according to the invention are described in, for example, JP-A Nos. 2002-289804 and 2002-287668.

(Application of the Invention)

The image forming method using the photothermographic material of the present invention is preferably employed to record a fusion image, as a medical image recording method.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

1. Preparation of PET Support and Undercoating (1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

(2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV A·minute/m$^2$ was executed, judging from the readings of current and voltage on that occasion. The frequency upon this treatment was 9.6 kHz, and the gap clearance between the electrode and dielectric roll was 1.6 mm.

(3) Undercoating

1) Preparations of Coating Solution for Undercoat Layer

| Formula (1) (for undercoat layer on the image forming layer side) | |
|---|---|
| Pesresin A-520 manufactured by Takamatsu Oil & Fat Co., Ltd. (30% by weight solution) | 59 g |
| Polyethyleneglycol mononononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| Distilled water | 935 mL |

| Formula (2) (for first layer on the backside) | |
|---|---|
| Styrene-butadiene copolymer latex (solid content of 40% by weight, styrene/butadiene mass ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |

| Formula (3) (for second layer on the backside) | |
|---|---|
| $SnO_2$/SbO (9/1 by mass ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

2) Undercoating

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 7.7 mL/m$^2$, and dried at 180° C. for 6 minutes. Thus, an undercoated support was produced.

2. Back Layer

1) Preparation of Coating Solution for Back Layer

<<Preparation of Dispersion of Solid Fine Particles (a) of Base Precursor>>

2.5 kg of base precursor-1,300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

<<Preparation of Solid Fine Particle Dispersion of Dye>>

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of an antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

<<Preparation of Coating Solution for Antihalation Layer>>

A vessel was kept at 40° C., and thereto were added 37 g of gelatin having an isoelectric point of 6.6 (ABA gelatin, manufactured by Nippi Co., Ltd.), 0.1 g of benzoisothiazolinone, and water to allow gelatin to be dissolved. Additionally, 36 g of the above-described dispersion of the solid fine particles of the dye, 73 g of the above-described dispersion of the solid fine particles (a) of the base precursor, 1.5 g of ultraviolet absorbing agent-1, 43 mL of a 3% by weight aqueous solution of sodium polystyrenesulfonate, and 82 g of a 10% by weight liquid of SBR latex (styrene/butadiene/acrylic acid copolymer; mass ratio of the copolymerization of 68.3/28.7/3.0) were admixed to give a coating solution for the antihalation layer in an amount of 773 mL. The pH of the resulting coating solution was 6.3.

<<Preparation of Coating Solution for Back Surface Protective Layer>>

A vessel was kept at 40° C., and thereto were added 43 g of gelatin having an isoelectric point of 4.8 (PZ gelatin, manufactured by Miyagi Chemical Industry Co., Ltd.), 0.21 g of benzoisothiazolinone, and water to allow gelatin to be dissolved. Additionally, 8.1 mL of a 1 mol/L sodium acetate aqueous solution, 0.93 g of monodispersed fine particles of poly(ethylene glycol dimethacrylate-co-methyl methacrylate) (a mean particle diameter of 7.7 μm, and a standard deviation of particle diameter of 0.3), 5 g of a 10% by weight emulsion of liquid paraffin, 10 g of a 10% by weight emulsion of dipentaerythritol hexaisostearate, 10 mL of a 5% by weight aqueous solution of sodium di(2-ethylhexyl) sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight liquid of ethyl acrylate/acrylic acid copolymer (mass ratio of the copolymerization of 96.4/3.6) latex were admixed. Just prior to the coating, 50 mL of a 4% by weight aqueous solution of N,N-ethylenebis (vinylsulfone acetamide) was admixed to give a coating solution for the back surface protective layer in an amount of 855 mL. The pH of the resulting coating solution was 6.2.

2) Coating of Back Layer

The backside of the undercoated support described above was subjected to simultaneous double coating so that the coating solution for the antihalation layer gave the coating amount of gelatin of 0.54 g/m$^2$, and so that the coating solution for the back surface protective layer gave the coating amount of gelatin of 1.85 g/m$^2$, followed by drying to produce a back layer.

Base precursor-1

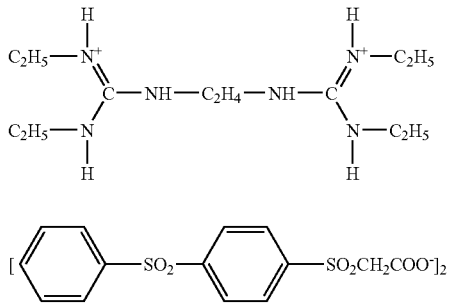

Cyanine dye-1

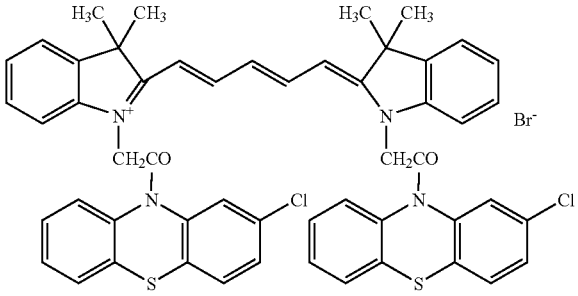

-continued

Ultraviolet absorbing agent-1

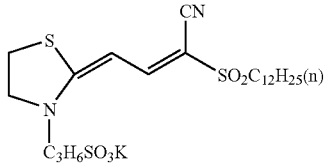

3. Image Forming Layer, Intermediate Layer, and Surface Protective Layer 3-1. Preparations of Coating Material 1) Preparation of Silver Halide Emulsion (Preparation of Silver Halide Emulsion 1—Preparation of Blue Sensitive Emulsion)

-Preparation of Host Grains-

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. The method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. The method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The obtained silver halide grains were grains having a mean projected area equivalent diameter of 0.93 μm, a variation coefficient of a projected area equivalent diameter distribution of 17.7%, a mean thickness of 0.057 μm, and a mean aspect ratio of 16.3. Tabular grains having an aspect ratio of 2 or more occupied 80% or more of the total projected area. A mean equivalent spherical diameter of the grains was 0.42 μm.

30% or more of the silver iodide existed in γ phase from the result of powder X-ray diffraction analysis.

-Preparation of Epitaxial Junction Portion- 1 mol of the host tabular emulsion described above was added to a reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

-Chemical Sensitization-

The above silver halide emulsion having an epitaxial junction portion was kept at 38° C. with stirring, and to each was added 5 mL of a 0.34% by weight methanol solution of 1,2-benzoisothiazolin-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. Then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to obtain silver halide emulsion 1.

Preparation of Emulsion 1 for Coating Solution

The obtained silver halide emulsion was dissolved and thereto was added benzothiazolium iodide in a 1% by weight aqueous solution to give $7\times10^{-3}$ mol per 1 mol of silver. Further, as "a compound that is one-electron-oxidized to provide a one-electron oxidation product, which releases one or more electrons", the compounds Nos. 1, 2, and 3 are added respectively in an amount of $2\times10^{-3}$ mol per 1 mol of silver in silver halide. Thereafter, as "a compound having an adsorptive group and a reducing group", the compound Nos. 1 and 2 are added respectively in an amount of $8\times10^{-3}$ mol per 1 mol of silver halide. Further, water is added thereto to give the content of silver halide of 15.6 g in terms of silver, per 1 liter of the emulsion for a coating solution.

(Preparation of Silver Halide Emulsion 2—Preparation of Red Sensitive Emulsion-)

<<Preparation of Silver Halide Emulsion A>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion B>>

Preparation of silver halide dispersion B was conducted in a similar manner to the process in the preparation of the silver halide emulsion A except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion A. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion B similar to the silver halide emulsion A except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver.

Grains in the silver halide emulsion B were cubic pure silver bromide grains having a mean equivalent spherical diameter of 0.080 μm and a variation coefficient of an equivalent spherical diameter distribution of 20%.

<<Preparation of Silver Halide Emulsion C>>

Preparation of silver halide dispersion C was conducted in a similar manner to the process in the preparation of the silver halide emulsion A except that the temperature of the liquid upon the grain forming process was altered from 30° C. to 27° C., and in addition, the precipitation/desalting/water washing/dispersion were carried out similarly to the silver halide emulsion A. Silver halide emulsion C was obtained similarly to the silver halide emulsion A except that: the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion C were silver iodobromide grains having a mean equivalent spherical diameter of 0.034 μm and a variation coefficient of an equivalent spherical diameter distribution of 20%, which uniformly include iodine at 3.5 mol %.

-Preparation of Mixed Emulsion 2 for Coating Solution-

The silver halide emulsion A at 70% by weight, the silver halide emulsion B at 15% by weight, and the silver halide emulsion C at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $5\times10^{-3}$ mol per 1 mol of silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

Spectral sensitizing dye A

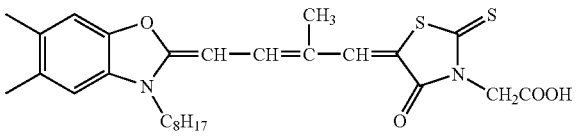

Spectral sensitizing dye B

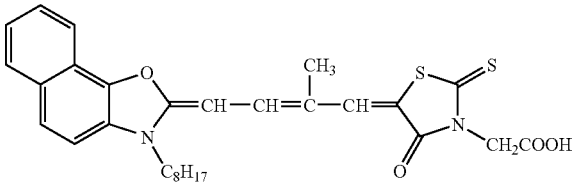

Tellurium sensitizer C

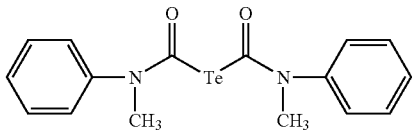

Compound 1 that is one-electron-oxidized to provide a one-electron oxidation product which releases one or more electrons

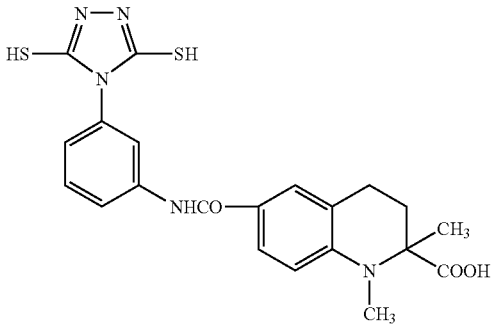

Compound 2 that is one-electron-oxidized to provide a one-electron oxidation product which releases one or more electrons

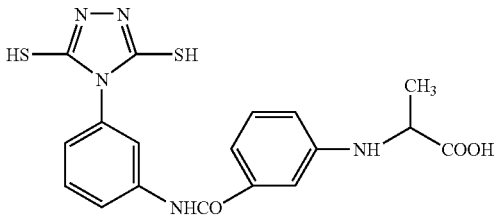

Compound 3 that is one-electron-oxidized to provide a one-electron oxidation product which releases one or more electrons

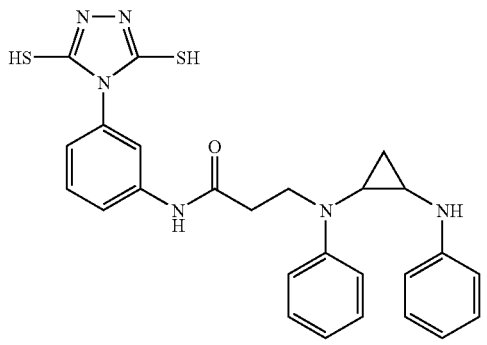

Compound 1 having adsorptive group and reducing group

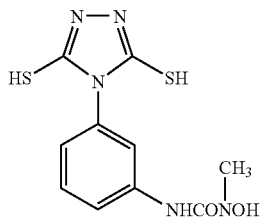

Compound 2 having adsorptive group and reducing group

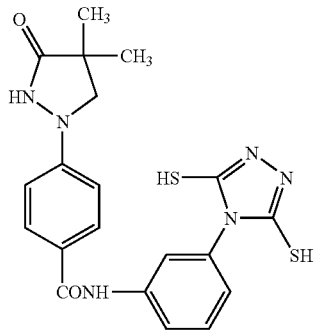

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<Preparation of Reducing Agent-1 Dispersion>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<Preparation of Reducing Agent-2 Dispersion>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less.

The resultant reducing agent dispersion was subjected to filtration with a polypropylene filter having a pore size of 3.0 μm to remove foreign substances such as dust, and stored.

<Preparation of Auxiliary Reducing Agent-1 Dispersion>

To 10 kg of auxiliary reducing agent-1 (1,1-bis(2-hydroxy-3,5-dimethylphenyl)-3,5,5-trimethylhexane) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the auxiliary reducing agent to be 25% by weight. This dispersion was subjected to heat treatment at 60° C. for 5 hours to obtain auxiliary reducing agent-1 dispersion.

Particles of the auxiliary reducing agent included in the resulting auxiliary reducing agent dispersion had a median diameter of 0.40 μm, and a maximum particle diameter of 1.4 μm or less. The resulting auxiliary reducing agent dispersion was subjected to filtration with a polypropylene filter having a pore size of 3.0 μm to remove foreign substances such as dust, and stored.

<Preparation of Dispersion of Reducing Agent Represented by Formula (I)>

The dispersion of reducing agent (23) of formula (I) described below was prepared in a similar manner to the process in the preparation of the auxiliary reducing agent-1 dispersion.

Reducing agent (23)

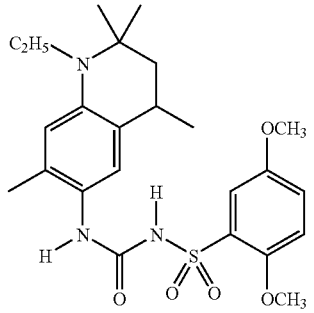

4) Preparations of Coupler Dispersion

The dispersions of cyan couplers described below were prepared in a similar manner to the process in the preparation of the auxiliary reducing agent-1 dispersion.

(C-1)

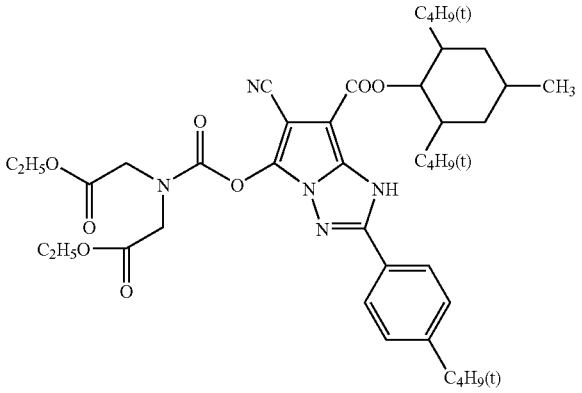

(C-3)

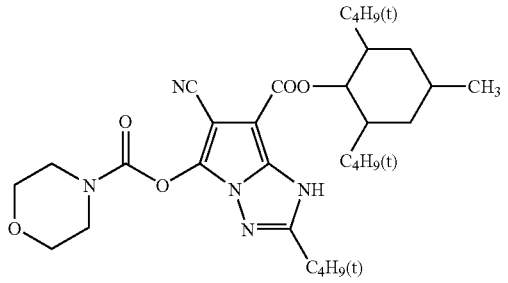

5) Preparation of Hydrogen Bonding Compound Dispersion

<Preparation of Hydrogen Bonding Compound-1 Dispersion>

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

6) Preparations of Development Accelerator Dispersions and Color-Tone-Adjusting Agent Dispersion To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resultant development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed similar to the development accelerator-1, and thus dispersions of 20% by weight and 15% by weight were respectively obtained.

7) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of 6-isopropyl phthalazine to prepare a 5% by weight solution of phthalazine compound-1.

9) Preparations of Solution of Additive

<Preparation of Aqueous Solution of Mercapto Compound-1>

Mercapto compound-1 (1-(3-sulfophenyl)-5-mercaptotetrazole sodium salt) in an amount of 7 g was dissolved in 993 g of water to give a 0.7% by weight aqueous solution.

<Preparation of Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

<Preparation of Aqueous Solution of Phthalic Acid>

A 20% by weight aqueous solution of diammonium phthalate was prepared.

10) Preparation of Latex Binder

<<Preparation of SBR Latex (TP-1) Liquid>>

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex (TP-1) was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, an ionic conductance of 4.80 mS/cm (measurement of the ionic conductance was performed using a conductivity meter CM-30S manufactured by Toa Electronics Ltd. for the latex stock solution (44% by weight) at 25° C.), and the pH of 8.4.

<<Preparation of Isoprene Latex (TP-2) Liquid>>

1500 g of distilled water were poured into the polymerization vessel of a gas monomer reaction apparatus (type TAS-2J manufactured by Tiatsu Garasu Kogyo Ltd.), and the vessel was heated for 3 hours at 90° C. to make passive film over the stainless vessel surface and stainless stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercapatn were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, the resulting mixture was filtered with a polypropylene filter having a pore size of 1.0 μm to remove foreign substances such as dust, and stored. 1248 g of isoprene latex (TP-2) was obtained. The measurement of halogen ion by an ion chromatography showed that the concentration of residual chloride ion was 3 ppm. The measurement by a high speed liquid chromatography showed that residual chelating agent concentration was 142 ppm.

The obtained latex has an average particle size of 113 nm, Tg=15° C., a solid content of 41.3% by weight, an equilibrium moisture content under the atmosphere of 25° C. and 60RH % of 0.4% by weight, and an ionic conductivity of 5.23 mS/cm (the measurement of which was carried out at 25° C. using a conductometer CM-30S produced by DKK-TOA Corp.).

3-2. Preparations of Coating Solution

1) Preparations of Coating Solution for Image Forming Layer

<<Preparation of Coating Solution for Silver Image Forming Layer>>

To the dispersion of the silver salt of a fatty acid obtained as described above in an amount of 1000 g were serially added water, the organic polyhalogen compound-1 dispersion, the organic polyhalogen compound-2 dispersion, the phthalazine compound-1 solution, the SBR latex (TP-1) liquid, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. The coating solution for the silver image forming layer was prepared by adding the silver halide emulsion 2 thereto, followed by thorough mixing just prior to the coating.

<<Preparation of Coating Solution for Color Image Forming Layer>>

To the dispersion of the silver salt of a fatty acid obtained as described above in an amount of 1000 g were serially added water, the organic polyhalogen compound-1 dispersion, the organic polyhalogen compound-2 dispersion, the SBR latex (TP-1) liquid, the isoprene latex (TP-2) liquid, the auxiliary reducing agent-1 dispersion, the dispersion of the reducing agent represented by formula (I), the cyan coupler dispersion, the hydrogen bonding compound-1 dispersion, the development accelerator-1 dispersion, the development accelerator-2 dispersion, the color-tone-adjusting agent-1 dispersion, the phthalazine compound-1 solution, the mercapto compound-1 aqueous solution, and the mercapto compound-2 aqueous solution. The coating solution for the color image forming layer was prepared by adding the silver halide emulsion 1 thereto, followed by thorough mixing just prior to the coating.

2) Preparation of Coating Solution for Intermediate Layer

To 1000 g of poly(vinyl alcohol) PVA-205 (manufactured by Kuraray Co., Ltd.), 272 g of the pigment-1 dispersion, 4200 mL of a 19% by weight liquid of methyl methacrylate/styrene/butyl acrylate/hydroxyethyl methacrylate/acrylic acid copolymer (mass ratio of the copolymerization of 64/9/20/5/2) latex, 27 mL of a 5% by weight aqueous solution of aerosol OT (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 9.1 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers 64 g of inert gelatin was dissolved in water, and thereto were added 112 g of a 19.0% by weight liquid of methyl methacrylate/styrene/butyl acrylate/hydroxyethyl methacrylate/acrylic acid copolymer (mass ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxyethyl alcohol, and 0.1 g of benzoisothiazolinone. Water was added to give a total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight liquid of methyl methacrylate/styrene/butyl acrylate/hydroxyethyl methacrylate/acrylic acid copolymer (mass ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol OT (manufactured by American Cyanamid Co.), 4 g of poly(methyl methacrylate) fine particles (mean particle diameter of 0.7 μm, distribution of volume weighted average being 30%), and 21 g of poly(methyl methacrylate) fine particles (mean particle diameter of 3.6 μm, distribution of volume weighted average being 60%), 1.6 g of 4-methyl phthalic acid, 4.8 g of phthalic acid, 44 mL of 0.5 mol/L sulfuric acid, and 10 mg of benzoisothiazolinone. Water was added to give a total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparation of Photothermographic Material 1

Reverse surface of the back surface was subjected to simultaneous overlaying coating by a slide bead coating method in order of the coating solution for the color image forming layer, the coating solution for the silver image forming layer, the coating solution for the intermediate layer, the coating solution for the first layer of surface protective layers, and the coating solution for the second layer of surface protective layers, and thus sample of photothermographic material was produced. In this method, the temperature of the coating solution was adjusted to 31° C. for the image forming layers and intermediate layer, to 36° C. for the first layer of the surface protective layers, and to 37° C. for the second layer of the surface protective layers.

The coating amount of each compound (g/m$^2$) for the image forming layers is as follows.

| <<Silver Image Forming Layer>> | |
|---|---|
| Silver salt of a fatty acid | 3.51 |
| Organic polyhalogen compound-1 | 0.06 |
| Organic polyhalogen compound-2 | 0.09 |
| Phthalazine compound-1 | 0.12 |
| SBR latex (TP-1) | 6.29 |
| Reducing agent-1 | 0.26 |
| Reducing agent-2 | 0.26 |

-continued

| | |
|---|---|
| Hydrogen bonding compound-1 | 0.19 |
| Development accelerator-1 | 0.016 |
| Development accelerator-2 | 0.013 |
| Color-tone-adjusting agent-1 | 0.005 |
| Mercapto compound-1 | 0.001 |
| Mercapto compound-2 | 0.004 |
| Silver halide emulsion 2 (on the basis of Ag content) | 0.09 |
| <<Color Image Forming Layer>> | |
| Silver salt of a fatty acid | 2.22 |
| Organic polyhalogen compound-1 | 0.05 |
| Organic polyhalogen compound-2 | 0.13 |
| Phthalazine compound-1 | 0.61 |
| SBR latex (TP-1) | 2.77 |
| Isoprene latex (TP-2) | 4.16 |
| Auxiliary reducing agent-1 | 0.04 |
| Reducing agent (23) represented by formula (I) | 0.79 |
| Cyan coupler (C-1) | 0.124 |
| Cyan coupler (C-3) | 0.108 |
| Hydrogen bonding compound-1 | 0.20 |
| Development accelerator-1 | 0.027 |
| Development accelerator-2 | 0.013 |
| Color-tone-adjusting agent-1 | 0.003 |
| Mercapto compound-1 | 0.001 |
| Mercapto compound-2 | 0.004 |
| Silver halide emulsion 1 (on the basis of Ag content) | 0.23 |

Conditions for coating and drying were as follows.

The support was decharged by ionic wind. Coating was performed at the speed of 160 m/min. Conditions for coating and drying were adjusted within the range described below, and conditions were set to obtain the most stable surface state. The clearance between the leading end of the coating die and the support was from 0.10 mm to 0.30 mm. The pressure in the vacuum chamber was set to be lower than atmospheric pressure by 196 Pa to 882 Pa. In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus. After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the back surface as Beck's smoothness. In addition, measurement of pH of the film surface on the image forming layer side gave the result of 6.0.

Chemical structures of the compounds used in Examples of the invention are shown below.

Reducing agent-1

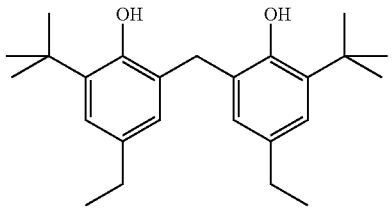

-continued

Reducing agent-2

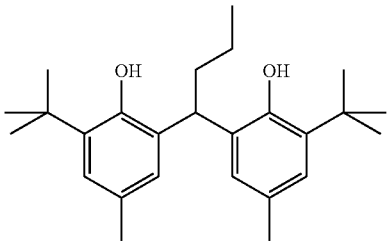

Auxiliary reducing agent-1

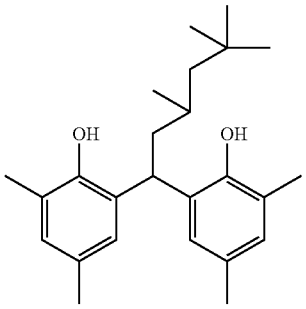

Hydrogen bonding compound-1

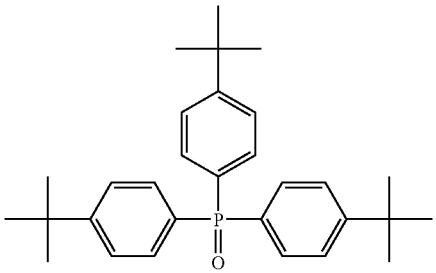

Organic polyhalogen compound-1

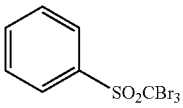

Organic polyhalogen compound-2

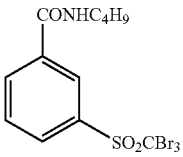

Mercapto compound-1

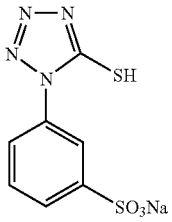

Mercapto compound-2

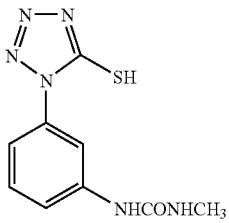

-continued

Phthalazine compound-1

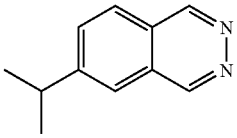

Development accelerator-1

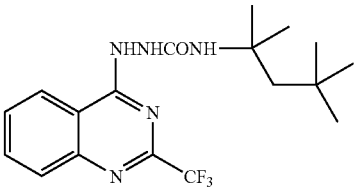

Development accelerator-2

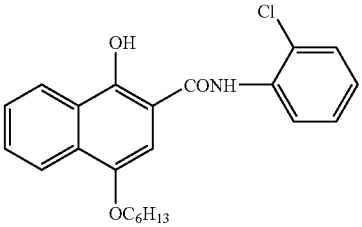

Color-tone-adjusting agent-1

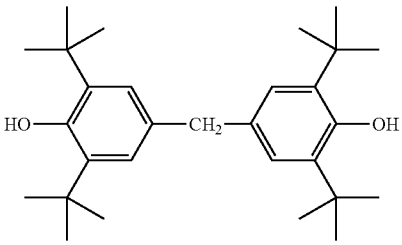

(F-1)

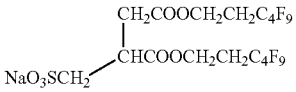

(F-2)

Mixture of

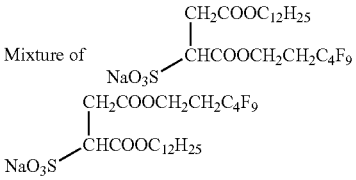

and

5. Evaluation of Performance

1) Imagewise Exposure and Thermal Development

<<Exposure>>

Exposure was performed using a Fuji Medical Dry Laser Imager DRYPIX 7000 (equipped with 660 nm red laser diode having a maximum output of 50 mW (IIIB)) in which a NDHV 310ACA laser diode fabricated by Nichia Corporation as a blue laser diode beam source was mounted in an exposure portion thereof and a beam diameter thereof was adjusted to about 100 μm.

The blue laser diode and the red laser diode were controlled separately, and the blue laser diode emitted functional images from PET and the red laser diode emitted morphological images from CT. Thereby, the sample was exposed simultaneously by the above lasers while conveying the sample.

<<Thermal Development>>

Thermal development of the exposed sample was performed using the thermal developing portion of Fuji Medical Dry Laser Imager DRYPIX 7000 in conditions that 3 panel heaters were set 107° C.-121° C.-121° C., and a total time period for thermal development was set to 14 seconds.

2) Evaluation of Performance

A hard copy of obtained fusion image was observed on a lighting table as a transmitted image and compared with the fusion image shown on a high definition liquid crystal display screen (5 mega pixel) used for medical use. As a result, the photothermographic material of the present invention exhibits excellent performances such as high definition and high density and attain superior diagnostic quality, compared with the fusion images displayed on the liquid crystal display screen for medical use.

Example 2

1. Preparations of Photosensitive Silver Halide Emulsion (Preparation of Silver Halide Emulsion 3-Preparation of Infrared Sensitive Emulsion-)

Silver halide emulsion 3 was prepared in a similar manner to the process in the preparation of silver halide emulsion 2 except that the infrared sensitizing dye described below was used instead of the sensitizing dyes A and B. The infrared sensitizing dye was added in an amount to make sensitization efficiency to a maximum.

Infrared sensitizing dye

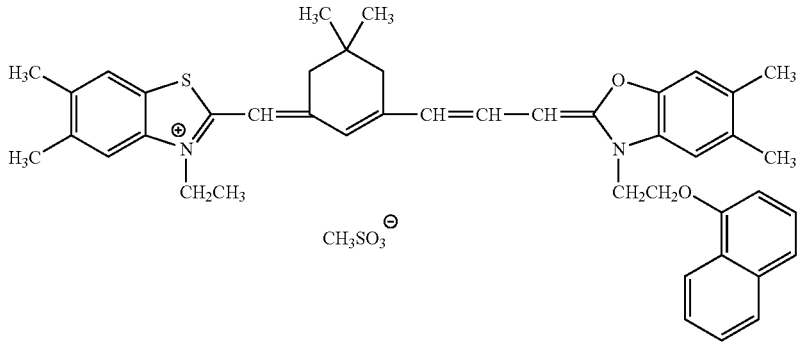

(Preparation of Silver Halide Emulsion 4-Preparation of Green Sensitive Emulsion-)

Silver halide emulsion 4 was prepared in a similar manner to the process in the preparation of silver halide emulsion 2 except that the orthochromatic spectral sensitizing dyes described below were used instead of the sensitizing dyes A and B. The sensitizing dye-1, -2, and -3 were mixed in a ratio of 1:1:10 and added to make sensitization efficiency to a maximum.

(Orthochromatic Sensitizing Dye)

Sensitizing dye-1

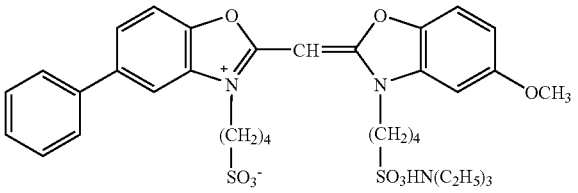

-continued

Sensitizing dye-2

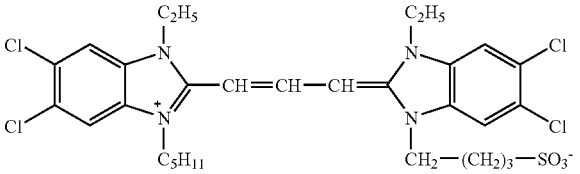

Sensitizing dye-3

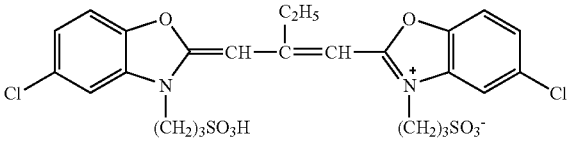

2. Preparations of Coating Solution for Image Forming Layer

<<Coating Solution for Silver Image Forming Layer>>

The coating solution for the silver image forming layer was prepared in a similar manner to the process in the preparation of the coating solution for the silver image forming layer of Example 1 except that silver halide emulsion 3 was used instead of silver halide emulsion 2.

<<Preparation of Coating Solution A for Color Image Forming Layer —Cyan Color Forming Layer>>

Coating solution A for the color image forming layer was prepared in a similar manner to the process in the preparation of the coating solution for the color image forming layer of Example 1 except that silver halide emulsion 2 was used instead of silver halide emulsion 1.

<<Preparation of Coating Solution B for Color Image Forming Layer -Magenta Color Forming Layer->>

Coating solution B for the color image forming layer was prepared in a similar manner to the process in the preparation of the coating solution for the color image forming layer of Example 1 except that silver halide emulsion 4 was used instead of silver halide emulsion 1, and coupler (M-1), (M-4), and (M-7) were used instead of coupler (C-1) and (C-3).

(M-1)

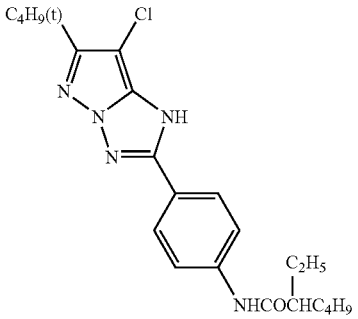

(M-4)

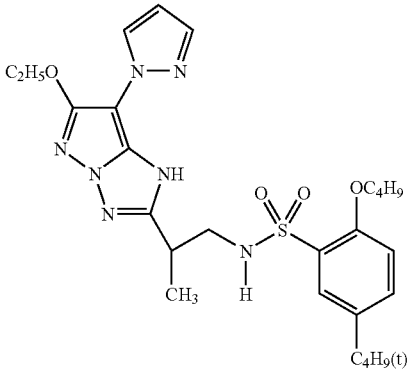

(M-7)

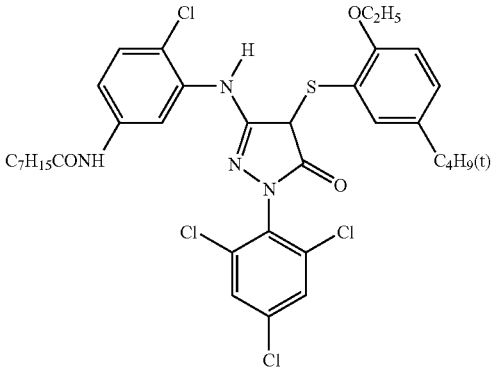

3. Preparation of Sample

Reverse surface of the back surface was subjected to simultaneous overlaying coating by a slide bead coating method in order of the coating solution A for the color image forming layer, the coating solution B for the color image forming layer, the coating solution for the silver image forming layer, the coating solution for the intermediate layer, the coating solution for the first layer of surface protective layers, and the coating solution for the second layer of surface protective layers, and thus sample of photothermographic material was produced. In this method, the temperature of the coating solution was adjusted to 31° C. for the image forming layers and intermediate layer, to 36° C. for the first layer of the surface protective layers, and to 37° C. for the second layer of the surface protective layers.

The coating amount of each compound (g/m$^2$) for the image forming layers is as follows.

| <<Silver Image Forming Layer>> | |
|---|---|
| Silver salt of a fatty acid | 3.51 |
| Organic polyhalogen compound-1 | 0.06 |
| Organic polyhalogen compound-2 | 0.09 |
| Phthalazine compound-1 | 0.12 |
| SBR latex (TP-1) | 6.29 |
| Reducing agent-1 | 0.26 |
| Reducing agent-2 | 0.26 |
| Hydrogen bonding compound-1 | 0.19 |
| Development accelerator-1 | 0.016 |
| Development accelerator-2 | 0.013 |
| Color-tone-adjusting agent-1 | 0.005 |
| Mercapto compound-1 | 0.001 |
| Mercapto compound-2 | 0.004 |
| Silver halide emulsion 3 (on the basis of Ag content) | 0.09 |

| <<Color Image Forming Layer A>> | |
|---|---|
| Silver salt of a fatty acid | 1.67 |
| Organic polyhalogen compound-1 | 0.04 |
| Organic polyhalogen compound-2 | 0.10 |
| Phthalazine compound-1 | 0.46 |
| SBR latex (TP-1) | 2.08 |
| Isoprene latex (TP-2) | 3.12 |
| Auxiliary reducing agent-1 | 0.05 |
| Reducing agent (23) represented by formula (I) | 0.59 |
| Cyan coupler (C-1) | 0.093 |
| Cyan coupler (C-3) | 0.081 |
| Hydrogen bonding compound-1 | 0.15 |
| Development accelerator-1 | 0.020 |
| Development accelerator-2 | 0.009 |
| Color-tone-adjusting agent-1 | 0.002 |
| Mercapto compound-1 | 0.001 |
| Mercapto compound-2 | 0.003 |
| Silver halide emulsion 2 (on the basis of Ag content) | 0.04 |

| <<Color Image Forming Layer B>> | |
|---|---|
| Silver salt of a fatty acid | 1.67 |
| Organic polyhalogen compound-1 | 0.04 |
| Organic polyhalogen compound-2 | 0.10 |
| Phthalazine compound-1 | 0.46 |
| SBR latex (TP-1) | 2.08 |
| Isoprene latex (TP-2) | 3.12 |
| Auxiliary reducing agent-1 | 0.05 |
| Reducing agent (23) represented by formula (I) | 0.59 |
| Magenta coupler (M-1) | 0.042 |
| Magenta coupler (M-4) | 0.056 |
| Magenta coupler (M-7) | 0.074 |
| Hydrogen bonding compound-1 | 0.15 |
| Development accelerator-1 | 0.020 |
| Development accelerator-2 | 0.009 |
| Color-tone-adjusting agent-1 | 0.002 |
| Mercapto compound-1 | 0.001 |
| Mercapto compound-2 | 0.003 |
| Silver halide emulsion 4 (on the basis of Ag content) | 0.04 |

4. Evaluation of Performance

1) Imagewise Exposure and Thermal Development

<<Exposure>>

Exposure was performed using a Fuji Medical Dry Laser Imager DRYPIX 7000 (equipped with 660 nm red laser diode having a maximum output of 50 mW (IIIB)) in which an infrared laser diode and a green oscillating laser were mounted in an exposure portion thereof and a beam diameter thereof was adjusted to about 100 μm.

As the infrared laser diode, GaAlAs (oscillation wavelength of 808.5 nm) is employed. As the green oscillating laser, 252 excimer laser having a wavelength of 532 nm is employed, which is taken out by exciting a solid state laser $YVO_4$ (Yttrium Orthvanadate) crystal by using GaAlAs laser diode (oscillation wavelength of 808.5 nm) as a excitation source, and by subjecting the oscillation wavelength of 1064 nm to the wavelength conversion (half the wavelength) consisted of KTP (potassium titanyl phosphate) crystal as SHG (second harmonic generation) device.

The red laser diode, the infrared laser diode, and the green oscillating laser were controlled separately. Therefore, functional images and their intensity distribution of SPECT (single photon emission computed tomography) were recorded in two colors by using the red laser diode and the green oscillating laser, and morphological image by MRI (magnetic resonance imaging) was recorded by the infrared laser diode. Thereby, the sample was exposed simultaneously by the above lasers while conveying the sample.

<<Thermal Development>>

Thermal development of the exposed sample was performed using the thermal developing portion of Fuji Medical Dry Laser Imager DRYPIX 7000 in conditions that 3 panel heaters were set 107° C.-121° C.-121° C., and a total time period for thermal development was set to 14 seconds.

2) Evaluation of Performance

A hard copy of obtained fusion image was observed on a lighting table as a transmitted image and compared with the fusion image shown on a high definition liquid crystal display screen (5 mega pixel) used for medical use. As a result, the photothermographic material of the present invention exhibits excellent performances such as high definition and high density and attain superior diagnostic quality, compared with the fusion images displayed on the liquid crystal display screen for medical use.

What is claimed is:

1. An image forming method using a photothermographic material comprising, on a support, at least a photosensitive silver halide, a non-photosensitive organic silver salt, a reducing agent for silver ions, and a binder, wherein the photothermographic material comprises at least two image forming layers having spectral sensitivities that are different from each other, and wherein the image forming method comprises: exposing the photothermographic material with different image information by using at least two laser beams having wavelengths that are different from each other and correspond to photosensitive wavelengths of the image forming layers; and thermally developing the photothermographic material to form a fusion image made up of two or more images.

2. The image forming method according to claim 1, wherein the fusion image is formed by at least one image information which is medical morphological information and at least one other image information which is medical functional information.

3. The image forming method according to claim 2, wherein the medical morphological information is CT (Computed Tomography) information or MRI (Magnetic Resonance Imaging) information.

4. The image forming method according to claim 2, wherein the medical functional information is PET (Positron Emission Tomography) information or SPECT (Single Photon Emission Computed Tomography) information.

5. The image forming method according to claim 2, wherein the medical morphological information is CT information or MRI information, and the medical functional information is PET information or SPECT information.

6. The image forming method according to claim 1, wherein at least one layer of the image forming layers is a color image forming layer comprising a color image forming material.

7. The image forming method according to claim 6, wherein at least one layer of the image forming layers is a silver image forming layer which forms an image substantially constituted by a silver image, and at least one other layer of the image forming layers is a color image forming layer comprising a color image forming material.

8. The image forming method according to claim 6, wherein at least two layers of the image forming layers are color image forming layers which form color images having different hues from each other.

9. The image forming method according to claim 6, wherein a reducing agent contained in the color image forming layer comprises a compound represented by the following formula (I):

Formula (I)

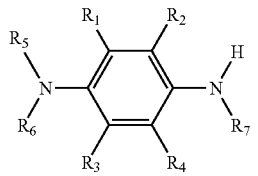

wherein $R_1$, $R_2$, $R_3$ and $R_4$ each independently represent a hydrogen atom or a substituent; $R_5$ and $R_6$ each independently represent one selected from an alkyl group, an aryl group, a heterocyclic group, an acyl group, or a sulfonyl group; members in at least one combination of $R_1$ and $R_2$, $R_3$ and $R_4$, $R_5$ and $R_6$, $R_2$ and $R_5$, and $R_4$ and $R_6$ may bond to each other to form a 5-, 6-, or 7-membered ring; $R_7$ represents $R_{11}$—O—CO—, $R_{12}$—CO—CO—, $R_{13}$—NH—CO—, $R_{14}$—$SO_2$—, $R_{15}$—W—C($R_{16}$)($R_{17}$)—, $R_{19}$—$SO_2$NHCO—, $R_{20}$—CONHCO—, $R_{21}$—$SO_2$NH$SO_2$—, $R_{22}$—CONH$SO_2$—, or $(M)_{1/n}OSO_2$—; $R_{11}$, $R_{12}$, $R_{13}$, $R_{14}$, $R_{19}$, $R_{20}$, $R_{21}$, and $R_{22}$ each independently represent an alkyl group, an aryl group, or a heterocyclic group; $R_{15}$ represents a hydrogen atom or a block group; W represents an oxygen atom, a sulfur atom, or —N($R_{18}$)—; $R_{16}$, $R_{17}$ and $R_{18}$ each independently represent a hydrogen atom or an alkyl group; and M represents a cation having a valency of n.

10. The image forming method according to claim 9, wherein $R_7$ in formula (I) represents $R_{11}$—O—CO— or $R_{19}$—$SO_2$NHCO—.

11. The image forming method according to claim 9, wherein the reducing agent contained in the color image forming layer is a compound represented by the following formula (II):

Formula (II)

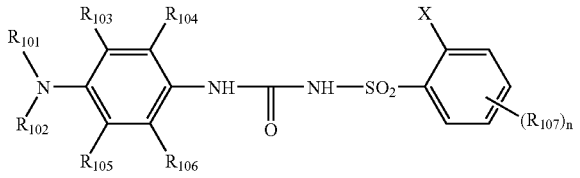

wherein $R_{101}$ and $R_{102}$ each independently represent a substituted or unsubstituted alkyl group, aryl group, heterocyclic group, acyl group, alkylsulfonyl group, or arylsulfonyl group; $R_{103}$, $R_{104}$, $R_{105}$, $R_{106}$, and $R_{107}$ each independently represent a hydrogen atom or a substituent; members in at least one combination of $R_{101}$ and $R_{102}$, $R_{103}$ and $R_{104}$, $R_{105}$ and $R_{106}$, and $R_{107}$ and X may bond to each other to form a 5-, 6-, or 7-membered ring; X represents a halogen atom or a substituent having a heteroatom through which the substituent bonds to the benzene ring; n represents an integer of from 0 to 4; and when n represents 2 or more, a plurality of $R_{107}$ may be the same or different from one another and may bond to one another to form a 5-, 6-, or 7-membered ring.

12. The image forming method according to claim 9, wherein the reducing agent contained in the color image forming layer is a compound represented by the following formula (III):

Formula (III)

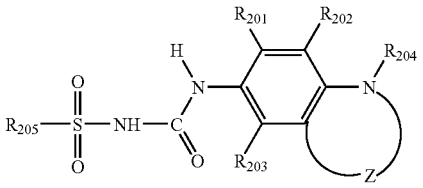

wherein $R_{201}$, $R_{202}$, and $R_{203}$ each independently represent a hydrogen atom or a substituent; $R_{204}$ represents an alkyl group, an aryl group, or a heterocyclic group; members in at least one combination of $R_{201}$ and $R_{202}$, and $R_{202}$ and $R_{204}$ may bond to each other to form a 5-, 6-, or 7-membered ring; Z represents a non-metallic atomic group for forming a 5-, 6-, or 7-membered ring together with a nitrogen atom and two carbon atoms in a benzene ring; $R_{205}$ represents an alkyl group, an aryl group, or a heterocyclic group; and no hydroxy group, carboxy group, or sulfo group is contained in any of $R_{201}$ to $R_{204}$.

13. The image forming method according to claim 12, wherein $R_{205}$ in formula (Ill) is a group represented by the following formula (IV):

Formula (IV)

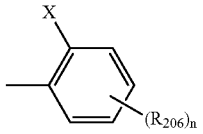

wherein X represents a halogen atom or a group which substitutes for a hydrogen atom on a benzene ring through a heteroatom; $R_{206}$ represents a substituent; n represents an integer of from 0 to 4; and when n represents 2 or more, a plurality of $R_{206}$ may be the same or different from one another, and two adjacent groups thereamong may bond to each other to form a 5-, 6-, or 7-membered ring.

14. The image forming method according to claim 6, wherein the color image forming material is a coupler which reacts with an oxidation product of the reducing agent to form a dye.

15. The image forming method according to claim 1, wherein the binder is formed by a polymer latex.

16. The image forming method according to claim 7, wherein the photothermographic material comprises the silver image forming layer on one side of the support and the color image forming layer on the other side of the support.

17. The image forming method according to claim 7, wherein the silver image forming layer and the color image forming layer are disposed on the same side of the support.

* * * * *